US006603939B1

(12) United States Patent
Toba et al.

(10) Patent No.: US 6,603,939 B1
(45) Date of Patent: Aug. 5, 2003

(54) DEVELOPING APPARATUS, PROCESS CARTRIDGE, CONNECTING METHOD BETWEEN DEVELOPING FRAME AND DEVELOPER FRAME, AND FLEXIBLE SEAL

(75) Inventors: Shinjiro Toba, Shizuoka-ken (JP); Tadayuki Tsuda, Susono (JP); Shigeo Miyabe, Numazu (JP); Hiroaki Sakai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/876,120

(22) Filed: Jun. 8, 2001

(30) Foreign Application Priority Data

Jun. 9, 2000 (JP) ..... 2000-173408
Nov. 17, 2000 (JP) ..... 2000-351578

(51) Int. Cl.[7] ..... G03G 15/00; G03G 15/08

(52) U.S. Cl. ..... 399/103; 399/111

(58) Field of Search ..... 399/102, 103, 399/105, 106, 111, 113, 119, 120

(56) References Cited

U.S. PATENT DOCUMENTS

| | | | | |
|---|---|---|---|---|
| 5,126,800 A | | 6/1992 | Shishido et al. | 399/111 |
| 5,134,441 A | | 7/1992 | Nagata et al. | 399/103 |
| 5,151,734 A | | 9/1992 | Tsuda et al. | 399/111 |
| 5,153,649 A | * | 10/1992 | Park | 399/103 X |
| 5,208,634 A | | 5/1993 | Ikemoto et al. | 399/111 |
| 5,223,893 A | | 6/1993 | Ikemoto et al. | 399/111 |
| 5,294,960 A | | 3/1994 | Nomura et al. | 399/113 |
| 5,331,372 A | | 7/1994 | Tsuda et al. | 399/114 |
| 5,331,373 A | | 7/1994 | Nomura et al. | 399/111 |
| 5,345,294 A | | 9/1994 | Nomura et al. | 399/90 |
| 5,404,198 A | | 4/1995 | Noda et al. | 399/107 |
| 5,452,056 A | | 9/1995 | Nomura et al. | 399/111 |
| 5,463,446 A | | 10/1995 | Watanabe et al. | 399/111 |
| 5,470,635 A | | 11/1995 | Shirai et al. | 428/131 |
| 5,475,470 A | | 12/1995 | Sasago et al. | 399/111 |
| 5,485,249 A | | 1/1996 | Higeta et al. | 399/105 |
| 5,488,459 A | | 1/1996 | Tsuda et al. | 399/167 |
| 5,500,714 A | | 3/1996 | Yashiro et al. | 399/111 |
| 5,510,878 A | | 4/1996 | Noda et al. | 399/111 |
| 5,543,898 A | | 8/1996 | Shishido et al. | 399/111 |
| 5,550,617 A | | 8/1996 | Odagawa et al. | 399/176 |
| 5,561,504 A | | 10/1996 | Watanabe et al. | 399/111 |
| 5,581,325 A | | 12/1996 | Tsuda et al. | 399/116 |
| 5,583,613 A | | 12/1996 | Kobayashi et al. | 399/111 |

(List continued on next page.)

FOREIGN PATENT DOCUMENTS

| | | |
|---|---|---|
| JP | 5-66662 | 3/1993 |
| JP | 6-242642 | 9/1994 |

OTHER PUBLICATIONS

US 2001/0026707 A1; Oct. 4, 2001; Miyabe et al.; Process Cartridge, Engaging Member Therefor and Method for Mounting Developing Roller and Magnet.*

*Primary Examiner*—Sophia S. Chen
(74) *Attorney, Agent, or Firm*—Fitzpatrick, Cella, Harper & Scinto

(57) ABSTRACT

A process cartridge detachably mountable to a main assembly of an electrophotographic image forming apparatus includes a drum, a developing member developing an latent image formed on the drum, a developing frame having a developer accommodating portion accommodating developer used to develop the latent image and a developer supply opening supplying developer from the accommodating portion to the developing member, a connecting member mounted to the developer frame and having a connecting member opening opposed to the developer supply opening, a drum frame supporting the drum, a developer frame supporting the developing member and having a developer receiving opening receiving developer having passed through the developer supply opening, and a flexible seal having a first opening opposed to the developer supply opening and the connecting member opening, and a second opening opposed to the developer receiving opening. The flexible seal is stuck on the periphery of the first opening.

31 Claims, 43 Drawing Sheets

U.S. PATENT DOCUMENTS 5,585,889 A 12/1996 Shishido et al. ..... 399/113
5,585,902 A 12/1996 Nishiuwatoko et al. ..... 399/106
5,602,623 A 2/1997 Nishibata et al. ..... 399/111
5,608,509 A 3/1997 Shirai et al. ..... 399/351
5,617,579 A 4/1997 Yashiro et al. ..... 399/114
5,623,328 A 4/1997 Tsuda et al. ..... 399/111
5,640,650 A 6/1997 Watanabe et al. ..... 399/117
5,659,847 A 8/1997 Tsuda et al. ..... 399/113
5,669,042 A 9/1997 Kobayashi et al. ..... 399/111
5,689,774 A 11/1997 Shishido et al. ..... 399/111
5,768,660 A 6/1998 Kurihara et al. ..... 399/111
5,809,374 A 9/1998 Tsuda et al. ..... 399/111
5,812,909 A 9/1998 Oguma et al. ..... 399/103
5,828,928 A 10/1998 Sasago et al. ..... 399/111
5,839,028 A 11/1998 Nomura et al. ..... 399/109
5,864,731 A 1/1999 Ikemoto et al. ..... 399/27
5,870,654 A 2/1999 Sato et al. ..... 399/109
5,873,012 A 2/1999 Miyabe et al. ..... 399/90
5,878,304 A 3/1999 Watanabe et al. ..... 399/92
5,878,309 A 3/1999 Nomura et al. ..... 399/111
5,878,310 A 3/1999 Noda et al. ..... 399/117
5,923,918 A 7/1999 Nakagawa et al. ..... 399/27
5,926,666 A 7/1999 Miura et al. ..... 399/25
5,937,237 A 8/1999 Nonaka et al. ..... 399/106
5,943,529 A 8/1999 Miyabe et al. ..... 399/111
5,946,531 A 8/1999 Miura et al. ..... 399/111
5,950,047 A 9/1999 Miyabe et al. ..... 399/111
5,966,566 A 10/1999 Odagawa et al. ..... 399/109
5,966,567 A 10/1999 Matsuzuki et al. ..... 399/111
6,006,058 A 12/1999 Watanabe et al. ..... 399/167
6,009,289 A 12/1999 Sekine et al. ..... 399/113
6,011,941 A 1/2000 Takashima et al. ..... 399/111
6,029,031 A 2/2000 Yokomori et al. ..... 399/109
6,041,196 A 3/2000 Nakagawa et al. ..... 399/27
6,058,278 A 5/2000 Tsuda et al. ..... 399/106
6,064,843 A 5/2000 Isobe et al. ..... 399/111
6,070,028 A 5/2000 Odagawa et al. ..... 399/104
6,072,968 A 6/2000 Nomura et al. ..... 399/113
6,118,958 A * 9/2000 Nagashima ..... 399/105
6,173,140 B1 1/2001 Suzuki et al. ..... 399/113
6,173,145 B1 1/2001 Chadani et al. ..... 399/265
6,246,853 B1 6/2001 Suzuki et al. ..... 399/262
6,283,390 B1 9/2001 Brendle et al. ..... 239/533.2
6,351,620 B1 2/2002 Miyabe et al. ..... 399/111

* cited by examiner- 27
15a
72a
72
15
60
60

27
52
71
72a
72
15a
15
60
60

27
52
71
100a
72a
72
15a
15
60
60

DEVELOPING APPARATUS, PROCESS CARTRIDGE, CONNECTING METHOD BETWEEN DEVELOPING FRAME AND DEVELOPER FRAME, AND FLEXIBLE SEAL

BACKGROUND OF THE INVENTION

Field of the Invention and Related Art

The present invention relates to a process cartridge removably mountable in an electrophotographic image forming apparatus, a method for joining a developing means holding frame and a developer holding frame, and a flexible sealing member.

Here, an electrophotographic image forming apparatus is an apparatus that forms an image on a recording medium with the use of an electrophotographic image-formation method. As examples of an electro-photographic image forming apparatus, there are an electrophotographic copying machine, an electrophotographic printer (for example, a laser printer, an LED printer, and the like), a facsimile machine, a word processor, and the like.

A process cartridge is a cartridge that integrally comprises a charging means, a developing means or a cleaning means, and an electrophotographic photosensitive drum, and is removably mountable in the main assembly of an image forming apparatus. It also refers to a cartridge that integrally comprises a minimum of one means among a charging means, a developing means, and cleaning means, and an electrophotographic photosensitive drum, and is removably mountable in the main assembly of an image forming apparatus, and refers to a cartridge that integrally comprises a minimum of a developing means, and an electrophotographic photosensitive drum, and is removably mountable in the main assembly of an image forming apparatus.

As the cumulative usage of an electrophotographic image forming apparatus increases, it becomes necessary to carry out various maintenance operations, for example, replacing a photosensitive drum, replenishing a developing apparatus with developer, replacing the developer, adjusting a charging device, cleaning of a cleaning means container, and the like.

Thus, a process-cartridge system is employed by an electrophotographic image forming apparatus that employs an electrophotographic image-formation process. According to a process-cartridge system, an electrophotographic photosensitive member, and a single or a plurality of processing means, which act on the electrophotographic photosensitive member, are integrated in the form of a cartridge removably mountable in the main assembly of an image forming apparatus. A process-cartridge system makes it possible for a user to maintain an electrophotographic image forming apparatus without relying on service personnel, remarkably improving an electrophotographic image forming apparatus in operational efficiency Therefore, a process-cartridge system is widely used in the field of an image forming apparatus.

Referring to FIG. 33, a conventional process cartridge 85 comprises a development unit and a cleaning unit, which are joined with each other with the use of connecting pins 89. The development unit comprises a developing means container 83 and a toner container 86, which are welded to each other by ultrasonic welding. The developing means container 83 supports developing members such as a development roller. The cleaning unit comprises a photosensitive drum 11, a charge roller 12, a cleaning blade 14, a cleaning means container 87, and the like. The photosensitive drum 11, the charge roller 12, the cleaning blade 14, and the like, are supported by the cleaning means container 87. Further, a pair of compression springs 82 are placed in a compressed state between the cleaning means container 87 and developing means container 83, keeping the photosensitive drum 11 and development roller 18 pressed toward each other.

The developing means container 83 and toner container 86 are solidly joined to each other with the use of ultrasonic welding, thermal welding, adhesive, or the like. The solidly joined combination of the developing means container 83 and toner container 86 is connected to the cleaning means container 87, which doubles as a removed toner container, in such a manner that the combination can move relative to the cleaning means container 87, in other words, can pivot about the connecting pin 89. There are spacer rings (unshown) between the peripheral surfaces of the photosensitive drum 11 and development roller 18 to keep a proper amount of a gap between the peripheral surfaces of the photosensitive drum 11 and development roller 18. In other words, while the photosensitive drum 11 and development roller 18 are kept pressed toward each other in a manner to pivot about a line connecting the axial lines of the connecting pins 89, the spacer rings keep the proper amount of gap between the photosensitive drum 11 and development roller 18.

There is a tendency that in order to extend the process-cartridge replacement interval, in other words, in order to extend the length of the service life of a process cartridge, a toner container (developer container) and a removed toner container are increased in capacity.

As a toner container is increased in capacity with the use of any of the conventional technologies, the amount of developer (toner) filled in the toner container increases, which results in an increase in the amount of the load which is applied to the spacer rings and also in the amount of the load which is applied to the development roller 18 and photosensitive drum 11.

SUMMARY OF THE INVENTION

The primary object of the present invention is to provide a method for connecting a developing means frame and developer holding frame in such a manner that the two frames are movable relative to each other; a developing apparatus, which comprises a developing means frame and a developer holding frame, which are movable relative to each other; a process cartridge; and a flexible sealing member suitable for using the connecting method.

Another object of the present invention is to provide a method for connecting a developing means frame and a developer holding frame in such a manner that the load which is applied to a developing member and an electrophotographic photosensitive member does not fluctuate in response to the amount of the developer; a developing apparatus and a process cartridge, in which the load which is applied to a developing member and an electrophotographic photosensitive member does not fluctuate in response to the amount of the developer; and a flexible sealing member suitable for the connecting method.

Another object of the present invention is to provide a method for connecting a developing means frame and a developer holding frame in such a manner that the load which is applied to a developing member and an electrophotographic photosensitive member does not increase even if the amount of the developer stored in the developer holding frame increases; a developing apparatus and a process cartridge, in which a developing means holding frame and a developer holding frame are connected to each other in such a manner that the two frames are movable relative to each other; and a flexible sealing member suitable for the connecting method.

Another object of the present invention is to provide a method for connecting a developing means frame and a developer holding frame in such a manner that the load which is applied to a developing member and an electrophotographic photosensitive member does not increase even when the developer container is increased in capacity, and also that the load which is applied to a developing member and an electrophotographic photosensitive member does not change even when the amount of the developer within the developer container decreases; a developing apparatus and a process cartridge, which comprise a developing means frame and a developer holding frame, which are connected to each other with the use of the connecting method; and a flexible sealing member suitable for the connecting method.

Another object of the present invention is to provide a developing apparatus and a process cartridge, in which a flexible seal is folded so that the first and second holes of the flexible sheet align with each other, and the two halves of the flexible sheet created by the folding are pasted to each other at their edges.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

The preferred embodiments of the present invention will be described with reference to FIGS. 1–9. In the following embodiments of the present invention, the longitudinal direction is a direction that is perpendicular to the direction in which the recording medium is conveyed, and that is parallel to the surface of the recording medium. The top and bottom surfaces of the process cartridge are the top and bottom surfaces of the process cartridge that has been properly mounted in the main assembly of an image forming apparatus.

(Description of Process Cartridge and Main Assembly of Image Forming Apparatus)

Figure 1:
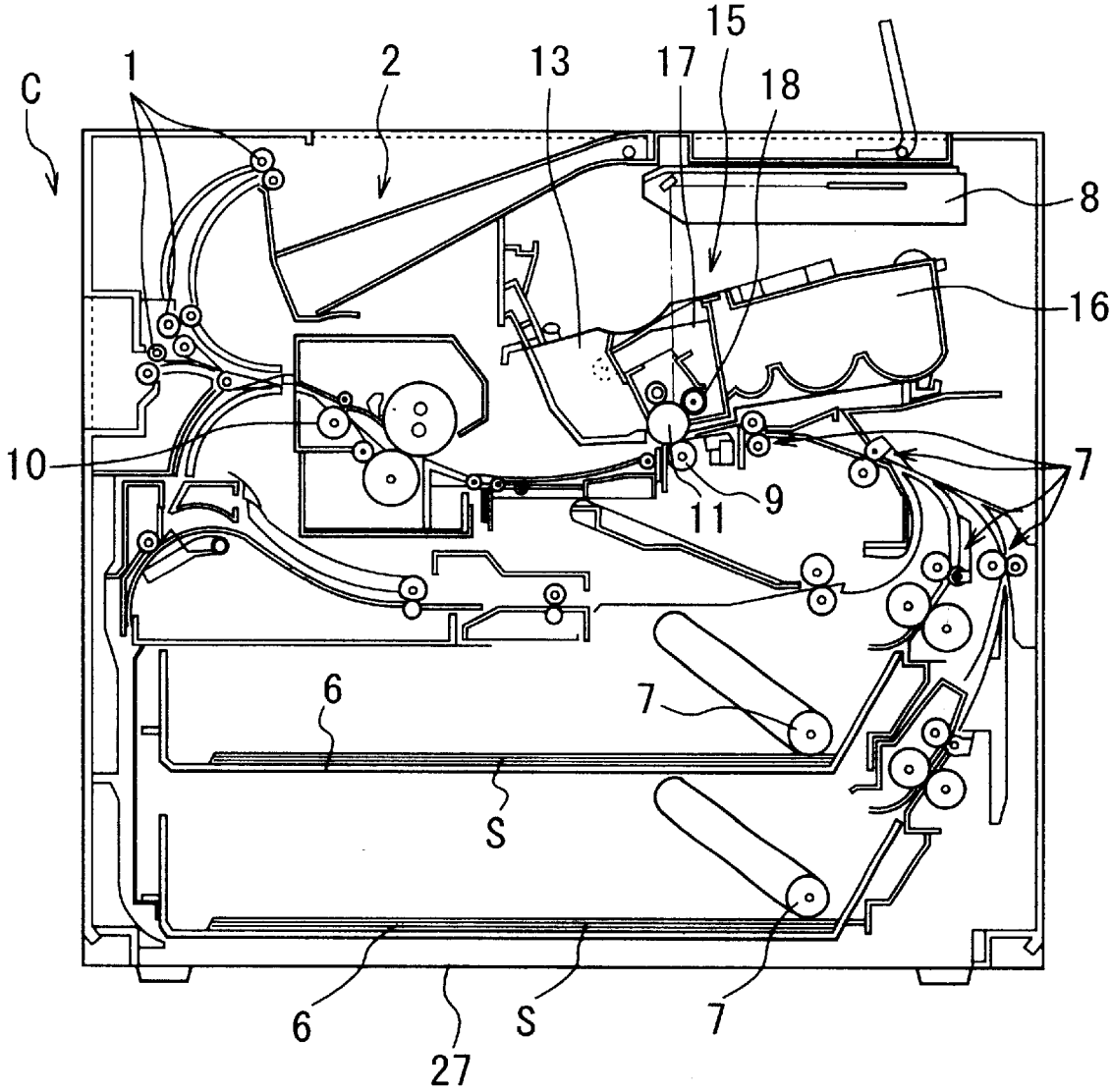
FIG. 1 is a vertical sectional view of an electrophotographic image forming apparatus.
Figure 2:
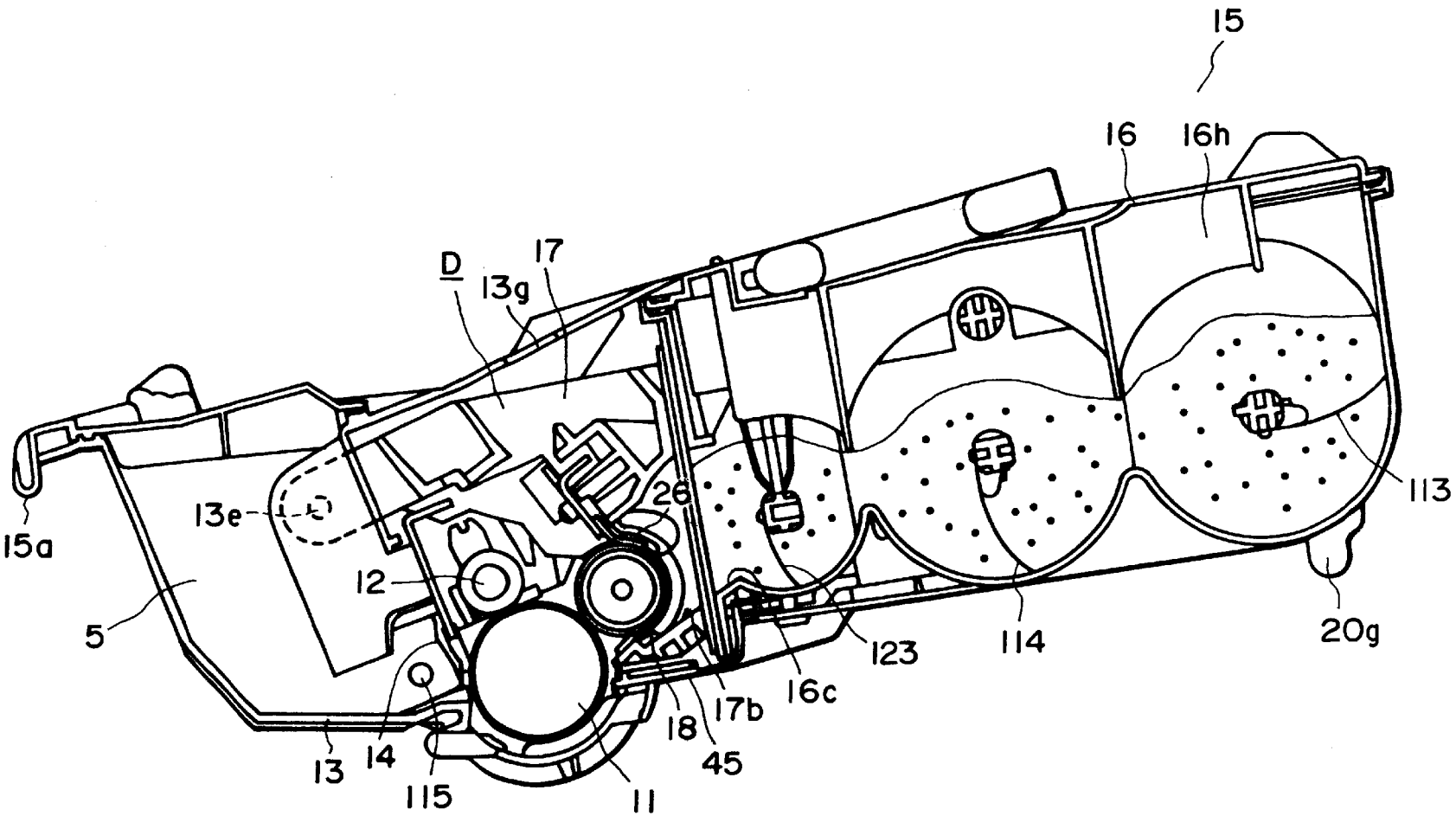
FIG. 2 is a vertical sectional view of a process cartridge.

FIG. 2 is a sectional view of a process cartridge in accordance with the present invention, at a plane perpendicular to the longitudinal direction, and FIG. 1 is a sectional view of an image forming apparatus in accordance with the present invention, at a plane perpendicular to the longitudinal direction. This process cartridge comprises an electrophotographic photosensitive member, and a plurality of processing means which act on the electrophotographic photosensitive member. As for the processing means, there are a charging means for charging the peripheral surface of the electrophotographic photosensitive member, a developing means for developing an electrostatic latent image formed on the electrophotographic photosensitive member, and a cleaning means for removing the developer remaining on the peripheral surface of the electrophotographic photosensitive member.

Referring to FIG. 2, in the process cartridge 15 in this embodiment, a charging member 12 as a charging means, a development roller as a developing means, a development blade as a developing means, and a cleaning member 14 as a cleaning means, are positioned around the electrophotographic photosensitive drum 11. These components are integrally covered with a housing, forming the process cartridge 15 that is removably mountable in the main assembly 27 of an image forming apparatus (which hereinafter will be referred to as an apparatus main assembly). The charging member 12 is a charge roller, which comprises a metallic core and a layer of rubber wrapped around the metallic core. The electrical resistance of the rubber layer is in the medium range. The cleaning member 14 comprises a rubber blade placed in contact with the peripheral surface of the photosensitive drum 11 to scrape away the toner remaining on the photosensitive drum 11 after image transfer, and a metallic plate to which the rubber blade is fixed.

Referring to FIG. 1, this process cartridge 15 is mounted in an electrophotographic image forming apparatus C to be used for image formation. In an image forming operation, a sheet S is conveyed by a conveying roller 7 from a sheet cassette 6 mounted in the bottom portion of the apparatus main assembly. In synchronism with the conveyance of the sheet S, a latent image is formed by selectively exposing the peripheral surface of the photosensitive drum 11 with the use of an exposing apparatus 8. Thereafter, the toner stored in a toner container 16 is coated in a thin layer on the peripheral surface of the development roller 18 by the development blade 26, while being triboelectrically charged. Then, the toner on the development roller 18 is supplied to the peripheral surface of the photosensitive drum 11, in accordance with the latent image, by applying a development bias to the development roller 18. As a result, a toner image is formed on the peripheral surface of the photosensitive drum 11. This toner image is transferred onto the sheet S as a recording medium, which is being conveyed, by the application of a bias voltage to the transfer roller 9. Then, the sheet S is conveyed to a fixing apparatus 10, in which the toner image is fixed to the sheet S. Thereafter, the sheet S is discharged into a sheet delivery portion 2 at the top of the apparatus main assembly, by a discharge roller 1.

On the other hand, after the image transfer, the toner remaining on the photosensitive drum 11 is removed by the cleaning member 14, and is moved inward of a removed toner bin 5 by a removed toner moving member 115.

(Structure of Process Cartridge Frame)

Figure 5:
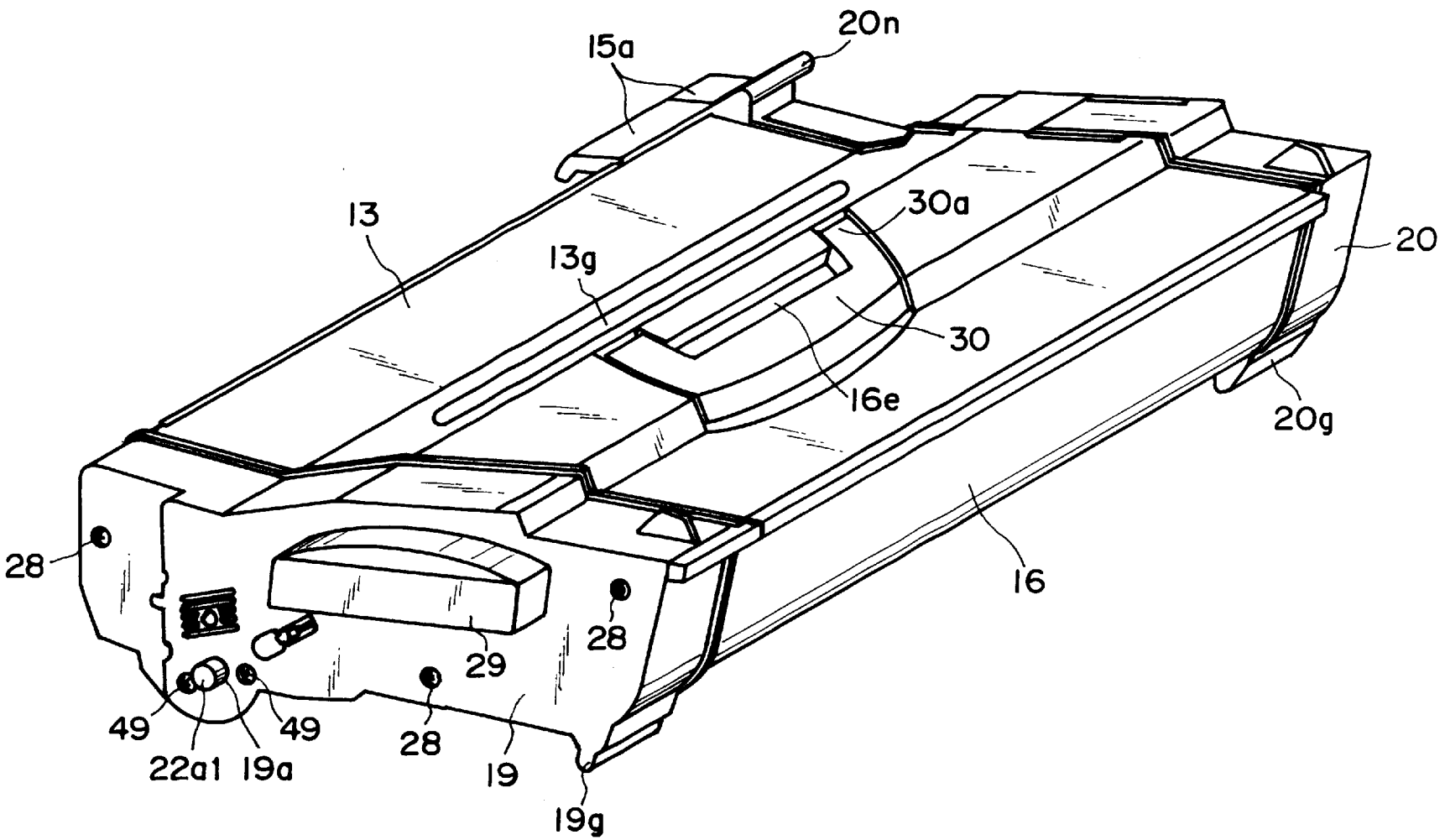
FIG. 5 is a perspective view of the process cartridge as seen from diagonally above the top right of the rear end of the process cartridge in terms of the direction in which the process cartridge is mounted.
Figure 6:
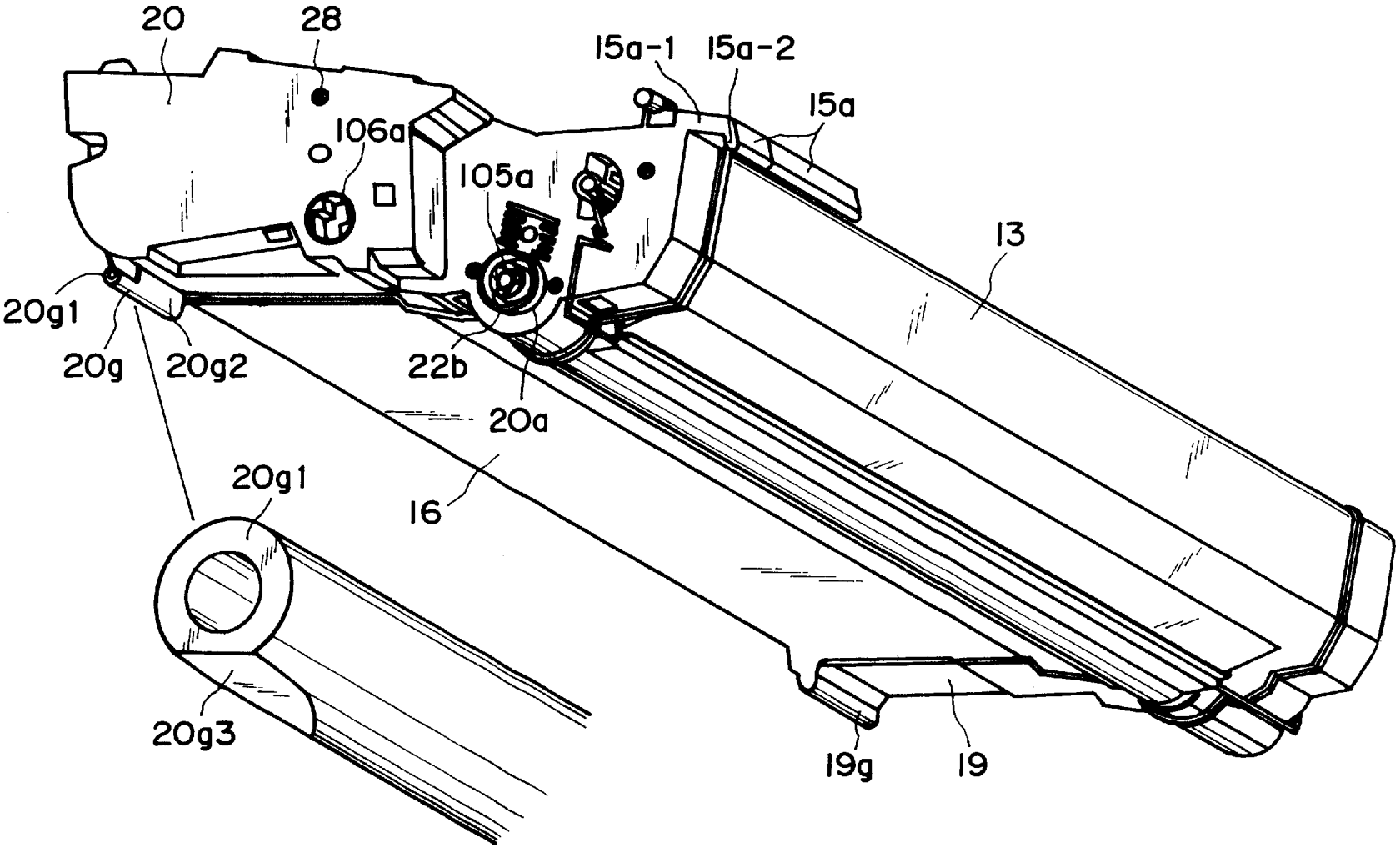
FIG. 6 is a perspective view of the process cartridge as seen from diagonally below the bottom right of the front end of the process cartridge in terms of the process-cartridge mounting direction.
Figure 7:
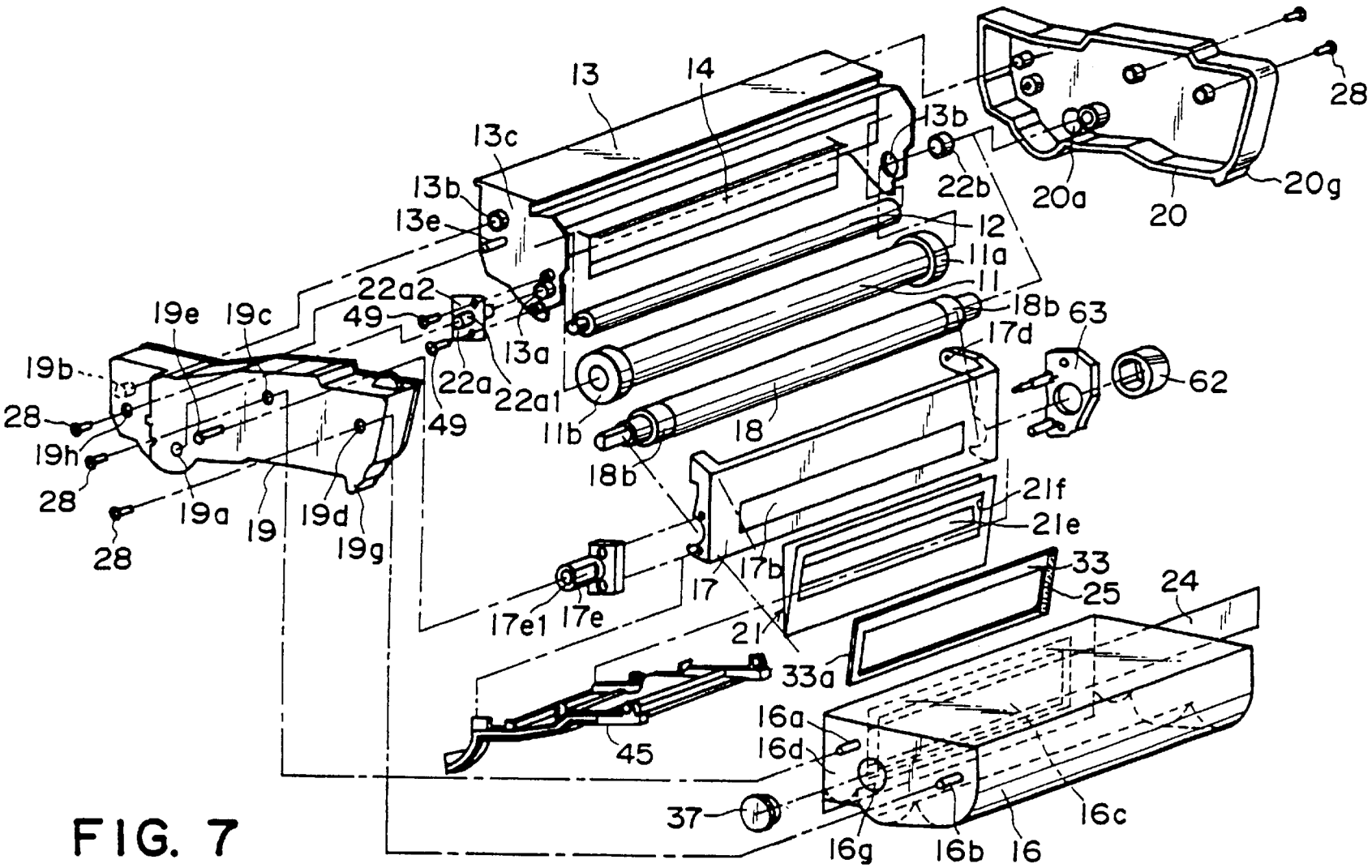
FIG. 7 is an exploded perspective view of the process cartridge.

FIGS. 3–9 are drawings for showing the structure of the process cartridge frame. FIG. 7 is a drawing which shows the components of the process cartridge prior to their assembly. FIGS. 3–6 are drawings of the process cartridge after its assembly. The process cartridge 15 comprises three frames: a cleaning means holding frame 13, which integrally supports the photosensitive drum 11, the charging member 12, and the cleaning member 14; a developing means holding frame 17 (which may be referred to as a development frame) which integrally supports the development roller 18, and a development blade (which is not shown in FIG. 7, and is shown in FIG. 2, being designated by a reference code 26); and a developer holding frame 16, which constitutes a developer container 16*h* for holding developer (which hereinafter will be referred to as toner). The developer holding frame 16 is provided with a cover 45, which is attached to the bottom of the developer holding frame 16 and will be referred to as a bottom cover. In addition, the process cartridge 15 comprises a pair of end covers 19 and 20, which are fixed to the longitudinal ends, one for one, of both the cleaning means holding frame 13 and developer holding frame 16. The developing means holding frame 17 is supported by the cleaning means holding frame 13. Hereinafter, the frame that supports the photosensitive drum 11 may be referred to as a drum frame.

As described above, the process cartridge 15 has the bottom cover 45, which is attached to the process cartridge 15, at a location which will be below the development roller 18 as a developing member, and a development blade 26 as a developing member after the mounting of the process cartridge 15 in the apparatus main assembly 27. It constitutes a part of the external wall of the process cartridge 15. One end of the bottom cover 45 in terms of the longitudinal direction is connected to the end cover 19, or the end cover on the rear end of the process cartridge 15 in terms of the process-cartridge insertion direction, and the other end of the bottom cover 45 is connected to the end cover 20, or the end cover on the front end of the process cartridge 15 in terms of the process-cartridge insertion direction.

Figure 3:
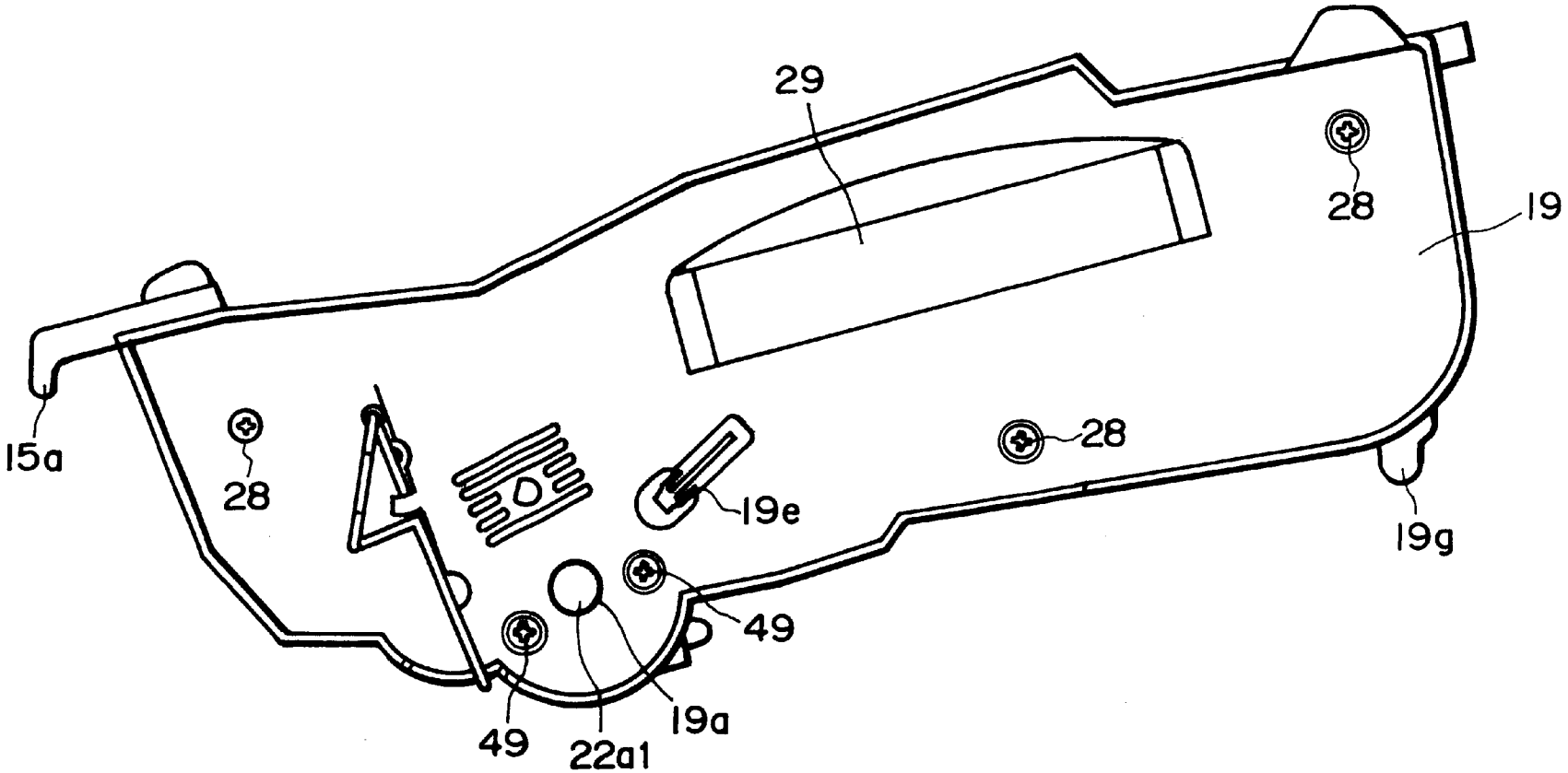
FIG. 3 is a front view of the process cartridge.

Referring to FIG. 3, the rear end cover 19 has a second handle 29, which is grasped by an operator when the process cartridge 15 is mounted into or dismounted from the apparatus main assembly 27 by the operator. The process cartridge 15 is mounted into or removed from the apparatus main assembly 27 in a direction parallel to the longitudinal direction of the photosensitive drum 11. More specifically, when the process cartridge 15 is mounted into the apparatus main assembly 27, it is inserted all the way into the apparatus main assembly 27 in the longitudinal direction, and then, is lowered into the apparatus main assembly 27, whereas when it is removed from the apparatus main assembly 27, it is first moved upward and then is pulled out in the longitudinal direction.

The rear end cover 19 is provided with a hole 19*a*, through which a shaft 22*a*1, the axial line of which coincides with the that of the shaft that bears the photosensitive drum, extends outward. The shaft 22*a*1 is a part of a bearing member 22*a* with which one of the longitudinal ends of the photosensitive drum 11 is supported by the cleaning means holding frame 13. It is accurately positioned relative to the apparatus main assembly 27 as the process cartridge 15 is mounted into the apparatus main assembly 27. More specifically, first, the process cartridge 15 is inserted straight into the apparatus main assembly 27 as far as possible, and then, is lowered into the apparatus main assembly 27. As the process cartridge is lowered, the shaft portion (positioning member) 22*a*1 integral with the drum shaft engages into the positioning recess (which will be described later) of the apparatus main assembly 27. While the process cartridge 15 is inserted into, or pulled out of, the apparatus main assembly 27, the process cartridge 15 is supported by the apparatus main assembly 27 at the guide portions 19*g* and 20*g*.

Referring to FIG. 5, the developer holding frame 16 is provided with a first handle 30, which is on the top surface of the process cartridge 15. Here, the top surface of the process cartridge 15 is a surface of the process cartridge 15 that faces upward after the mounting of the process cartridge into the apparatus main assembly 27. The first handle 30 is a handle that is grasped by an operator when the process cartridge is carried. It folds into the recess 16*e* in the top surface of the developer holding frame 16. It is attached to the developer holding frame 16 by its base portions 30*a* with the use of pins (unshown) parallel to the longitudinal direction. When the first handle 30 is used, it is rotated about the pins to the position at which it becomes upright relative to the top surface of the process cartridge 15.

Referring to FIGS. 2 and 5, the cleaning means holding frame 13 is provided with an exposure opening 13*g*, through which the light, which is projected from the exposing apparatus 8 of the apparatus main assembly 27 while being modulated with image formation information, is allowed to enter the process cartridge 15 to expose the photosensitive drum 11.

Figure 4:
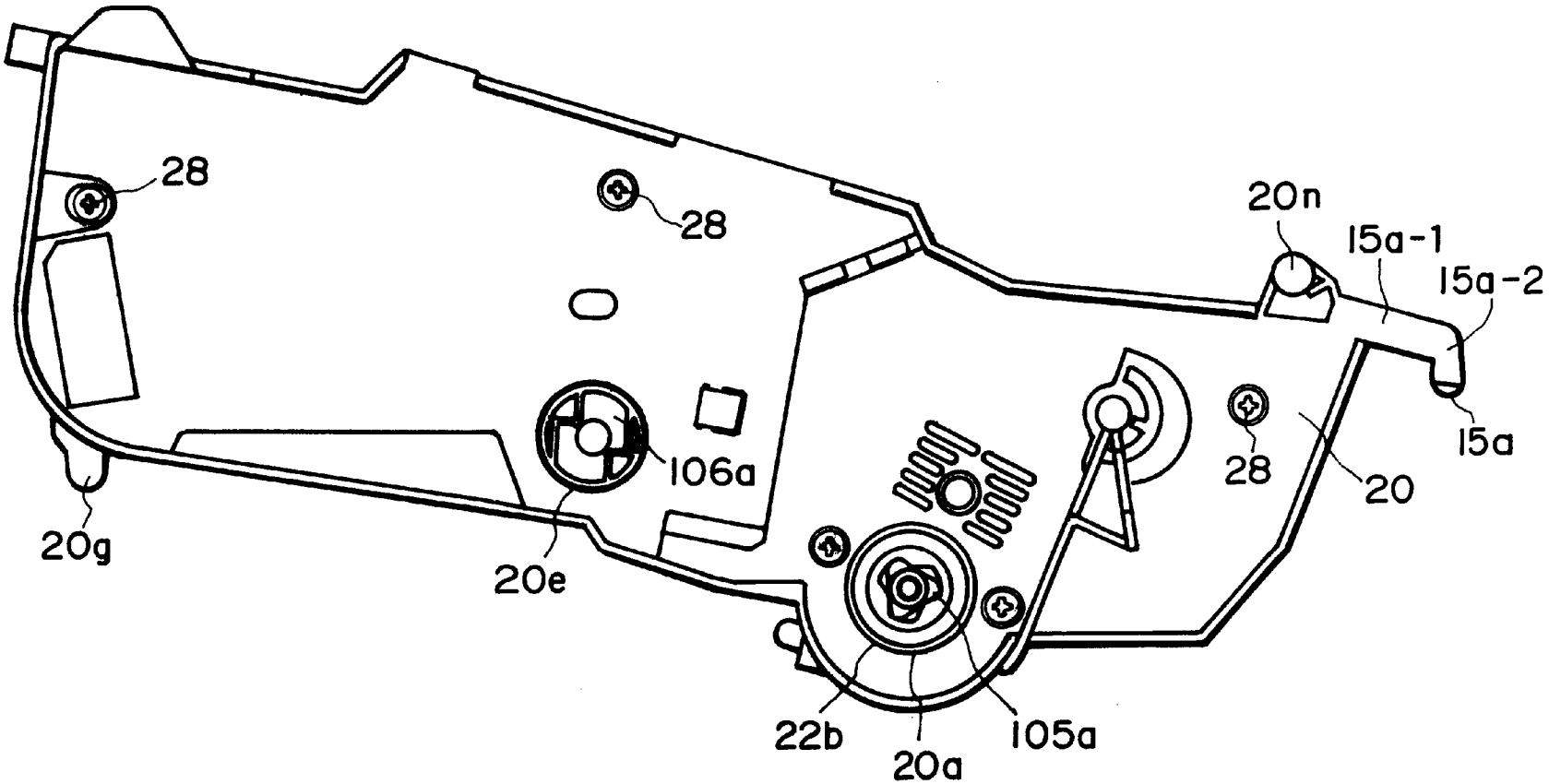
FIG. 4 is a rear view of the process cartridge.

Referring to FIGS. 4 and 7, the front end cover 20 is provided with a first hole 20*a* and a second hole 20*e*. In the first hole 20*a*, a first coupling 105*a* is fitted, which is a first driving force receiving portion for receiving the driving force for rotating the photosensitive drum 11 from the apparatus main assembly 27 after the mounting of the process cartridge 15 into the apparatus main assembly 27. The first coupling 105*a* as a driving force receiving portion is an integrally formed part of a flange 11*a* shown in FIG. 7. The flange 11*a* is fixed to one of the longitudinal ends of the photosensitive drum 11. In the second hole 20*e*, a second coupling 106*a* as a second driving force receiving portion is fitted, which receives, from the apparatus main assembly 27, the driving force for rotating stirring members 113, 114, and 123 (FIG. 2) as toner moving members for sending out the toner stored in the developer container 16*h* of the developer holding frame after the mounting of the process cartridge 15 into the apparatus main assembly 27.

The details of the developing means holding frame 17 will be given later.

The end covers 19 and 20 are large enough to virtually perfectly cover the corresponding ends of the process cartridge 15 in the longitudinal direction (large enough to match in size and shape the cross section of the process cartridge 15 at a plane perpendicular to the longitudinal direction), and are located at the ends of the process cartridge 15 in the longitudinal direction, one for one. The end covers 19 and 20 each extend across the longitudinal ends of the cleaning means holding frame 13 and developer holding frame 16, and are fixed to the cleaning means holding frame 13 and developer holding frame 16, thereby holding the cleaning means holding frame 13 and 16 together.

The positions of the end covers 19 and 20 are fixed relative to the cleaning means holding frame 13 and developer holding frame 16 so that the centers of the holes 19*a* and 20*a* shown in FIG. 7 align with the axial line of the photosensitive drum 11 supported by the cleaning means holding frame 13. On the rear end cover 19 side shown in FIG. 7, the bearing member 22*a* is pressed into the hole 13*a* of the cleaning means holding frame 13, and small screws 49 are put through the flange 22*a*2 and are screwed into the cleaning means holding frame 13. The bearing member 22*a* comprises the flange 22*a*2 and the shaft 22*a*1 integrally formed with the flange 22*a*2. The shaft 22*a*1 is put through the hole 13*a*, and then, the end of the shaft 22*a*1 is slid into the center hole of the flange 11*b*. To one of the longitudinal ends of the photosensitive drum 11, the flange 11*b* is immovably fitted. Since the position of the rear end cover 19 relative to the cleaning means holding frame 13 is fixed by the outward shaft 22*a*1 of the bearing member 22*a*, the rear end cover 19 is accurately positioned relative to the photosensitive drum 11. The positioning portion 19*b*, that is, one of the joggles of the rear end cover 19, which is positioned as far as possible from the photosensitive drum 11, is fitted in the positioning portion 13*b*, that is, one of the holes of the side wall 13*c* of the cleaning means holding frame 13. With this arrangement, the rear end cover 19 is prevented from rotating about the axial line of the photosensitive drum 11. The rear end cover 19 is fixed to the side wall 13*c* of the cleaning means holding frame 13, that is, one of the end walls of the cleaning means holding frame 13 in terms of the longitudinal direction.

The developer holding frame 16 is provided with cylindrical positioning portions 16*a* and 16*b*, which are on the side wall 16*d*, that is, one of the end walls of the developer holding frame 16 in terms of the longitudinal direction. The positioning portions 16*a* and 16*b* project in the longitudinal direction. They are fitted in the positioning portions 19*c* and 19*d*, which are holes of the rear end cover 19. With this arrangement, the positions of the developer holding frame 19 and rear end cover 16 relative to each other are fixed. The developer holding frame 16 and rear end cover 16 are fixed to each other. The other end cover, or the front end cover 20, is accurately positioned relative to the developer holding frame 16 and 13, and is fixed to them, in the same manner as is the rear end cover 19. That is, the shaft of the bearing member 22*b* fixed to the cleaning means holding frame 13 by being pressed into the cleaning means holding frame 13 is fitted in the hole 20*a* of the front end cover 20, in such a manner that a portion of the bearing member 22*b* extends outward from the front end cover 20. The bearing members 22 (22*a* and 22*b*) double as members for accurately positioning the process cartridge 15 relative to the apparatus main assembly 27; in other words, the bearing members 22 are cylindrical members for fixing the position of the process cartridge 15. The position of the developing means holding frame 17 relative to other components is fixed by a method which will be described later.

(Method for Connecting Frames)

The cartridge frame essentially comprises the cleaning means holding frame 13, the developer holding frame 16, the developing means holding frame 17, the end cover 19, and the end cover 20.

The cartridge frame is temporarily assembled prior to its permanent assembly. In the temporary assembly of the cartridge frame, the shaft 22*a*1 projecting from the cleaning means holding frame 13 is put through the hole 19*a* of the rear end cover 19; the positioning portion (cylindrical joggle) 19*b* of the rear end cover 19 is put through the positioning hole 13*b* of the side wall of the cleaning means holding frame 13; and the positioning portions 16*a* and 16*b* of the end wall of the developer holding frame 16, are put through the positioning portions (holes) 19*c* and 19*d* of the rear end cover 19. Also on the front end cover 20 side, the front end cover 20, the cleaning means holding frame 13, and the developer holding frame 16 are joined with each other in the same manner as on the rear end cover 19 side. Since these components can be temporarily assembled as described, they are easy to handle or put together before they are permanently fixed to each other.

In order to fix the rear end cover 19 to the cleaning means holding frame 13 and developer holding frame 16, first small screws 28 are put through the positioning portions 19*c* and 19*d* and screwed into the positioning portions 16*a* and 16*b*. Also, an additional small screw 28 is put through the hole 19*h* of the rear end cover 19 and screwed into the hole of the joggle 13*e* of the cleaning means holding frame 13. The positioning portions 19*c* and 19*d*, and hole 19*h*, are step holes, the outward sides of which are smaller in diameter. The smaller diameter portions of the holes are large enough in diameter for the screws 28 to be put through, but are smaller in diameter than the positioning portions 16*a* and 16*b*, and the joggle 13*e*. The cleaning means holding frame 13 and developer holding frame 16 are held together by the front end cover 20 in the same manner as they are by the rear end cover 19.

Incidentally, the cleaning means holding frame 13 and developer holding frame 16 may be held together by the end covers 19 and 20 with the use of resin. In such a case, the end covers 19 and 20, the cleaning means holding frame 13, and the developer holding frame 16 are provided with resin flow paths, which must be formed along the joining edges of the end covers 19 and 20, the cleaning means holding frame 13, and the developer holding frame 16, when these components are formed. Then, melted resin is poured into the resin flow paths from the gate of a fixing jig, which is different from the jig used for forming the end covers 19 and 20, through a resin pouring path set up between the gate and the resin flow paths. The poured melted resin is allowed to solidify in the resin flow paths to keep the cleaning means holding frame 13 and the developer holding frame 16 together by the end covers 19 and 20. Before the pouring of melted resin, the process cartridge 15 is temporarily assembled in advance, and placed in the fixing jig used for joining the cleaning means holding frame 13 and developer holding frame 16 by the end covers 19 and 20 with the use of resin.

The developer holding frame 16 and developing means holding frame 17 are provided with a developer supplying hole 16*c* (FIG. 2) and a developer receiving hole 17*b*, respectively, for supplying toner from the developer holding frame 16 to the development roller 18. The developer holding frame 16 and the developing means holding frame 17 are connected to each other, with the interposition of a flexible seal 21 (FIG. 7), in such a manner that the aforementioned holes 17*b* and 16*c* form a through hole between the two frames 16 and 17. The position of the developer holding frame 16 is fixed relative to the end covers 19 and 20, whereas the position of the developing means holding frame 17 is fixed relative to the cleaning means holding frame 13. Therefore, a certain amount of a gap must be provided between the developing means holding frame 17 and developer holding frame 16 because it is possible that the two frames may have dimensional errors. The position of the process cartridge 15 relative to the apparatus main assembly 27 is fixed as the position of the cleaning means holding frame 13 relative to the cartridge mounting portion of the apparatus main assembly 27 is fixed as the process cartridge 15 is inserted into the apparatus main assembly 27.

With the provision of the above described structural arrangement, even if the process cartridge 15 is increased in developer capacity by increasing the size of the developer container 16*h*, the increase does not adversely affect the development roller 18, because the load from the toner is applied to the covers 19 and 20 and the development roller 18 is supported by the developing means holding frame 17. Therefore, it does not occur that an unnecessary load is exerted upon the photosensitive drum 11. As a result, quality images can be consistently obtained.

(Method for Attaching Flexible Seal to Developing Means Holding Frame and Developer Holding Frame)

In this embodiment, the process cartridge 15 is structured so that the joint between the developing apparatus D and developer holding frame 16 remains sealed. More specifically, the flexible seal 21 is folded in half, and the two halves of the flexible seal 21 are pasted to each other, forming a sealing member in the form of a bellow, and this bellows-like sealing member is pasted to the developing apparatus D and developer holding frame 16. The flexible seal 21 is attached to the developer holding frame 16 with the interposition of a backing plate 33 as a connecting member. The flexible seal 21 in this embodiment is no more than 1 mm in thickness. However, the thickness of the flexible seal 21 may be more than 1 mm as long as a material which does not reduce the flexibility of the flexible seal 21 when the flexible seal 21 is folded in the form of bellows is selected as the material for the flexible seal 21.

Figure 10:
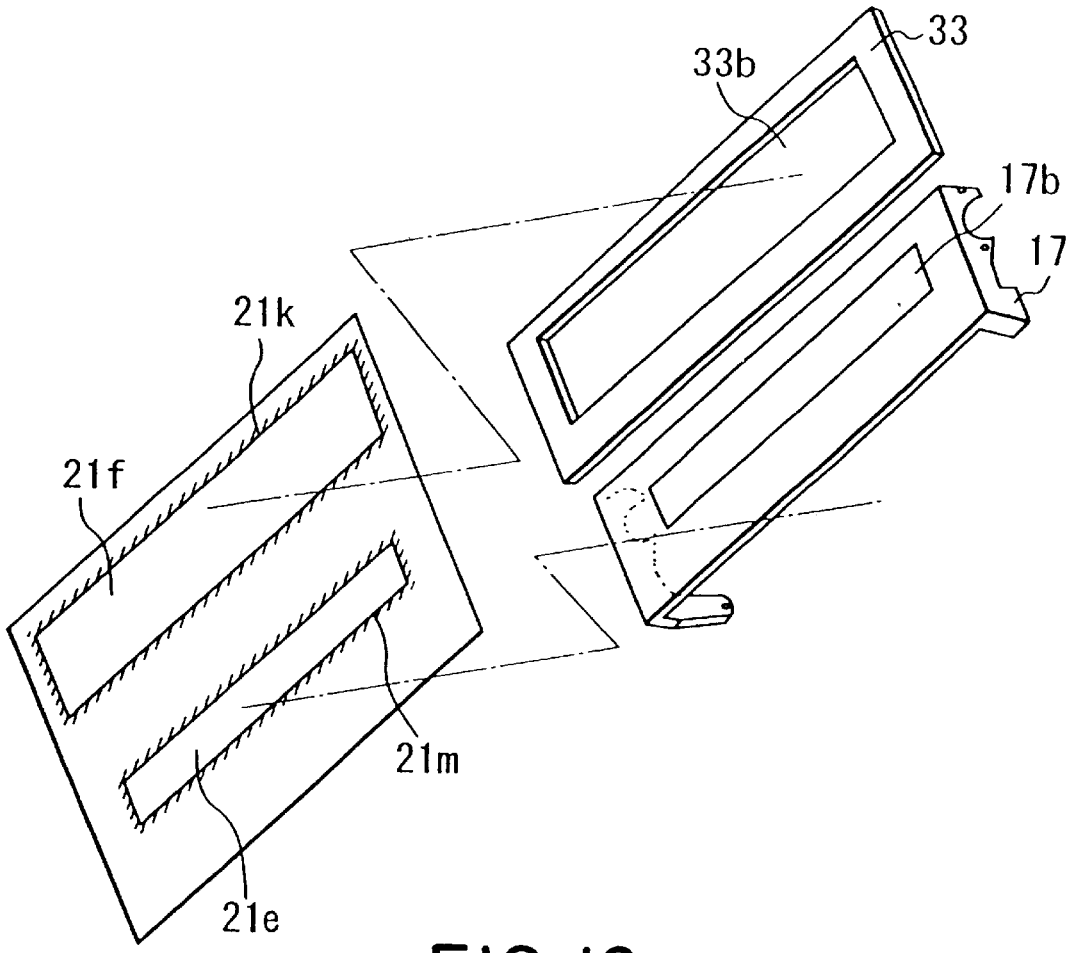
FIG. 10 is a perspective view of a sealing sheet for sealing between a toner container and a developing means holding frame, and components related to the sealing sheet.

Next, referring to FIGS. 10 and 11, a method for attaching the flexible seal 21 will be described. Referring to FIG. 10, the flexible seal 21 is provided with first and second hole 21*e* and 21*f*. The first hole 21*e* is the same or larger in size than the hole 33*b* of the backing plate 33. The second hole 21*f* is the same or larger in size than the developer receiving hole 17*b* of the developing means holding frame 17.

The flexible seal 21 is adhered to the backing plate 33 and the developing means holding frame 17 by first and second adhering portions 21*k* and 21*m*, respectively, that is, the surrounding edges (hatched portions in FIG. 10) of the holes 21*e* and 21*f*, so that the holes 21*e* and 21*f* align with the hole 33 of the backing plate 33*b* and the toner receiving hole 17*b* of the developing means holding frame 17. As a result, the first hole 21*e* of the flexible seal 21 is connected to the developer receiving hole 17*b* of the developing means holding frame 17, forming a through hole, and the second hole 21*f* of the flexible seal 21 is connected to the hole 33*b* of the backing plate 33, forming a through hole, as shown in FIG. 11.

In this embodiment, the developer holding frame 16, the developing means holding frame 17, the backing plate 33, and the flexible seal 21 are thermally welded to each other by a heat-seal method, an impulse-seal method, or the like. However, they may be bonded by ultrasonic welding, adhesive, adhesive tape, or the like.

Figure 11:
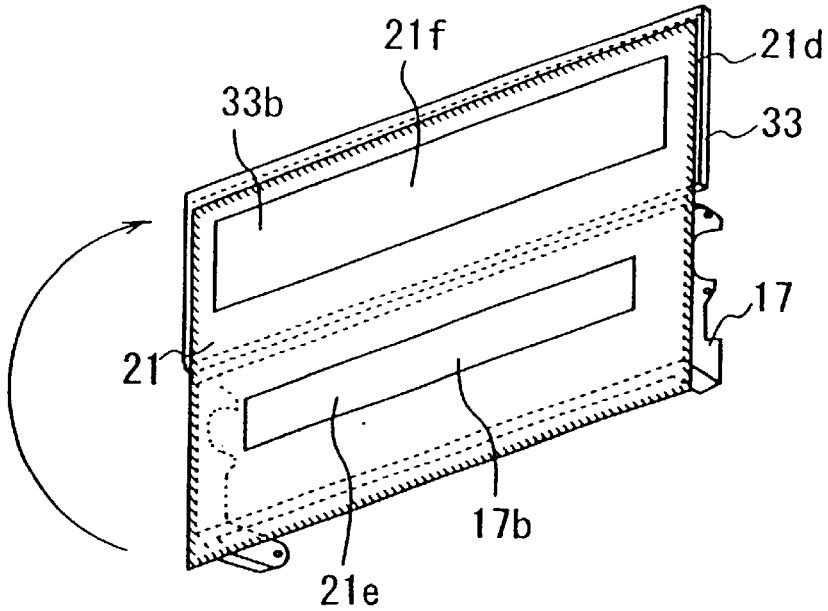
FIG. 11 is a perspective view of a sealing sheet for sealing between a toner container and a developing means holding frame, and components related to the sealing sheet.

Next, referring to FIG. 11, after being pasted to the developing means holding frame 17 and the backing plate 33, the flexible seal 21 is folded in the direction indicated by an arrow mark so that the developer receiving hole 17*b* and the hole 33*b* of the backing plate 33 align with each other, with the interposition of the flexible seal 21 between the developing means holding frame 17 and backing plate 33. As a result, the flexible seal 21 is shaped like a bellows (or a pouch). Then, the mutually facing halves of the flexible seal 21 are joined to each other by their edges 21*d* (hatched portions), sealing between the developing means holding frame 17 and the backing plate 33. Also in this case, a thermal welding method, such as a heat-seal method or an impulse-seal method, ultrasonic welding, adhesive, adhesive tape, or the like, may be used.

Next, the backing plate 33 is attached to the developer holding frame 16. In this case, a portion of the backing plate 33 is not welded or glued to the developer holding frame 16 so that a developer seal can be passed through between the developer holding frame 16 and backing plate 33.

In this embodiment, the backing plate 33 is welded by the portion 33*a*; the portion corresponding to the area across which the toner sealing member 25 presses upon the developer seal 24 is not welded. The portion 33*a* is one of the edges of the backing plate 33 in the longitudinal direction, that is, one of the edges which extend in the width direction, or the direction perpendicular to the longitudinal direction.

With the provision of the above described structural arrangement, in other words, since the flexible seal 21 as a sealing member forms a pouch or a bellows by being folded and welded, the resistance to the change in the gap between the mutually facing surfaces of the developer holding frame 16 and developing means holding frame 17, which occurs as the gap changes, is extremely small. Further, the interposition of the flexible seal 21 between the backing plate 33 and developing means holding frame 17 makes it possible to attach the backing plate 33 in a manner to cover the developer seal 24, and also to attach the toner sealing member 25 to the backing plate 33 in a manner to keep sealed the gap through which the developer seal 24 is passed. As a result, toner leakage is prevented.

Further, the provision of the backing plate 33 makes it possible to simplify the shape of a welding table necessary for welding, compared to a structural arrangement in which a sealing member in the form of a sheet is directly pasted to the developer holding frame 16.

Further, the provision of the backing plate 33 makes it possible to unitize the flexible seal 21 with the developing means holding frame 17, thereby making it easier to attach the flexible seal 21 to the developer holding frame 16.

Next, another method for attaching the flexible seal 21 to the developing means holding frame 17 and developer holding frame 16 will be described.

In this case, the flexible seal 21 is no more than 0.1 mm in thickness. It is a single layer sheet, and is kept on a backing sheet until it is used. Using a single layer sheet as the material for the flexible seal 21 makes it possible to render the flexible seal 21 less rigid.

Figure 12:
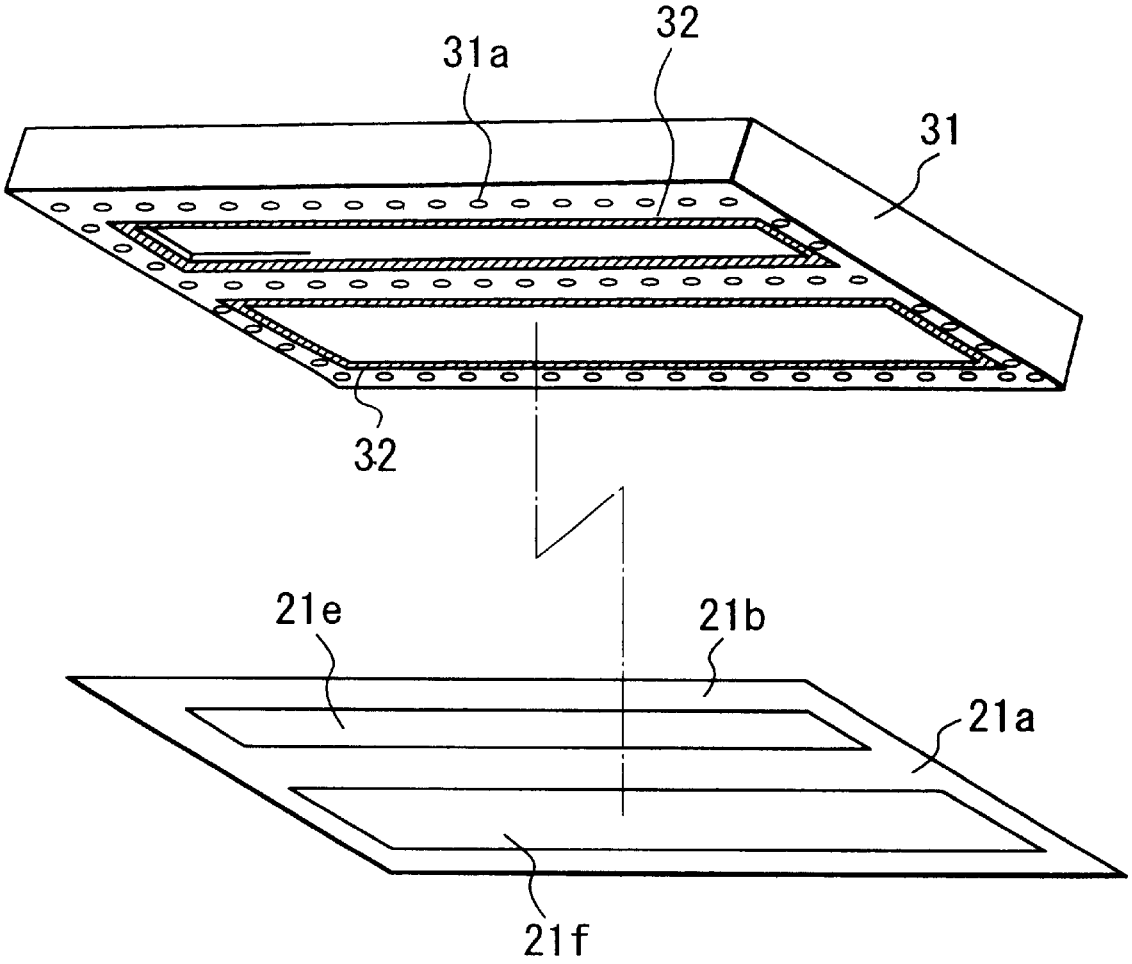
FIG. 12 is a perspective drawing for depicting how the sealing sheet is applied.

Referring to FIG. 12, the flexible seal 21 in this case comprises a flexible layer 21*a* and a backing sheet 21*b* that is more rigid than the layer 21*a*. The layer 21*a* is formed of polyethylene-terephthalate, polypropylene, biaxial orientation Nylon, a heat-seal member, ester resin, ethylene vinyl acetate, polyurethane resin, polyester resin, olefin resin, or the like.

Next, a method for forming the flexible seal 21 into a bellows will be described.

Figure 13:
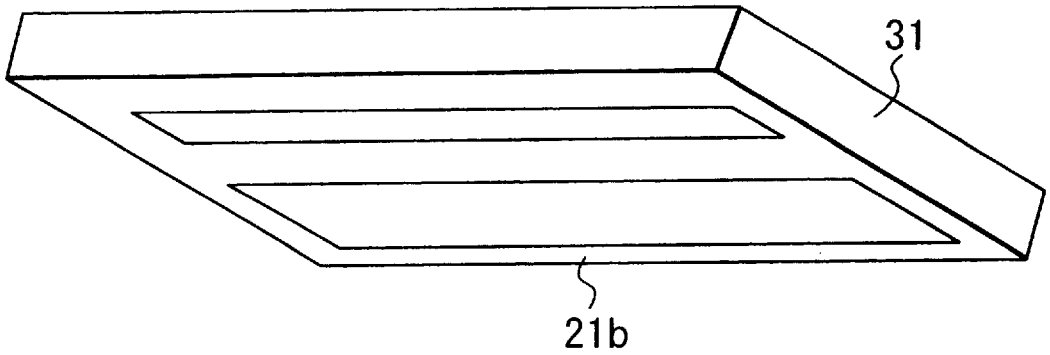
FIG. 13 is a perspective drawing for depicting how the sealing sheet is applied.
Figure 14:
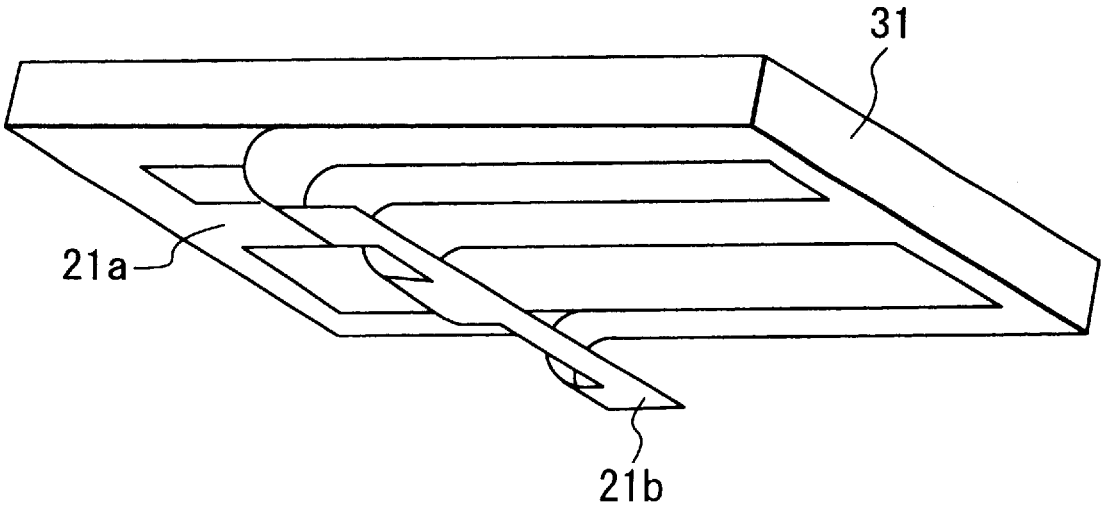
FIG. 14 is a perspective drawing for depicting how the sealing sheet is applied.

Referring to FIG. 12, a jig 31 for holding the flexible seal 21 is provided with a plurality of holes 31*a* for holding the flexible seal 21 by suction. These holes 31*a* are connected to an unshown vacuum pump. The flexible seal 21 is held to the holding jig 31, with the layer 21*a* facing the holes 31*a*, as shown in FIG. 13. The flexible seal 21 may be electrostatically held to the holding jig 31 by charging the surface of the holding jig 31. With the 25 flexible seal 21 held to the holding jig 31, the backing sheet 21*b*, or the second layer of the flexible seal 21, is peeled as shown in FIG. 14, leaving only the layer 21*a* (actual seal 21) on the holding jig 31.

Figure 15:
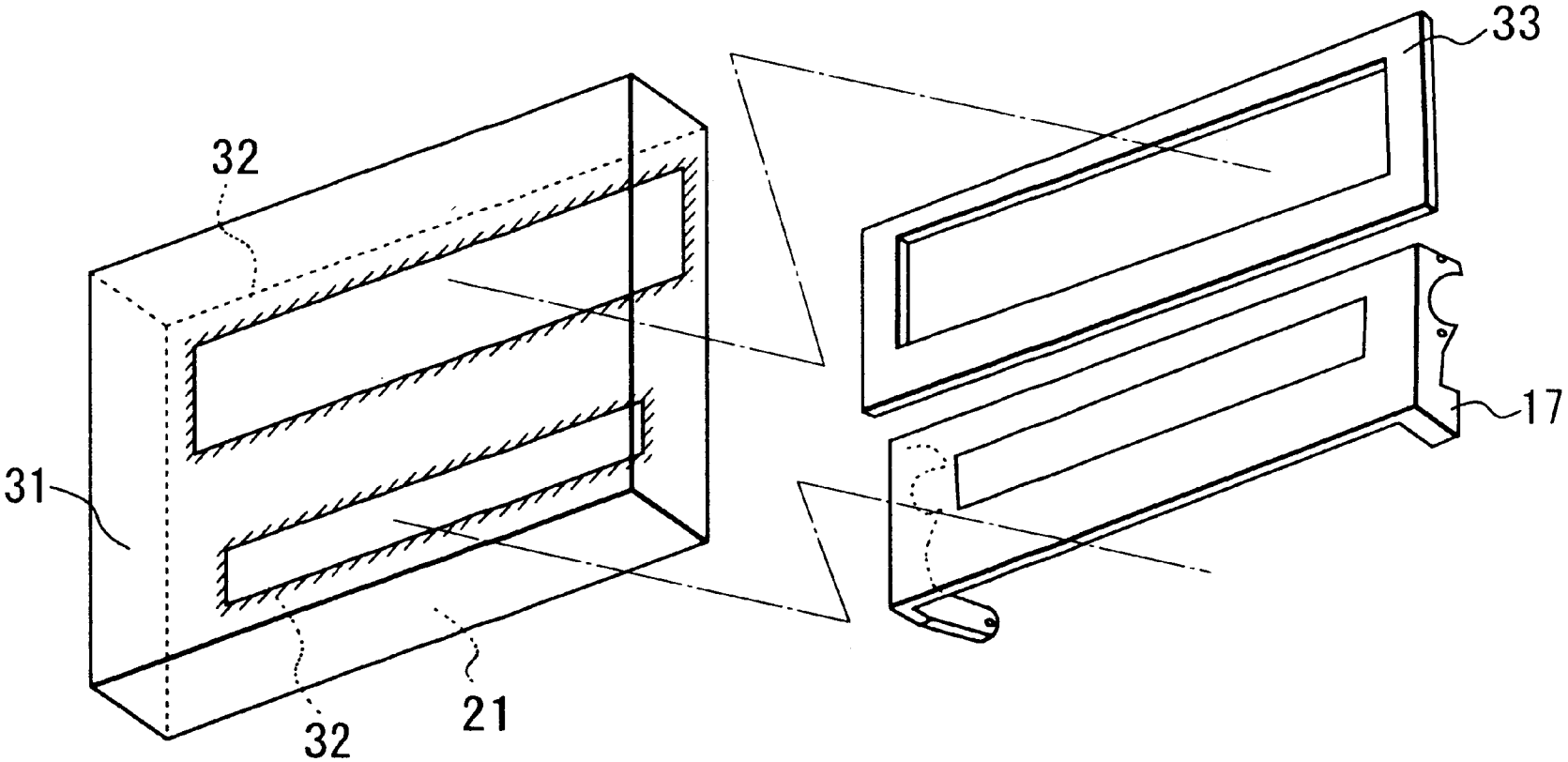
FIG. 15 is a perspective drawing for depicting how the sealing sheet is applied.

Also referring to FIG. 12, the holding jig 31 is provided with a heat generating member 32 for impulse sealing. Next, referring to FIG. 15, after the removal of the backing sheet 21*b*, the layer 21*a* of the flexible seal 21 held by the holding jig 31 is pressed onto the backing plate 33 and the developing means holding frame 17. Next, with the layer 21*a* of the flexible seal 21 being pressed onto the backing plate 33 and the developing means holding frame 17, electrical current briefly flows through the heat generating member 32 to generate heat, and then, the layer 21*a* of the flexible seal 21 is allowed to cool. As a result, the layer 21*a* of the flexible seal 21 becomes welded to the backing plate 33 and the developing means holding frame 17. Thereafter, the vacuum pump is stopped, and the holding jig 31 is raised to be moved away from the layer 21*a* of the flexible seal 21 having become welded to the developing means holding frame 17 and the backing plate 33. The backing plate 33 functions as a part of the developer holding frame 16. In other words, in reality, the hole 33*b* of the backing plate 33 becomes the hole of the developer holding frame 16.

The flexible seal 21 (layer 21*a*) is adhered to the backing plate 33 and the developing means holding frame 17 in such a manner that the surrounding edges of the holes 21*e* and 21*f* of the flexible seal 21 are adhered to the surrounding edge of the hole 33*b* of the backing plate 33, and the surrounding edge of the developer receiving hole 17*b* of the developing means holding frame 17, respectively.

As a result, the flexible seal 21 (layer 21*a*) is welded to the developing means holding frame 17 and the backing plate 33 as shown in FIG. 11. Then, the flexible seal 21 is folded in the direction indicated by the arrow mark in FIG. 11, so that the first and second holes 21*e* and 21*f* face each other. Then, the mutually facing halves of the flexible seal 21 are joined to each other by their edges 21*d* (hatched portions), forming a pouch that functions like bellows. The flexible seal 21 may be folded so that the resultant pouch will be shaped like accordion bellows with a plurality of folds.

In this embodiment, ester film is used as the material for the layer 21*a* of the flexible seal 21. However, hot melt film such as film, of copolymer of ethylene and vinyl acetate or the like, may be used.

Further, in this embodiment, the actual flexible seal 21, or the layer 21*a*, is formed of single layer film. Therefore, if a heat-seal method, in which heat is continuously applied, is used, it is possible that the layer 21*a* of the flexible seal 21 will be welded to the heating portion. Thus, the flexible seal 21 should be welded by an impulse-seal method in which the heating, cooling, and holding processes can be carried out in a short time.

In addition, ultrasonic welding, in which heat is instantaneously generated, or adhesive, adhesive tape, or the like, which does not involve heat, may be used.

With the provision of the above-described structural arrangement, even if the layer 21*a* of the flexible seal 21 is extremely thin, and is difficult to paste in a wrinkle-free manner, it can be adhered to a target area while holding a proper shape by being supported by the backing sheet, which is removed after the layer 21*a* is adhered.

Incidentally, a flexible seal 21, which comprises a plurality of layers, may be used in place of the above-described flexible seal 21 in which the actual flexible seal layer 21*a* is formed of a single layer film. Also in such a case, the above-described method for attaching the flexible seal 21 can be used.

Next, the backing plate 33 is attached to the developer holding frame 16. At this stage, a portion of the backing plate 33 is not welded or adhered to the developer holding frame 16, being left unattached thereto, so that the developer seal 24 can be passed through between the backing plate 33 and developer holding frame 16.

Referring to FIG. 7, in this embodiment, the areas 33*a* are welded, and the area across which the toner sealing member 25 presses upon the developer seal 24 is not welded.

Figure 8:
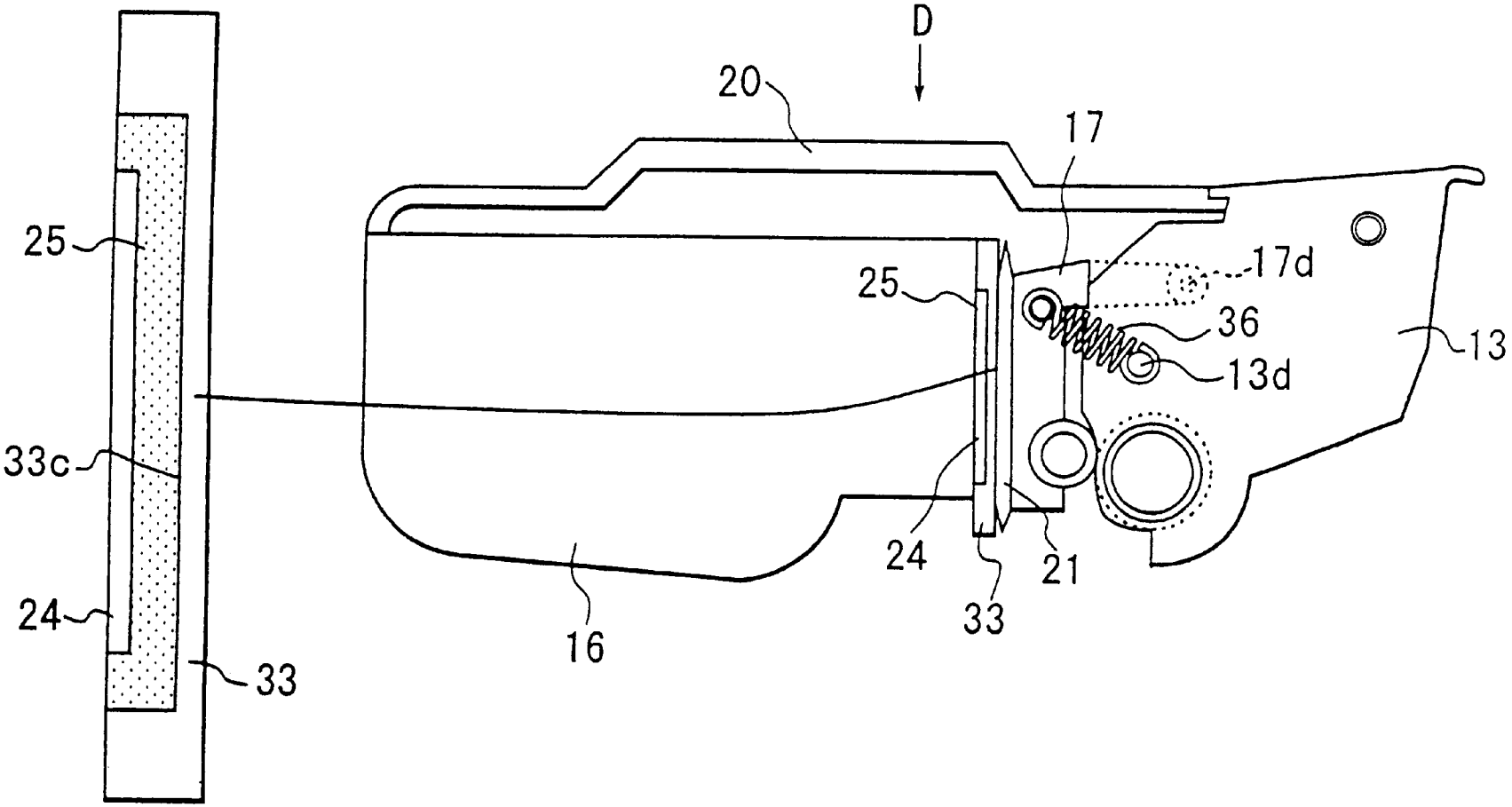
FIG. 8 is a rough rear view of the process cartridge, with the side cover removed.

The toner sealing member 25 is an elastic member formed of felt or the like material. It is a long and narrow member and is attached to the backing plate 33, along the edge of one of the longitudinal ends of the backing plate 33, extending in the width direction of the backing plate 33. It is pasted to the bottom surface of the recess 33*c* in the backing plate 33 (FIG. 8).

With the provision of the above-described structural arrangement, even if the gap between the mutually facing surfaces of the developer holding frame 16 and developing means holding frame 17 fluctuates, the resistance that occurs as the developing means holding frame 17 is displaced is extremely small, because the flexible seal 21 is folded in the shape of a pouch or bellows, and is formed of very thin flexible film.

(Other Examples of Sealing Member for Airtightly Sealing Between Developing Means Holding Frame and Toner Holding Frame)

Figure 16:
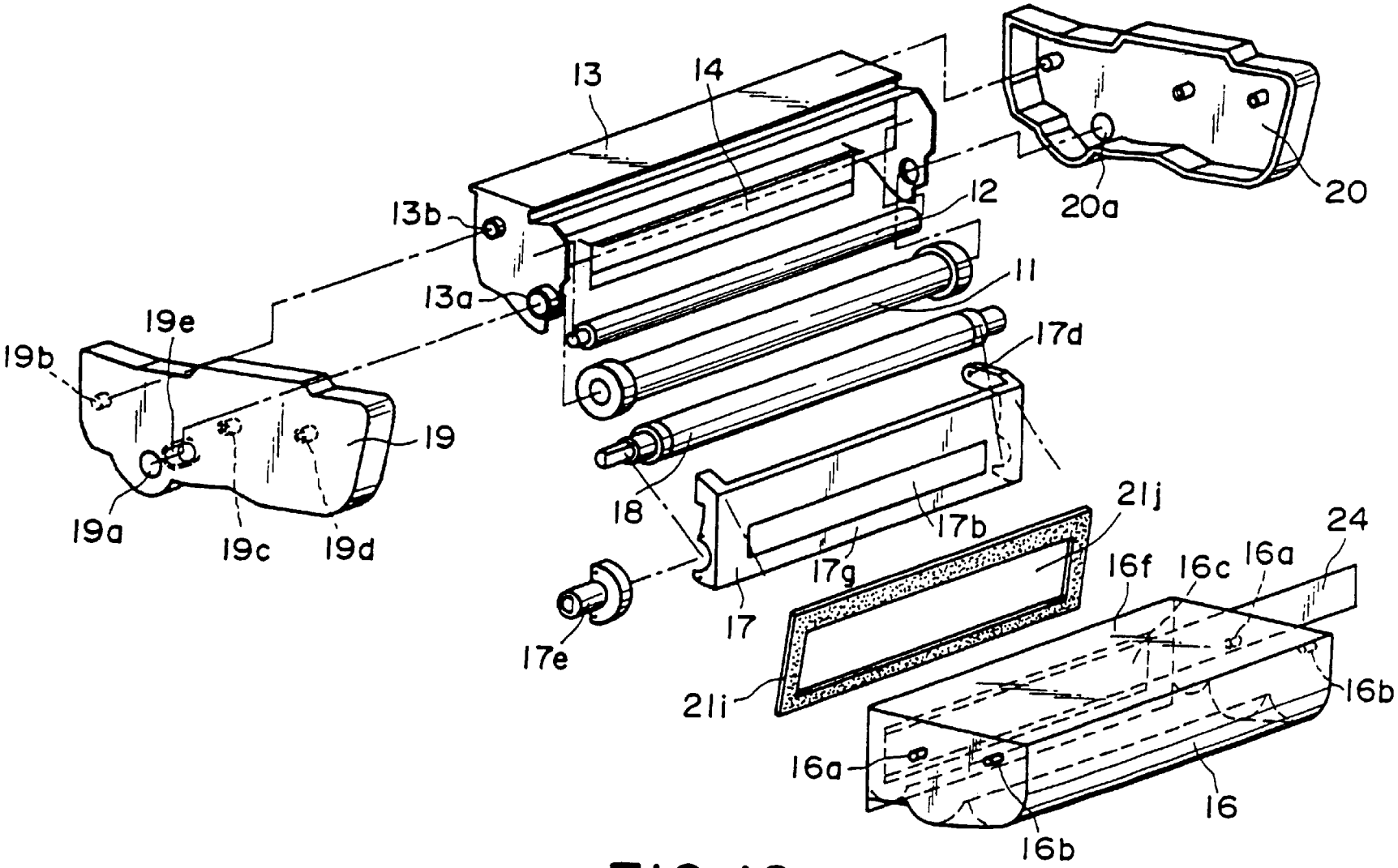
FIG. 16 is an exploded perspective view of the process cartridge, for showing the sealing sheet for sealing between a toner container and a developing means holding frame in another embodiment of the present invention.

FIG. 16 is an exploded perspective view of a process cartridge, for describing another example of a sealing member. FIG. 16 is a simplified version of FIG. 7, except that the sealing member in FIG. 16 is different from that in FIG. 7.

Figure 17:
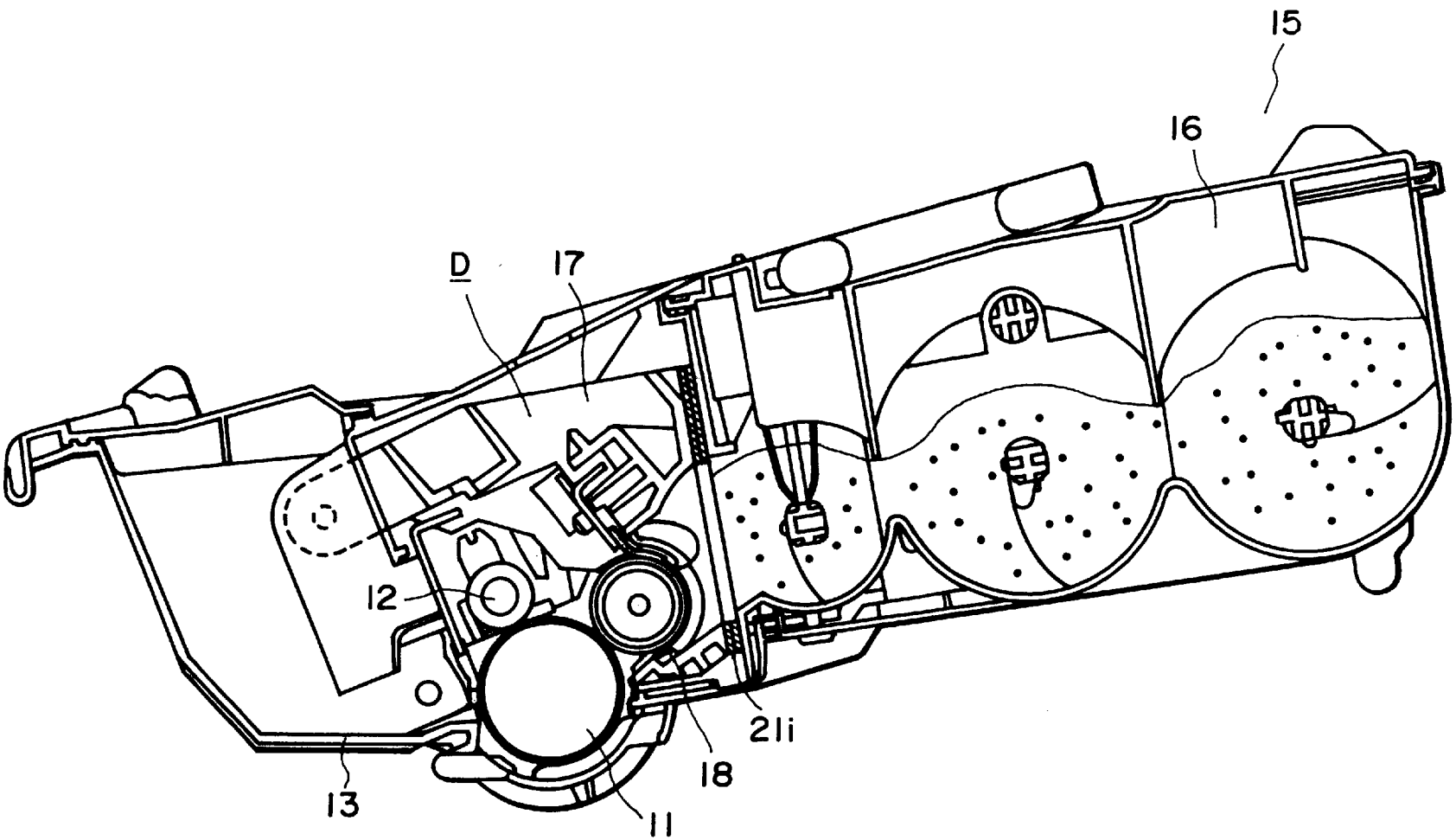
FIG. 17 is a vertical sectional view of the process cartridge, for showing the sealing sheet for sealing between a toner container and a developing means holding frame in another embodiment of the present invention.

FIG. 17 is a sectional view of a process cartridge at a plane perpendicular to the longitudinal direction of the process cartridge.

A flexible member 21*i* is in the form of a plate, and is formed of flexible material such as foamed synthetic resin (for example, foamed urethane), rubber with a relatively low level of hardness, silicone, or the like. It is provided with a hole 21*j*, which aligns with the developer receiving hole 17*b* of the developing means holding frame 17, and the developer supplying hole 16*c* of the developer holding frame 16, as the flexible member 21*i* is mounted. The hole 21*j* of the flexible member 21*i* is approximately the same in size as the holes 17*b* and 16*c*. The flexible member 21*i* is pasted to one or both of the mutually facing surfaces of the developing means holding frame 17 and developer holding frame 16, except across the portion corresponding to the area through which the developer seal 24 is passed when it 25 is pulled out of the process cartridge 15.

The thickness of the flexible member 21*i* before the process cartridge is assembled is greater than the distance between the mutually facing surfaces of the developing means holding frame 17 and developer holding frame 16, in particular, between the portion 17*g* surrounding the developer receiving hole 17*b* of the developing means holding frame 17, and the portion 16*f* surrounding the developer supplying hole 16*c* of the developer holding frame 16, after the process cartridge is assembled.

Therefore, in the process cartridge 15 having been assembled as shown in FIG. 17, the flexible sheet 21*i* remains compressed by the mutually facing surfaces 17*g* and 16*f* of the developing means holding frame 17 and developer holding frame 16, respectively. The reactive force generated as the flexible sheet 21*i* is compressed acts as such force that presses the spacer rings 18*b* of the development roller 18 upon the photosensitive drum 11. Therefore, it is desired that the resiliency of the flexible sheet 21*i* is rendered as small as possible.

The employment of this flexible sheet 21*i* makes it possible to eliminate the need for the backing plate 33 described with regard to the preceding method for sealing between the developer holding frame 16 and developing means holding frame 17, and also, the flexible sheet 21*i* is easier to apply than the flexible seal 21.

(Developer Seal)

The developer seal is extended from one end of the developer supplying hole 16*c* of the developer holding frame 16 to the other to seal the hole 16*c*, and then, is folded back and doubled back beyond the starting point as shown in FIG. 7. Prior to the application of the developer seal 24, the stirring members 113, 114, and 123 are assembled into the developer holding frame 16. After the application of the developer seal 24, toner is filled into the developer holding frame 16 through the toner filling hole 16*g*. After the filling, a toner cap 37 is pressed into the toner filling hole 16*g*.

To summarize the description of the sealing member given above, the developing means holding frame 17 and developer holding frame 16 are connected by the flexible seal 21, which is pasted to the developing means holding frame 17 and backing plate 33.

The flexible seal 21 is provided with the first and second holes 21*f* and 21*e*, which provide a passage, or a through hole, between the developer holding frame 16 and developing means holding frame 17 as the flexible seal 21 is folded. One end of the thus provided through hole faces the developer supplying hole 16*c* of the developer holding frame 16 through the hole 33*b* of the backing plate 33, and the other end of the through hole faces the developer receiving hole 17*b* of the developing means holding frame 17. The developer supplying hole 16*c* is a hole through which the toner stored in the developer storing portion 16*h* of the developer holding frame 16 is conveyed toward the development roller 18 as a developing member. The developer receiving hole 17*b* is a hole through which toner is received into the developing means holding frame 17 after passing through the developer supplying hole 16*c*. The flexible seal 21 is pasted to the backing plate 33 by the surrounding edge of one end of the above-described through hole, and is pasted to the developing means holding frame 17 by the surrounding edge of the other end of the through hole. In other words, the first hole 21*e*, or one end of the above described through hole, faces the developer receiving hole 17*b* of the developing means holding frame 17, and the second hole 21*f*, or the other end of the through hole 21*f*, faces the developer supplying hole 16*c* of the developer holding frame 16 through the hole 33*b* of the backing plate 33.

After the connection between the developer holding frame 16 and developing means holding frame 17, the flexible seal 21 is in the form of a pouch, with one of the mutually facing two halves of the flexible seal 21, or one side of the pouch, having the first hole 21*f*, and the other half, or the other side of the pouch, having the second hole 21*e*. The first hole 21*f* of the one side of the pouch faces the developer supplying hole 16*c* of the developer holding frame 16 through the hole 33*b* of the backing plate 33, whereas the second hole 21*e* of the other side of the pouch faces the developer receiving hole 17*b* of the developing means holding frame 17. The developer supplying hole 16*c* is a hole through which the toner stored in the developer storing portion 16*h* of the developer holding frame 16 is conveyed toward the development roller 18 as a developing member. The developer receiving hole 17*b* is a hole through which toner is received into the developing means holding frame 17 after passing through the developer supplying hole 16*c*. The flexible seal 21 is pasted to the backing plate 33 provided as a part of the developer holding frame 16, by the surrounding edge of the first hole 21*f* of the above described one side of the pouch, and also is pasted to the developing means holding frame 17 by the surrounding edge of the second hole 21*e* of the other side of the pouch.

After the flexible seal 21 is pasted to the developing means holding frame 17 and developer holding frame 16, it has at least one fold, being shaped like a bellows, one end of which is pasted to the backing plate 33 provided as a part of the developer holding frame 16, and the other end of which is pasted to the developing means holding frame 17.

The flexible seal 21 is formed of elastic material or a heat-seal member.

In comparison, the flexible sheet 21*i*, or a different type of a flexible seal, is formed of foamed urethane, rubber with a relatively low degree of hardness, silicone, or the like.

Figure 49:
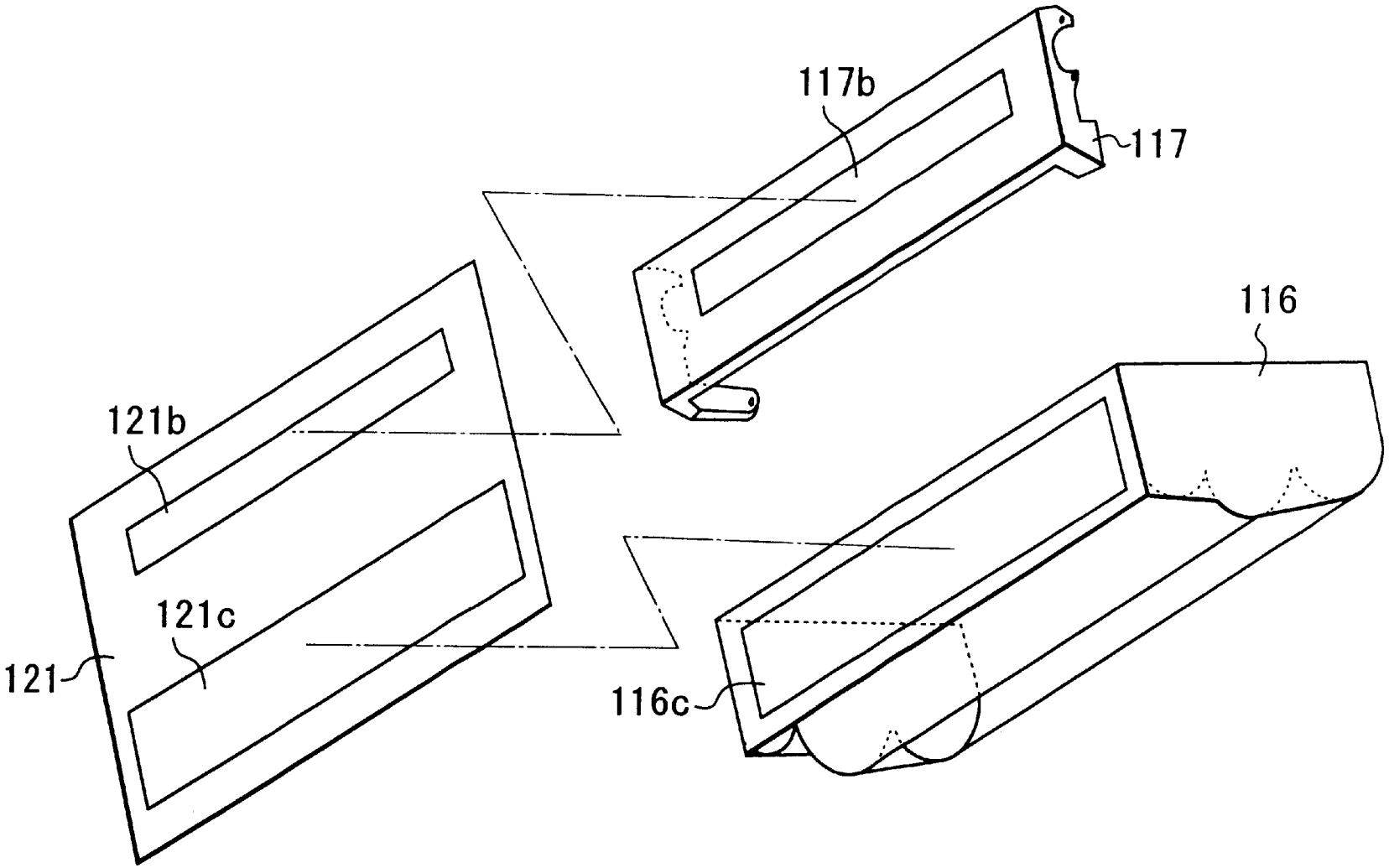
FIG. 49 is an exploded perspective view of the sealing member (sealing sheet) in another embodiment of the present invention, for showing a method for forming the sealing member.
Figure 50:
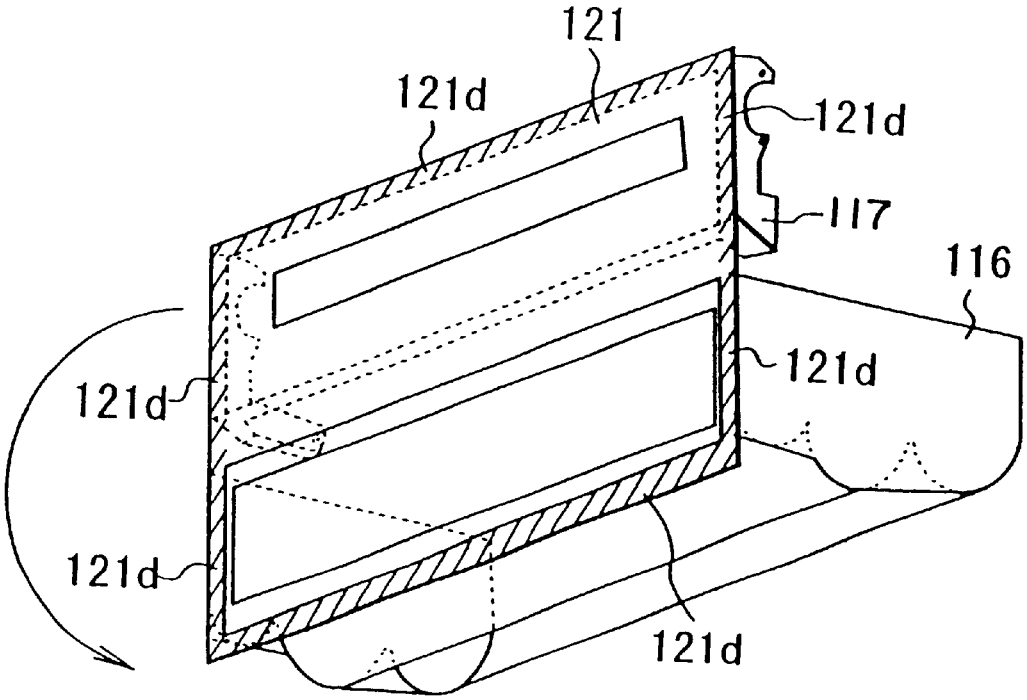
FIGS. 50 and 51 are a perspective view of a sealing member (sheet) in an embodiment and a side view of a sealing member (sheet) in an embodiment, for showing the method for forming the sealing member.

Next, referring to FIGS. 49 and 50, a method for forming a flexible sealing member 121 into a pouch-like member will be roughly described.

Referring to FIG. 49, the sealing member 121 has holes 121*c* and 121*b*, which are approximately the same in size as, or larger in size than, the toner supplying hole 116*c* of the toner holding frame 116 and the toner receiving hole 117*b* of the developing means holding frame 117, respectively.

Figure 51:
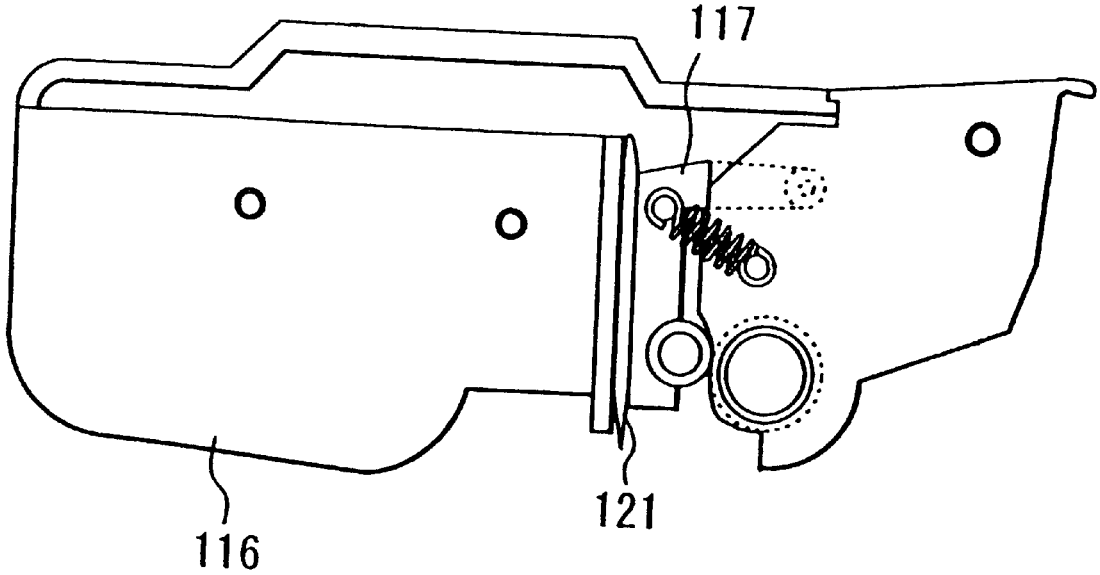

As shown in FIGS. 50 and 51, the sealing member 121 is pasted to the developing means holding frame 117 and developer holding frame 116, and then, it is formed into a bellows (which is shaped like a pouch) by being folded in the direction indicated by an arrow mark so that the holes of the frames 116 and 117 face each other. In this embodiment, the sealing member 121 is thermally welded to the developing means holding frame 117 and developer holding frame 116. However, the method for attaching the sealing member 121 to the frames 117 and 116 does not need to be limited to thermal welding. For example, ultrasonic welding, adhesive, adhesive tape, or the like, may be used.

Next, the two halves of the sealing member 121, which have been created by the folding of the sealing member 121, are joined to each other at their fringe portions 121*d* (hatched portions) in a manner to seal the joint. Also in this case, thermal welding, ultrasonic welding, adhesive, or adhesive tape, may be used to seal the joint.

Incidentally, a method different from the above-described one may be used to attach the sealing member 121 to the developer holding frame 116 and developing means holding frame 117. For example, a method in which the sealing member 121 is first attached to an unshown backing plate, and then, the backing plate is attached to the developer holding frame 116 and the developing means holding frame 117 with the use of screws, or the like methods, may be employed.

With the provision of the above-described structural arrangement, in other words, as the sealing member 121 is formed into a pouch-like bellows, even when the gap between the mutually facing surfaces of the developer holding frame 116 and the developing means holding frame 117 fluctuates, the resistance that occurs as the distance fluctuates is extremely small. Further, forming a bellows by folding a single sheet, or the sealing member 121, reduces the production cost.

Incidentally, in this embodiment, the developer supplying hole 116*c* of the developer holding frame 116 and the developer receiving hole 117*c* of the developing means holding frame 117 are connected to each other with the interposition of only the sealing member 121. However, when there is a certain reason related to production, a backing plate or the like may be combined with the sealing member 121 to form a bellows unit for connecting the two frames.

As is evident from the above description, according to the preceding embodiments of the present invention, a sealing member for connecting between the openings of the developing means holding frame and the developer holding frame of a developing apparatus, and also for perfectly sealing between the two frames, is formed by folding an elastic sheet in half and pasting the thus created two halves of the elastic sheet together at their edges, and this sealing member is used for sealing between the developing means holding frame and developer holding frame so that the displacement of the developing means holding frame and developer holding frame relative to each can be absorbed by the sealing member. Therefore, even if the capacity of the developer holding frame is substantially increased, the load which is applied to a developing member and an electrophotographic photosensitive member does not increase, and further, the decrease in the amount of the developer in the developer holding frame does not affect an image.

(Developing Apparatus Structure)

It has been already described that a pair of tension springs 36 are placed in the stretched state between the developing means holding frame 17 and cleaning means holding frame 13 (FIG. 8). The following is a further development of this structure.

Figure 18:
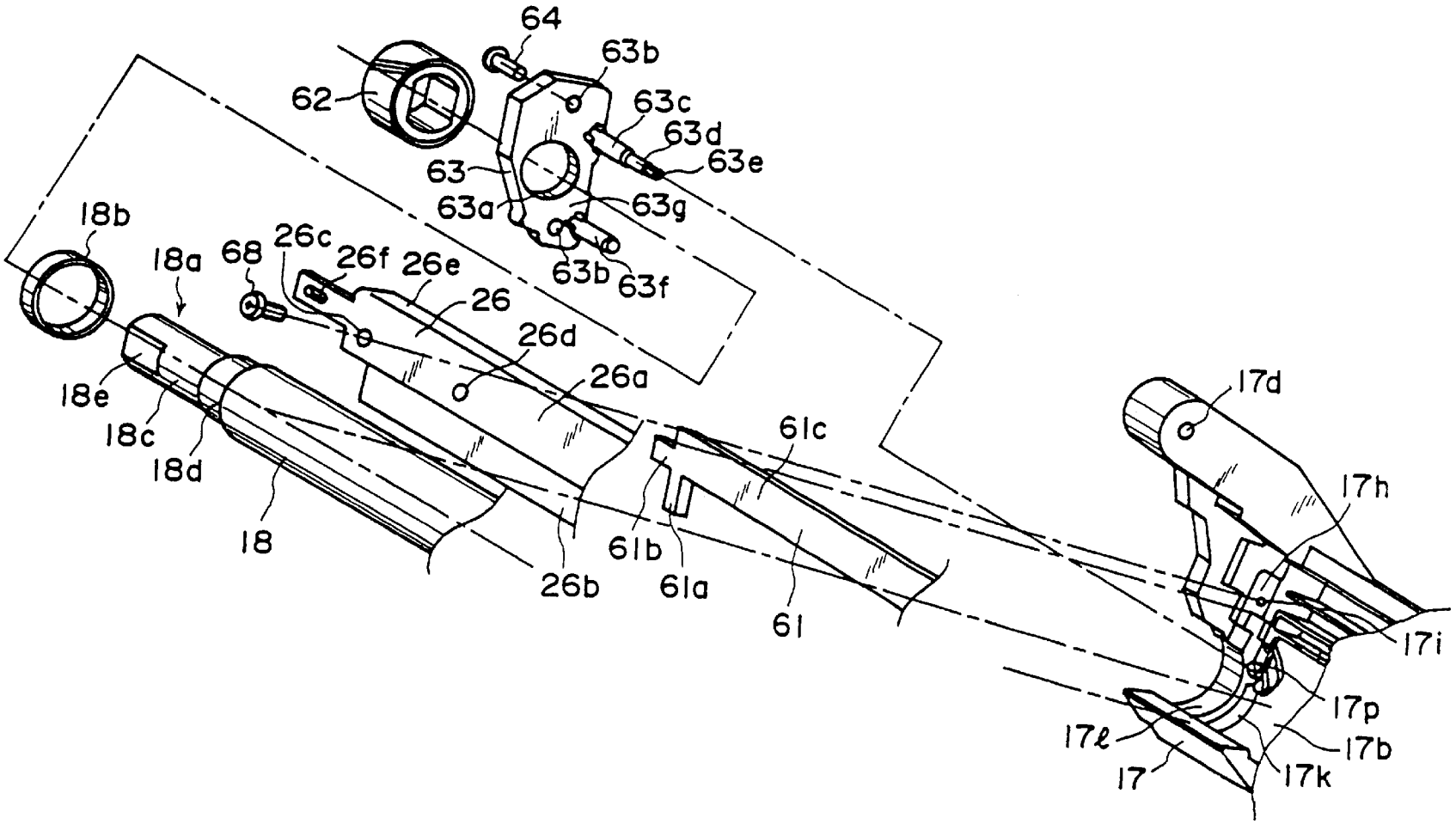
FIG. 18 is an exploded perspective view of a developing apparatus, for describing the structure for connecting a developing means holding frame and a cleaning means holding frame.
Figure 19:
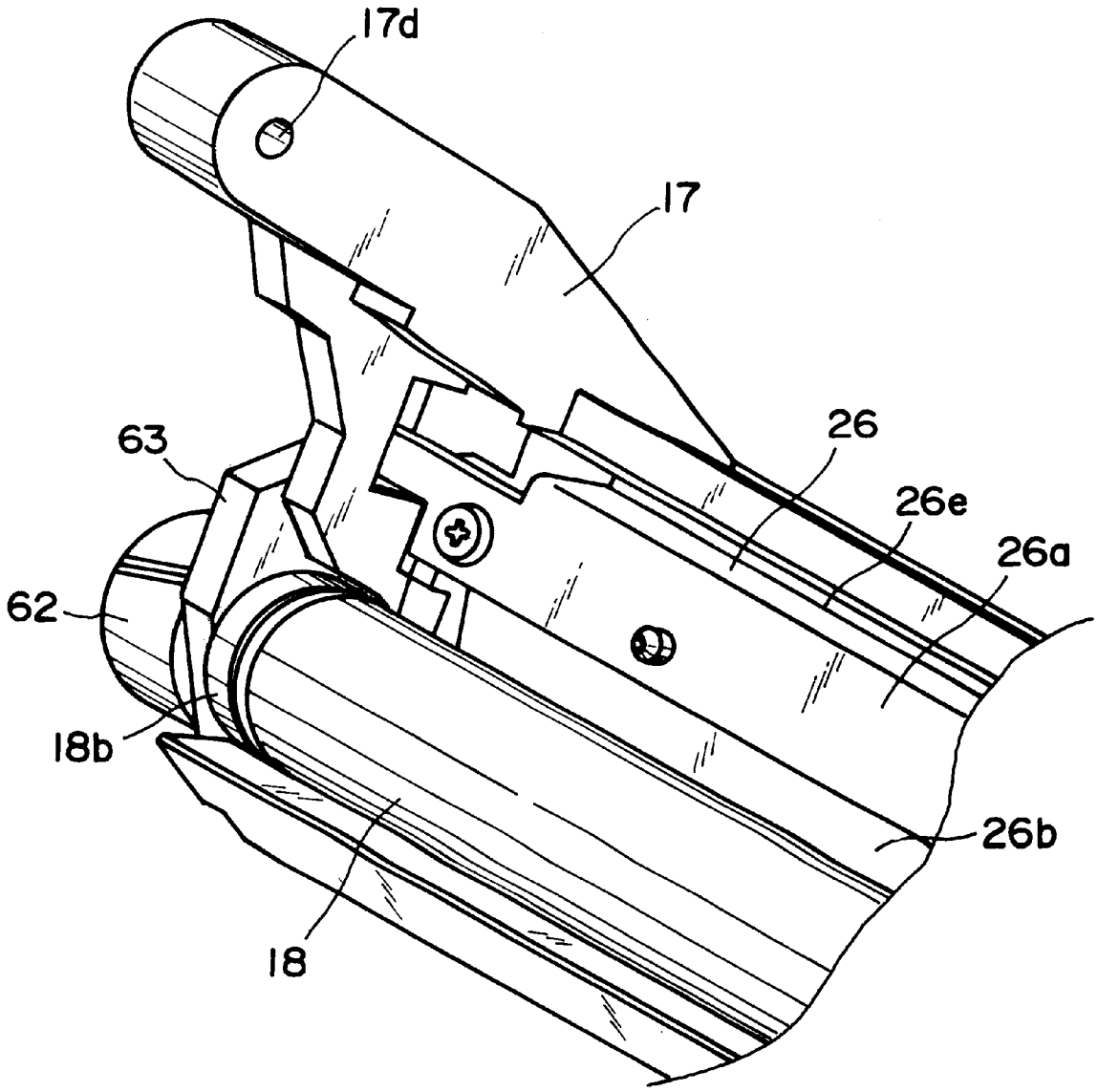
FIG. 19 is a perspective view of a portion of the developing apparatus.

Next, referring to FIGS. 18 and 19, the structure of the developing apparatus will be described. FIG. 18 is a perspective view of the components of the developing apparatus prior to their assembly, and FIG. 19 is a perspective view of the components of the developing apparatus after their assembly. The developing means holding frame 17 contains structural components such as the development roller 18, the development blade 26, and the like, which are involved in image formation. At this time, the description of the developing apparatus is given with reference to only one side, or the front end cover 20 side, of the apparatus. However, the structure of the developing apparatus on the other side, or the rear end cover 19 side, is the same as that on the front end cover 20 side.

The development blade 26 comprises a 1–2 mm thick metallic plate 26*a*, and a urethane rubber 26*b* fixed to the metallic plate 26*a* by hot melting, double-side adhesive tape, or the like. The amount of the toner on the peripheral surface of the development roller 18 is regulated by positioning the development blade 26 in such a manner that the urethane rubber 26*b* contacts the generatrix of the development roller 18. In some cases, silicon-rubber is used for the development blade 26. Referring to FIG. 18, the flat surface 17*h*, as a blade mounting portion, of the developing means holding frame 17 is provided with a hole 17*i* with female threads. It is also provided with a positioning joggle (unshown) which is located closer to the center of the developing means holding frame 17. The development blade 26 is placed on the developing means holding frame 17 so that the positioning joggle (unshown) of the developing means holding frame 17 fits through the hole 26*d* of the metallic plate 26*a*. Then, a small screw 68 is put through the screw hole 26*c* of the metallic plate 26*a* and is screwed into the hole 17*i* with female threads, to solidly fix the metallic plate 26*a* to the flat surface 17*h*. As a result, the position of the edge of the urethane rubber 26*b* is fixed, and therefore, the amount of the pressure applied to the development roller 18 by the urethane rubber 26*b* becomes fixed. In other words, the distance from the edge of the urethane rubber 26*b* to the contact point between the peripheral surface of the development roller 18 and the imaginary extension of the urethane rubber 26*b* toward the development roller 18 is set, thereby determining development conditions. In order to increase the rigidity of the metallic plate 26*a* of the development blade 26 so that the urethane rubber 26*b* evenly contacts the development roller 18 in terms of the longitudinal direction of the development roller 18, the metallic plate 26*a* is bent approximately 90° at a line parallel to the longitudinal direction, creating a bent portion 26*e*. Further, the metallic plate 26*a* is rendered long enough to protrude from both ends of the developing means holding frame 17 after its mounting into the developing means holding frame 17, and each of these protruding end portions of the metallic plate 26*a* is provided with a hole 26*f* for anchoring a pressure generating spring that will be described later.

The developing means holding frame 17 is provided with an elastic sealing member 61, which is pasted to the developing means holding frame 17 to prevent toner from leaking out. The elastic sealing member 61 is shaped like a letter U stretched in the direction of the horizontal stroke, extending along the top edge of the developer receiving hole 17*b* from one end to the other (first straight portion 17*n*), and also extending a predetermined distance downward (second straight portion 17*p*) from the top of the shorter edge of the developer receiving hole 17*b*. It is formed of MOLTPRENE, or the like. The first and second straight portions 61*c* and 61*a* of the elastic sealing member 61 are pasted to the aforementioned first and second straight portions 17*n* and 17*p* of the developing means holding frame 17. This elastic sealing member 61 is sandwiched between the developing means holding frame 17 and development blade 26, remaining thereby in the compressed state, to prevent toner from leaking out. The elastic sealing member 61 is also provided with an earlobe-like portion 61*b*, which protrudes several millimeters from the longitudinal end in the longitudinal direction, and plays a role in accurately positioning an unshown magnetic seal.

Each of the longitudinal ends of the developing means holding frame 17 is provided with a groove 17*k*, which is in the semicylindrical surface 17*l* of the developing means holding frame 17, the curvature of which matches that of the peripheral surface of the development roller 18. The groove 17*k* extends from the top to bottom ends of the semicylindrical surface 17*l*, along the edge of the developer receiving hole 17*b* perpendicular to the longitudinal direction. In the groove 17*b*, a magnetic seal (unshown) is attached to prevent toner from leaking and following the peripheral surface of the development roller 18, by the magnetic force of the magnetic seal.

The mandible-like portion of the developing means holding frame 17 is provided with a thin elastic sealing member (unshown), which is pasted to the mandible-like portion in a manner to contact the generatrix of the development roller 18.

The development roller 18 is a cylindrical member formed of metallic material such as aluminum or stainless steel. It is approximately 16–20 mm in external diameter, and 0.5–1.0 mm in wall thickness. In order to improve the efficiency with which developer is charged, the peripheral surface of the development roller 18 is coated with carbon, or blasted. In this embodiment, the peripheral surface of the development roller 18 has been simply coated with carbon.

The longitudinal ends of the development roller 18 are fitted with a sleeve flange 18*a* (one at one of the longitudinal ends is shown), which is a cylindrical member with a step portion, formed of metallic material such as aluminum or stainless steel, and is pressed into the end of the development roller 18. The sleeve flange 18*a* is coaxial with the development roller 18, and has two cylindrical portions: a first cylindrical portion 18*d* with a larger diameter and a second cylindrical portion 18*c* with a diameter smaller than that of the first cylindrical portion. The first cylindrical portion 18*d* is fitted with a distance regulating member 18*b* in the form of a ring (which may be referred to as spacer ring) for regulating the distance (which hereinafter will be referred to as "SD gap") between the peripheral surfaces of the development roller 18 and the photosensitive drum 11. The spacer ring 18*b* is formed of dielectric material such as polyacetal. The external diameter of the spacer ring 18*b* is greater by twice the SC gap than the external diameter of the development roller 18. The second cylindrical portion 18*c* is fitted in a development roller bearing 63 (shown in FIG. 20, which is an enlarged perspective view of the end cover 20 side of the developing apparatus, on the side opposite to the side shown in FIGS. 18 or 19) for accurately positioning the development roller 18 relative to the developing means holding frame 17 while rotationally supporting the development roller 18. The end portion of the second cylindrical portion 18*c* has been flattened to give it the so-called double "D" cross section. A development roller gear 62 formed of synthetic resin is fitted around the cylindrical portion 18*c*, being prevented by this flattened portion 18*e* from rotating around the cylindrical portion 18*c*. The development roller gear 62 is driven by a helical drum gear (unshown) attached to one of the longitudinal ends of the photosensitive drum 11, and rotates a development roller 18. The teeth of the development roller gear 62 are twisted in the direction to thrust the development roller 18 toward the center of the developing apparatus. Within the development roller 18, a cylindrical magnet (which is not shown in FIG. 18, and will be described later) for adhering toner onto the peripheral surface of the development roller 18 is placed.

The development-roller bearing 63 is a virtually flat member with an approximate thickness of 2–5 mm, and is formed of resinous material with a higher level of slipperiness. It has the cylindrical bearing portion 63*a*, which is located in the approximate center of the flat portion 63*g*. The internal diameter of the bearing portion 63*a* is in a range of 8–15 mm. In this bearing portion 63*a*, the second cylindrical portion 18*c* of the sleeve flange 18*a* is fitted to allow the development roller 18 to rotate, with the peripheral surface of the second cylindrical portion 18*c* sliding on the wall of the hole of the bearing portion 63*a*. The flat portion 63*g* is provided with a joggle 63*c*, which projects approximately parallel to the axial line of the bearing portion 63*a* to accurately position the development-roller bearing 63 relative to the developing means holding frame 17. The joggle 63*c* is divided into three portions: a base portion, a portion 63*d*, or the middle portion, and a portion 63*e*, or the end portion, which are coaxial. The portions 63*d* and 63*e* of the joggle 63*c* are used to accurately position the magnetic seal. Further, the flat portion 63*g* is provided with screw holes 63*b* for solidly fixing the development-roller bearing 63 to the developing means holding frame 17, with the use of small screws 64 or the like. More specifically, the joggle 63*c* of the development-roller bearing 63 fits into an unshown hole provided in the end wall of the developing means holding frame 17 in terms of the longitudinal direction, and the joggle 63*f* of the development roller bearing 63 fits into another unshown hole, with the elongated cross section, of the same end wall of the developing means holding frame 17, so that the flat portion 63*g* of the development-roller bearing 63 flatly contacts the above-described end wall of the developing means holding frame 17. Then, the small screws 64 are put through the corresponding screw holes of the development roller bearing 63, and screwed into the corresponding unshown female threaded holes of the developing means holding frame 17. With this structural arrangement, the development blade 26 and development roller 18 are accurately positioned relative to the developing means holding frame 17, assuring that high quality images are consistently outputted.

In some cases, a highly slippery substance (for example, polyphenylene sulfide, or polyamide), which is relatively costly, is used as the material for the bearing portion 63*a* of the development-roller bearing 63 in order to allow the sleeve flange 18*a* to smoothly rotate. In such cases, the cost of the development-roller bearing 63 can be reduced by dividing the development roller bearing 63 into a bushing portion that actually bears the development roller 18, and a housing portion, because only the bushing portion, or the portion with a smaller volume, requires highly slippery material, whereas the housing portion, or the substantial portion of the development-roller bearing 63, may be formed of relatively inexpensive material, such as high impact polystyrene or the like.

Within the development roller 18, a magnet (unshown) for adhering toner onto the peripheral surface of the development roller 18 is placed.

In the above, the developing apparatus is described with reference to the side from which the development roller 18 is driven (driven side). The side of the developing apparatus from which the development roller 18 is not driven (non-driven side) will be described later.

(Structure for Supporting Developing Apparatus)

Figure 20:
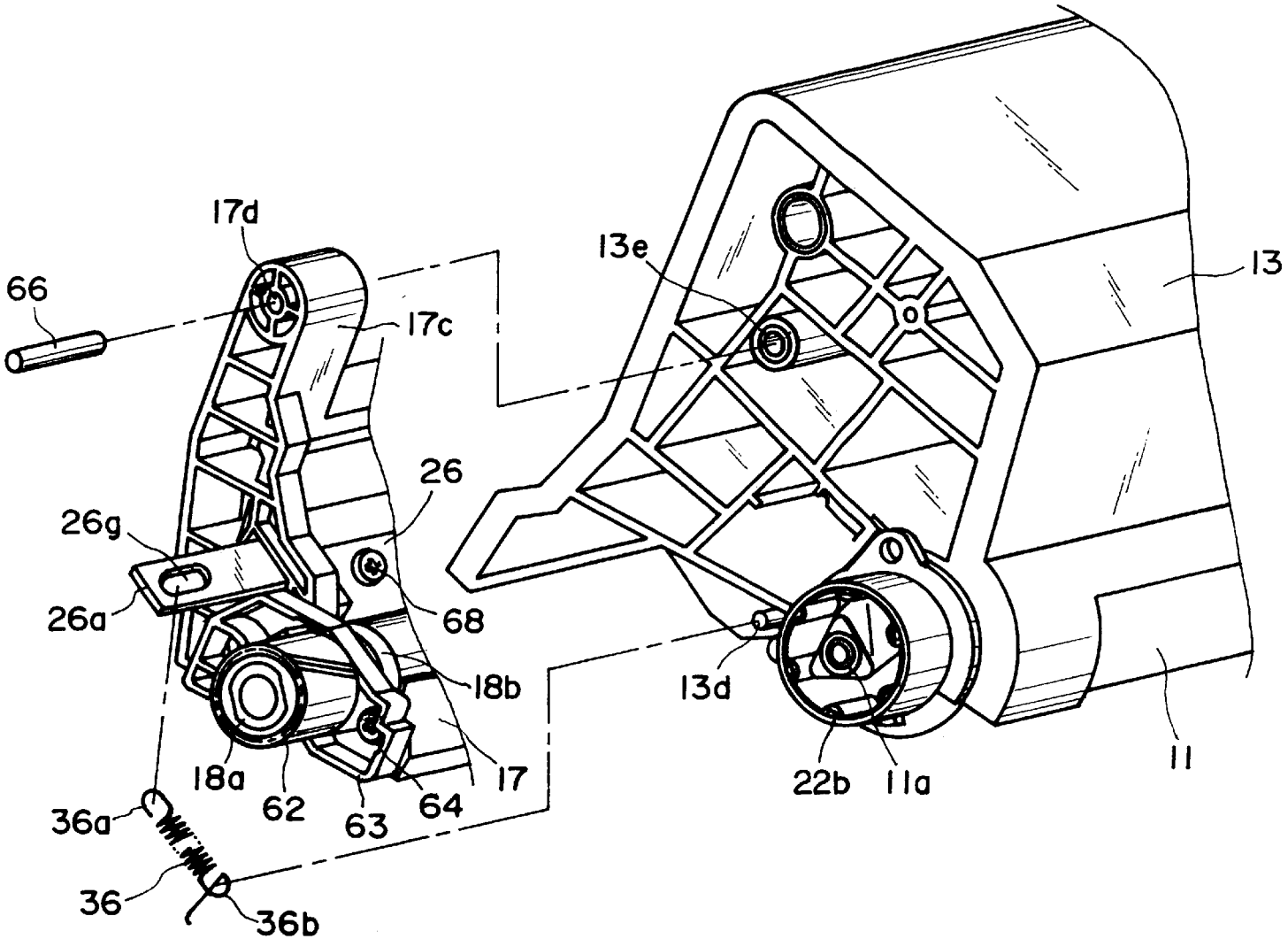
FIG. 20 is an exploded perspective view of the structure for connecting the developing apparatus and cleaning means holding frame.
Figure 21:
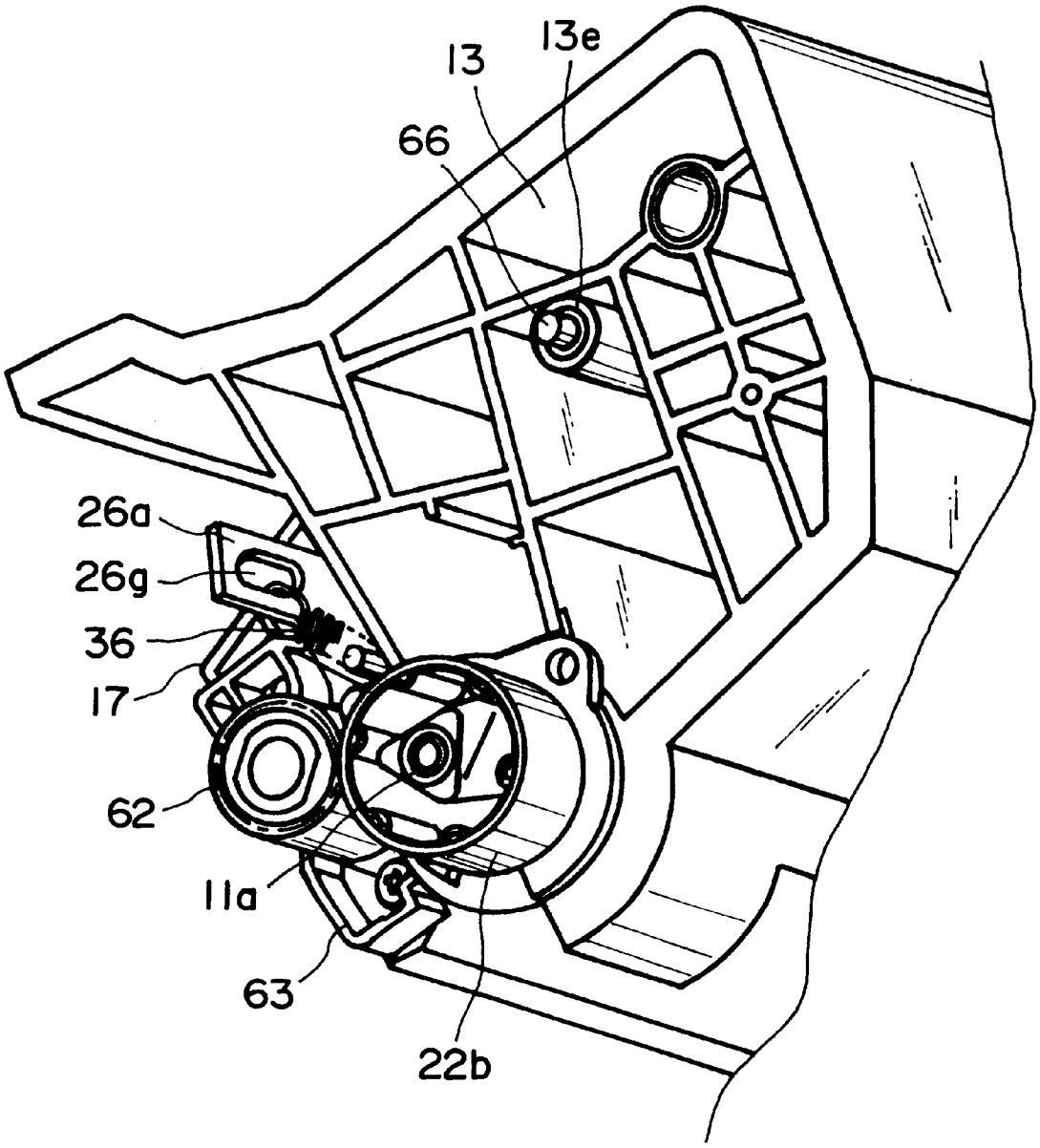
FIG. 21 is a perspective view of the structure for connecting the developing apparatus and cleaning means holding frame.
Figure 22:
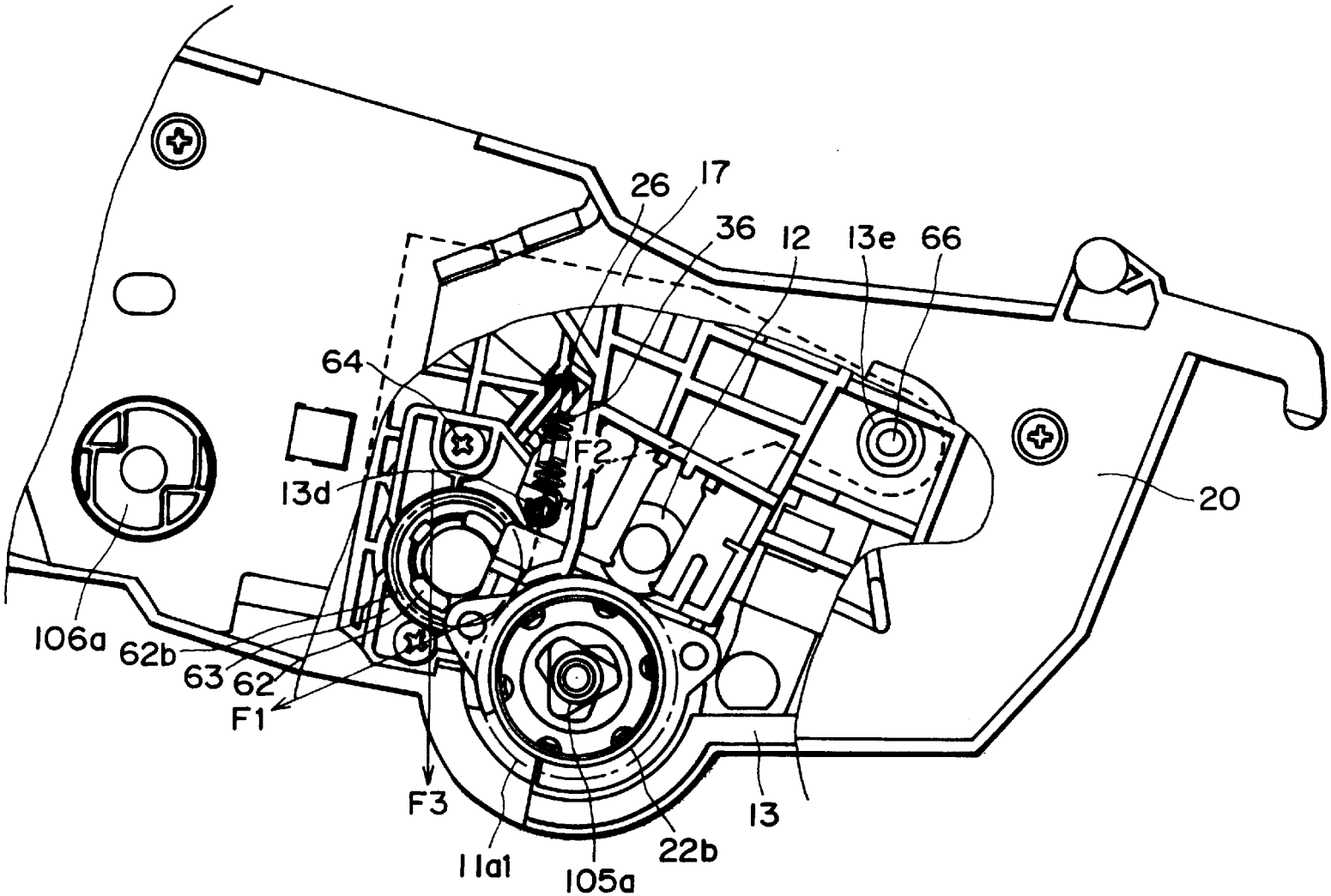
FIG. 22 is a rear view of the structure for connecting the developing apparatus and cleaning means holding frame.
Figure 23:
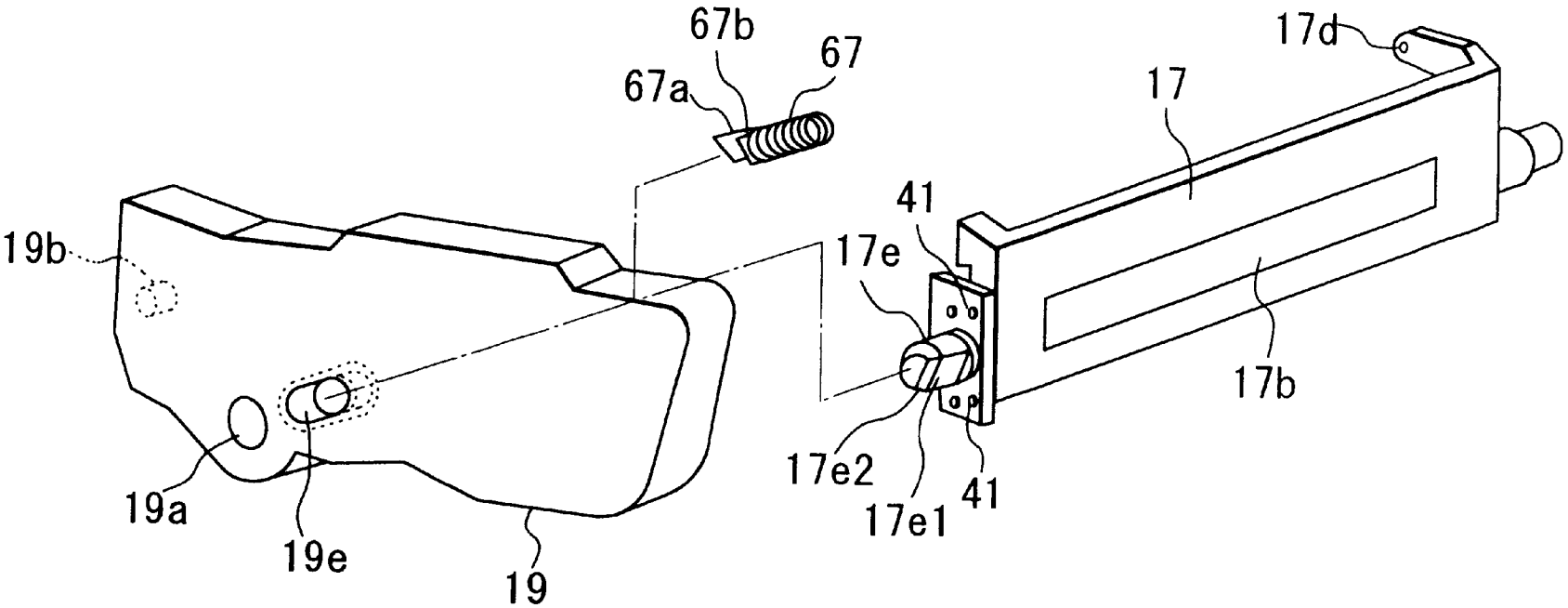
FIG. 23 is an exploded perspective view of the developing means holding frame and side cover, for showing their relationship.

Next, referring to FIGS. 7, 20, 21, 22, and 23, the structure for supporting the developing apparatus will be described. FIG. 20 is a perspective view of the developing apparatus, on the driven side, before the developing apparatus is supported by the cleaning means holding frame 13. FIG. 21 is a perspective view of the developing apparatus, on the driven side, after the developing apparatus is supported by the cleaning means holding frame 13. FIG. 22 is a partially enlarged side view of the driving apparatus, on the driven side, with the end cover removed. FIG. 23 is a perspective view of the developing means holding frame and end cover, on the non-driven side, before the end cover is attached to the developing means holding frame.

As described before, in order to output an image of optimum quality, an optimum SD gap (gap between photosensitive drum 11 and development roller 18) must be kept between the development roller 18 and photosensitive drum 11. For this purpose, in this embodiment, the development roller 18 is pressed upon the photosensitive drum 11 with the application of an optimum amount of pressure (which hereinafter will be referred to as D pressure) to maintain the SD gap (FIG. 2). In this embodiment, this optimum amount of the D pressure is approximately 500 g–2,000 g on both the driven and non-driven sides. If the D pressure (contact pressure between spacer ring and photosensitive drum 11) is no more than the amount within this range, the SD gap tends to widen due to vibrations or the like, and image defects such as unwanted white spots or the like occur. If the D pressure is no less than the amount within this range, the spacer ring 18*b* is collapsed by the D pressure, allowing the SD gap to narrow. Further, it is possible that, with the elapse of time, the spacer ring 18*b* is shaved due to the load exerted upon the peripheral surface and internal surfaces of the spacer rings 18*b*, or the like and damage occurs to the spacer rings 18*b*, failing to maintain the optimum amount of SD gap. In this embodiment, the following structural arrangement is employed to maintain the optimum amount of SD gap. Hereafter, the supporting of the developing apparatus (method for maintaining SD gap) will be separately described for the driven side and non-driven side.

Referring to FIGS. 20, 21, and 22, on the driven side, the developing means holding frame 17 (developing apparatus inclusive of development roller, development blade, and the like) and cleaning means holding frame 13 are positioned relative to each other so that the suspension hole 17*d* located in the end portion of the arm portion 17*c* of the developing means holding frame 17 aligns with the support hole 13*e* of the cleaning means holding frame 13, and a parallel pin 66 is inserted through the suspension hole 17*d* and support hole 13*e*. As a result, the developing means holding frame 17 and cleaning means holding frame 13 are connected, being enabled to pivot relative to each other about the parallel pin 66 in such a manner that the axial line of the development roller 18 moves toward the axial line of the photosensitive drum 11. Referring to FIG. 22, with this structural arrangement, the amount of the pressure by which the development roller 18 is pressed upon the photosensitive drum 11, on the driven side, is the combination of three forces: a working pressure F1 (load exerted at the pitch point between the gear portions 11*a*1 and 62*b* in the direction of a transverse line of action upon a tooth) between the gear portion 11*a*1 of the flange of the photosensitive drum 11 and the gear portion 62*b* of a development roller gear 62; a force F2 generated by the resiliency of the tension spring 36 stretched between the cleaning means holding frame 13 and developing apparatus; and a force F3 which applies to the center of gravity of the developing apparatus due to the self-weight of the developing apparatus. In other words, the structural arrangement is such that all three forces work in the direction to pivot the developing apparatus about the parallel pin 66 (pivotal center) in the counterclockwise direction so that the development roller 18 is pressed upon the photosensitive drum 11. Further, the structural arrangement is made so that the angle which the line connecting the contact point between the photosensitive drum 11 and spacer ring 18*b*, and the pivotal center (66) forms relative to the transverse line of action of the force F1, becomes small, for example, approximately 5 degrees. This is due to the following reason. That is, the working pressure F1 fluctuates due to the fluctuation of torque, and the fluctuation of the working pressure F1 results in the fluctuation of the D pressure. Therefore, the above-described structural arrangement is made to prevent the fluctuation of the D pressure. Further, the force F3 resulting from the self-weight of the developing apparatus is stable because the structural arrangement is such that the load from developer is not exerted upon the developing apparatus D as described before. Further, the tension spring 36 is positioned and supported, as will be described later, so that the resiliency of the spring 36 is not wasted. Therefore, the force F2 is stable. Thus, the D pressure D1 on the driven side remains a constant numerical value.

Referring to FIG. 20, the tension spring 36 is approximately 0.5–1.0 mm in wire diameter. It has hook portions 36*a* and 36*b* at its ends, which are used for anchoring it. As for the material for the tension spring 36, springy material such as SUS, piano wire, phosphor bronze, or the like, is used. One of the hooks, for example, hook 36*a*, is anchored through the hole 26*g* formed in the metallic plate 26*a* of the development blade 26, and the other hook, or the hook 36*b*, is hung around a shaft-like spring mount 13*d* of the cleaning means holding frame 13. The hole 26*g* of the development blade 26 is in the portion of the metallic plate 26*a*, which is projecting outward from the developing means holding frame 17. It is 2–5 mm in width and 4–8 mm in length. The spring mount 13*d* of the cleaning means holding frame 13 is located in the adjacencies of the photosensitive drum 11, and is 2–5 mm in diameter. It is an integral part of the cleaning means holding frame 13. The hole 26*g* and the spring mount 13*d* are positioned so that the line connecting the hole 26*g* of the development blade metallic plate 26*a* and the spring mount 13*d* of the cleaning means holding frame 13, becomes approximately perpendicular to the line connecting the hole 26*g* and pivotal center (66). The tension spring 36 is hooked to the development blade 26, eliminating the need for providing the developing means holding frame 17 with a spring mounting portion in the form of a shaft, for example, which projects outward from the developing means holding frame 17. Therefore, the developing means holding frame 17 can be simple in the configuration of its end surfaces in terms of the longitudinal direction, which in turn makes it easier to set up a jig for attaching the flexible seal 21 to the developing means holding frame 17, improving assembly efficiency. Further, anchoring the tension spring 36 to the development blade 26 means anchoring the tension spring 36 to a metallic component, which is high in elastic modulus, eliminating the problem that the D pressure is reduced due to the deformation or the like of the spring anchoring portion by the resiliency of the tension spring 36. Incidentally, when providing the spring anchoring portion, for example, a joggle, as an integral part of the developing means holding frame 17, such a spring anchoring portion, must be rendered large enough to prevent the D pressure from being reduced by its deformation. However, in this embodiment, the developing means holding frame 17 does not need to be provided with such a spring anchoring portion, or a joggle, therefore, contributing to a size reduction.

Next, referring to FIG. 23, on the non-driven side of the developing means holding frame 17, the developing means holding frame 17 is provided with a connecting member 17*e*, which projects outward from the developing means holding frame 17, and the axial line of which will align with that of the development roller 18. The developing means holding frame 17 is structured so that this connecting member 17*e* is pressed toward the center of the photosensitive drum 11. The connecting member 17*e* has a bearing, as an integral part of the connecting member, for supporting the non-driven end of the development roller 18.

Next, the structure for maintaining the D pressure on the non-driven side will be described. Referring to FIGS. 7 and 23, to the non-driven end of the developing means holding frame 17, a connecting member 17*e* is fixed, the axial line of which will be in alignment with the axial line of the development roller 18. The developing means holding frame 17 is structured so that this connecting member 17*e* is pressed toward the photosensitive drum 11. The connecting member 17*e* is screwed to the developing means holding frame 17. Referring to FIG. 23, it is inserted into the groove 19*e* (which in this embodiment is an elongated hole, the long axis of which is approximately parallel to the line connecting the axial lines of the development roller 18 and photosensitive drum 11) of the rear end cover 19, being enabled to move in the direction of the line connecting the axial lines of the development roller 18 and photosensitive drum 11. In the groove 19*e*, an elastic member 67 is placed on the side opposite to the photosensitive drum 11, with the connecting member 17*e* fitted in the groove 19*e* on the photosensitive drum 11 side, in a manner to sandwich the connecting member 17*e* and press the connecting member 17*e* by the pressing portion 67*a*. The elastic member 67 is a compression coil spring, the wire diameter of which is approximately 0.5–1.0 mm. The resiliency of this spring generates a pressure D2 which presses the non-driven end of the development roller 18 upon the photosensitive drum 11. In other words, the amount of the pressure D2 is determined by the resiliency of the coil spring alone, and therefore, is stable. This groove 19*e* also functions as a positioning groove, playing a role in regulating the direction in which the development roller 18 moves. As seen from the inward side of the rear end cover 19, the groove 19*e* is narrower on the outward side, preventing the pressing portion 67*a* from dislodging outward from the groove 19*e*.

The flat surface 67*b* of the pressing portion 67*a* is in contact with the elastic member 67. The flat surface 67*b* is perpendicular to the direction in which the elastic member 67 exerts pressure. The surface of the pressing portion 67*a*, which is on the opposite side of the portion of the pressing portion 67*a*, on which the flat surface 67*b* is, is a flat surface, and is in contact with the flat portion 17*e*1 of the connecting member 17*e*. The flat portion 17*e*1 is the location upon which the pressure from the elastic member 67 is exerted.

(Description of Coupling Member)

Next, referring to FIGS. 24–26, the configurations of the coupling members will be described.

Figure 24:
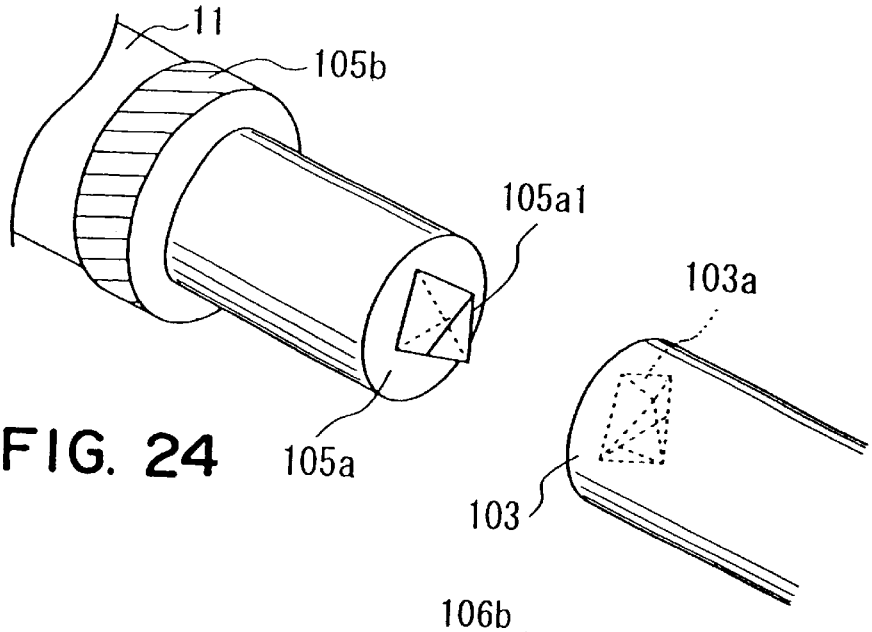
FIG. 24 is a perspective view of the couplings for driving the photosensitive drum.

Referring to FIG. 24, a first coupling 105*a*, that is, a member through which the force for driving the process cartridge 15 is received, has a projection 105*a*1 which is approximately triangular in cross section. More specifically, the projection 105*a*1 is in the form of a triangular pillar twisted about its axial line in the direction in which it is rotated. A first coupling 103, that is, the coupling on the apparatus-main-assembly side, has a hole 103*a* which is approximately triangular in cross section, and is twisted about its axial line in the direction in which the first coupling 103 is rotated, With the provision of the above-described structural arrangement, as the first coupling 103 on the apparatus main assembly side is rotated after the first coupling 105*a* on the process-cartridge side and first coupling 103 on the apparatus main assembly] apparatus-main-assembly side are engaged, the two couplings 103 and 105*a* rotate in such a manner that the edges of the projection 105*a*1 simultaneously make contact with the corresponding walls of the hole 103*a*. As a result, the axial lines of the first coupling 103 on the apparatus-main-assembly side and first coupling 105*a* on the process-cartridge side become aligned, and therefore, the driving force is smoothly transmitted.

As described above, the first coupling 105*a* and main assembly first coupling 103 are a projection and hole, respectively, which are in the form of a twisted triangular pillar, and therefore, as they rotate in engagement with each other, thrust is generated in a direction to pull them toward each other in their axial directions.

Figure 25:
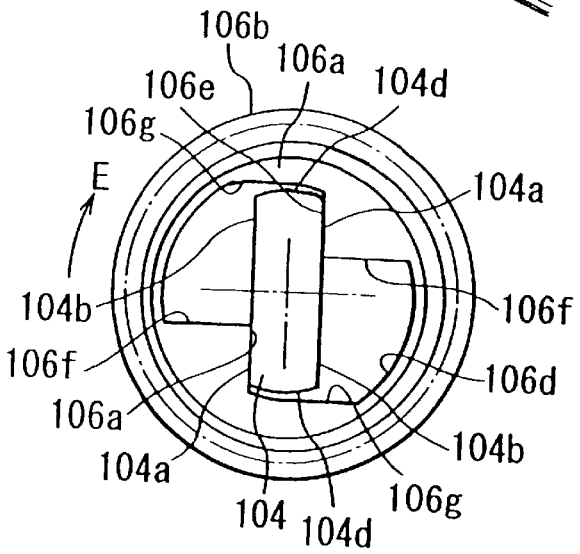
FIG. 25 is a rear view of the couplings for driving stirring members.
Figure 26:
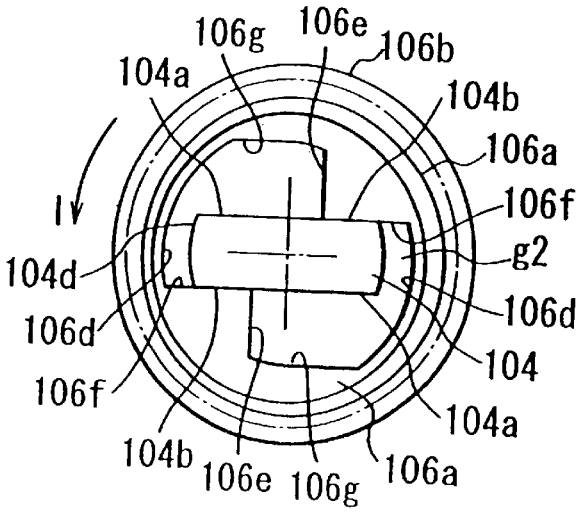
FIG. 26 is a rear view of the couplings for driving stirring members.

Referring to FIGS. 25 and 26, a second coupling 104 on the main assembly side of the image forming apparatus has a portion with two parallel flat surfaces formed by flattening the cylindrical portion, and one flat surface has a pair of contact areas 104*a*, and the other flat surface has a pair of contact areas 104*b*. In other words, both ends of each flat surface, in terms of the direction perpendicular to the longitudinal direction, constitute the contact area. On the other hand, each end of the portion with the two parallel flat surfaces has two different contact areas: contact area 104*a* and contact area 104*b*. The second coupling 106*a* on the process-cartridge side has a hole 106*d*, in which a pair of triangular ribs are placed on the wall of the hole in such a manner that the pair of triangular ribs become symmetrical with respect to the axial line of the hole 106*d* and extend in the axial direction of the hole 106*d*. The side surfaces of each rib are perpendicular to each other and have contact areas 106*e* and 106*f*, respectively.

Referring to FIG. 25, as the second coupling 104 on the main-assembly side is rotated in the direction indicated by an arrow mark E, that is, the direction in which the developer seal 24 is opened by an unshown automatic seal opening mechanism, the contact area 104*a* of the second coupling 104 on the main-assembly side contacts the contact area 106*e* of the triangular rib of the second coupling 106*a* on the process-cartridge side, and transmits a driving force to the second coupling 106*a* on the process-cartridge side.

In order to reduce the gaps g1 between the peripheral surface 104*d* of the second coupling 104 on the main-assembly side, and the wall of the hole 106*d* of the second coupling 106*a* on the process-cartridge side, the wall of the hole 106*d* is modified in shape to change the distance between the opposing two points on the wall, with respect to the axial line of the hole 106*d*, providing the wall of the hole 106*d* with a pair of surfaces 106*g* approximately parallel to the side surfaces 106*f*.

The peripheral surface of the second coupling 104 on the main-assembly side has a cylindrical curvature, and the axial line of this curvature coincides with the rotational axis of the coupling 104 on the main-assembly side. Referring to FIG. 26, as the driving for opening the developer seal 24 is completed, the second coupling 104 on the main-assembly side rotates in reverse. As a result, the contact areas 104*b* of the second coupling 104 on the main-assembly side come into contact with the contact areas 106*f* of the second coupling 106*a* on the process-cartridge side, and drive the second coupling 106*a* on the process-cartridge side, transmitting a driving force to the toner stirring members 113, 114, and 123, and the like. During this period, the gap g2 is maintained between the second coupling 104 on the main-assembly side and the second coupling 106*a* on the process-cartridge side, in terms of their radius directions. In this embodiment, the size of the gap g2 is approximately 2 mm.

With the provision of the above-described structural arrangement, while the developer seal 24 is opened, the photosensitive drum 11 is not driven, and the second coupling 104 on the main-assembly side and the second coupling 106*a* on the process-cartridge side are aligned with each other. Then, after the opening of the developer seal 24, in other words, during image formation, the first coupling 105*a* attached to the photosensitive drum 11, and the first coupling 103 on the main-assembly side, remain aligned with each other. During this period, if the second coupling 106*a* on the process-cartridge side and the second coupling 104 on the main-assembly side, which transmit a driving force to the toner stirring members 113, 114, and 123, and the like, happen to become misaligned, they do not become aligned any more, that is, they remain misaligned, but continue to transmit a driving force. In other words, the second coupling 106*a* on the process-cartridge side and the second coupling 104 on the main-assembly side are structured not to interfere with the alignment between the first coupling 103 on the main-assembly side and the first coupling 105*a* on the process-cartridge side.

(Description of Driving System)

Figure 27:
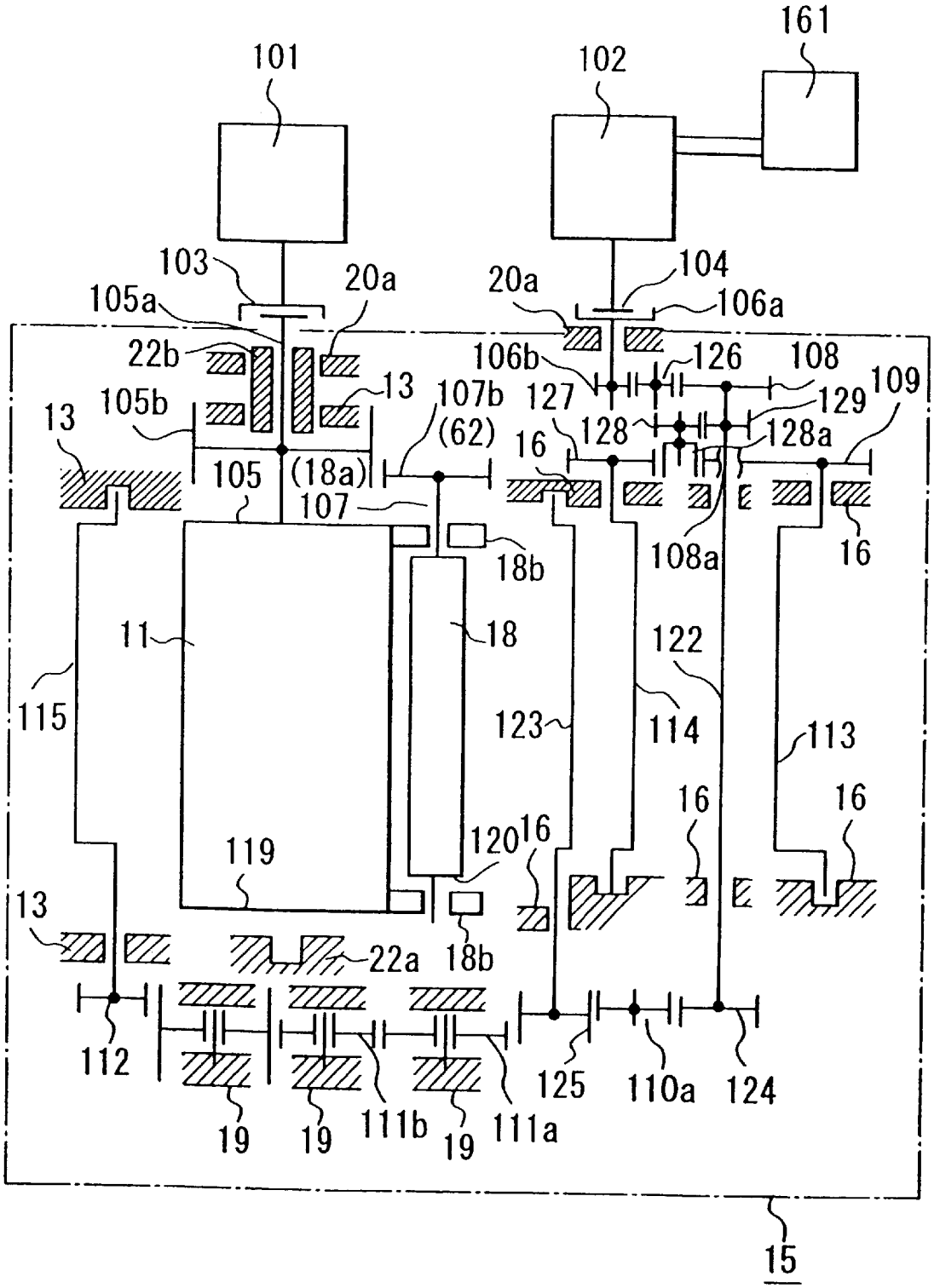
FIG. 27 is a diagram of the system for driving the process cartridge.

FIG. 27 is a system diagram of the drive train in this embodiment. The reference codes used in this diagram are used only in this diagram. For example, the development sleeve gear 107*b* in this diagram corresponds to the development roller gear 62 (FIGS. 7 and 20) in the actual structure.

Driving force sources 101 and 102, for example, motors, provided on the apparatus main assembly 27 side to drive the process cartridge 15 have couplings 103 and 104, respectively. With the process cartridge 15 mounted in the apparatus main assembly 27, the couplings 103 and 104, and power sources 101 and 102 are in connection with the couplings 105*a* and 106*a* which rotate with the input gears 105*b* and 106*b*, respectively, on the process-cartridge side. The coupling 106*a* is supported by a bearing. The coupling 105*a* and gear 105*b* are integral parts of a gear flange 105, and are supported by the cleaning means holding frame 13, with the interposition of the bearing 22*b*. Since the system for driving the toner stirring members is provided with the driving force source 102 independent from the driving force source 101 for driving the photosensitive drum 11, the rotational velocity of the motor 102 can be varied with the provision of a controlling apparatus 161 to vary the velocity at which the toner stirring member driving system is driven.

The controlling apparatus 161 is enabled to turn on or off the driving force source 102, or vary the driving speed, according to such factors as the cumulative number of copies the process cartridge 15 has produced, the amount of the toner within the process cartridge 15, the torque necessary for driving the stirring members of the process cartridge 15, and the like, that reflect the condition of the process cartridge 15.

With the provision of the driving force source 102 independent from the driving force source 101 for the photosensitive drum 11, even when the speeds of the photosensitive drum 11 and development roller 18 in the apparatus main assembly 27, which are enabled to print at high speed, are increased, the stirring speed can be kept unchanged by keeping the driving speed of the driving force source 102 unchanged, in other words, by setting the driving speed of the driving force source 102 independent from the driving force source 101 for driving the photosensitive drum 11 and the development roller 18. The driving force source 102 may be eliminated. In such a case, the force for driving the stirring system is drawn from the driving force source 101 with the interposition of a speed varying apparatus between the stirring system and the driving force source 101, so that an optimum speed can be set for the stirring system by varying the driving speed at which the stirring system is driven by the driving force source 101 in accordance with the operational mode of the apparatus main assembly 27.

Next, the driving system on the process-cartridge side will be described.

The photosensitive drum 11 and development roller 18, which are directly involved in the development of an electrostatic latent image, are provided with gear flanges 105 and 107, which are fixed to the ends of the photosensitive drum 11 and the development roller 18, respectively. The gear flanges 105 and 107 comprise gears 105*b* and 107*b*, which are integrally formed with the gear flanges 105 and 107, respectively. To the other ends of the photosensitive drum 11 and the development roller 18, bearing flanges 119 and 120 are fixed. The photosensitive drum 11, the gear flange 105, and the bearing flange 119 together constitute a photosensitive drum unit, and the development roller 18, the gear flange 107, and the bearing flange together constitute a development roller unit. The gear 105*b* and the sleeve gear 107*b* are meshed with each other.

As the coupling 103 is rotated by the driving force source 101 on the apparatus main assembly 27 side, the photosensitive drum 11 and the development roller 18 rotate. The photosensitive drum unit is rotationally supported by the bearing members 22*a* and 22*b*. The development roller 18, which is fitted with the pair of spacer rings 18*b* which are larger in external diameter than the development roller 18 and are coaxial with the development roller 18, rotate while pressing the spacer rings 18*b* upon the peripheral surface of the photosensitive drum 11. Therefore, the photosensitive drum 11 and development roller 18 rotate while maintaining an optimum gap between their peripheral surfaces. The bearing members 22*a* and 22*b* are walls themselves of the holes provided in the walls of the cleaning means holding frame 13 of the process cartridge 15, or members (FIG. 7) fixed to the cleaning means holding frame 13. In the bearing members 22*a* and 22*b*, the journal portions of the flanges 105 and 119 fit, respectively.

In the drive trains for the stirring system, the driving force is transmitted to an idler gear 108 meshed with an idler gear 126, which is meshed with an input gear 106*b*, and then, is transmitted to an idler gear 129 fixed to a shaft 108*a* to which the idler gear 108 is fixed. Then, it is transmitted to an idler gear 128 meshed with an idler gear 129. The idler gear 128 is a step gear, the small diameter portion 128*a* of which is meshed with the stirring gears 109 and 127 to transmit the driving force to the stirring members 113 and 114. The axial line of the input gear 106*b* does not need to be in alignment with the axial line of the stirring member 114, and therefore, the range in which the input gear 106*b* must be positioned is relatively wide. The aforementioned gears in the process cartridge 15 are all rotationally supported by the frame of the process cartridge 15.

The shaft 108*a* of the idler gear 108 is integral with a driving force transmitting rod 122, or connected thereto in alignment therewith. The driving force transmitting rod 122 is connected to an idler gear 124, on the opposite side of the process cartridge 15 in terms of the longitudinal direction, and transmits the driving force to the stirring member 123 through a stirring gear 125 meshed with an idler gear 110*a*. The driving force transmitting rod 122, and stirring members 113, 114, and 123, are rotationally supported by the developer holding frame 16.

Thus, as the input gear 106*b* rotates, the stirring members 114, 113, and 123, and the driving force transmitting rod 122, also rotate because the journal portions of those components are rotationally supported by the bearings with which the developer holding frame 16 is provided.

Referring to FIG. 24, the projection 105*a*1, in the form of a twisted triangular pillar, of the coupling 103 of the drum flange 105 engages into the hole 103*a*, in the form of a twisted triangular pillar, on the apparatus main assembly 27 side, and as the coupling 103 is driven, thrust is generated in a direction to pull the projection 105*a*1 into the hole 103*a*, and the couplings 103 and 105*a* are aligned with each other. Thus, as the coupling 103 is driven, the position of the process cartridge 15 relative to the apparatus main assembly 27 in terms of the longitudinal direction is determined. The projection of the coupling 104 and the hole of the coupling 106*a* are constructed to provide a certain amount of gap between the projection and the wall of the hole in terms of their radius directions, to afford a certain amount of misalignment between the coupling 104 and the coupling 106*a*. Therefore, the engagement between the coupling 104 and the coupling 106*a* does not affect the positioning of the first coupling 105*a* on the drum-flange side (FIGS. 25 and 26). In order to control the rotation of the process cartridge 15, the second guide portion 20*g* of the front end cover 20 is provided with a projection (which will be described later), the position of which is fixed by the apparatus main assembly 27. In other words, the couplings on the side where the driving force is transmitted to the photosensitive drum 11 for latent image formation, and the development roller 18 for latent image development, which directly affect image formation, are precisely structured so that the process cartridge 15, more specifically, the photosensitive drum 11 and the development roller 18, is accurately positioned relative to the apparatus main assembly 27 by the aligning functions of the couplings. However, the couplings on the side where the driving force is transmitted to the stirring system, are roughly structured so that they engage for the sole purpose of transmitting the driving force.

Within the cleaning means holding frame 13, which doubles as the removed toner bin 5, the feather-like removed toner moving member 115 for conveying the toner removed from the photosensitive drum 11 is placed. The removed toner moving member 115 is rotationally supported by the cleaning means holding frame 13; the shaft of the removed toner moving member 115 is supported by the bearings with which the cleaning means holding frame 13 is provided. To one end of the removed toner moving member 115, a power input gear 112 is fixed, which is connected to the gear 124 through idler gears 111*c*, 111*b*, 111*a*, 125, and 110*a*. To the end of the driving power transmitting rod 122, on the side opposite to the end to which the gear 108, or an power input gear, is fixed, in other words, on the non-driven side, the gear 124, or a power output gear, is fixed. The idler gears 111*a*, 111*b*, and 111*c* are rotationally supported by the rear end cover 19; their shafts are supported by the bearings with which the rear end cover 19 is provided. As the driving force transmitting rod 122 rotates, the removed toner moving member 115 is rotated by the rotation of the driving force transmitting rod 122. The shafts which support idler gears 111*a*, 111*b*, and 111*c*, one for one, are non-rotational shafts and are integrally formed parts of the rear end cover 19.

The idler gear 111*c* may be replaced with a step gear so that the large diameter portion of the step gear is meshed with the idler gear 111*b*, and the small diameter portion of the step gear is meshed with the removed toner moving member 112.

As described above, the process cartridge 15 essentially comprises two drive trains: the drive train for driving the photosensitive drum 11 and development roller 18, and the drive train for driving the stirring member, and removed toner moving member. The two drive trains are independently driven by the driving force sources on the apparatus main assembly 27 side.

The drive trains may be structured so that the removed toner moving member 115 is driven by the driving force transmitted from the opposite side of the toner container 16, that is, the side opposite to the side from which the driving force is transmitted to the stirring members 113 or 114, or by the driving force transmitted from any of the power input gears 109 and 127, and idler gears 108 and 128, with the interposition of a dedicated gear train.

(Structure of Cooling Air Passage)

Figure 28:
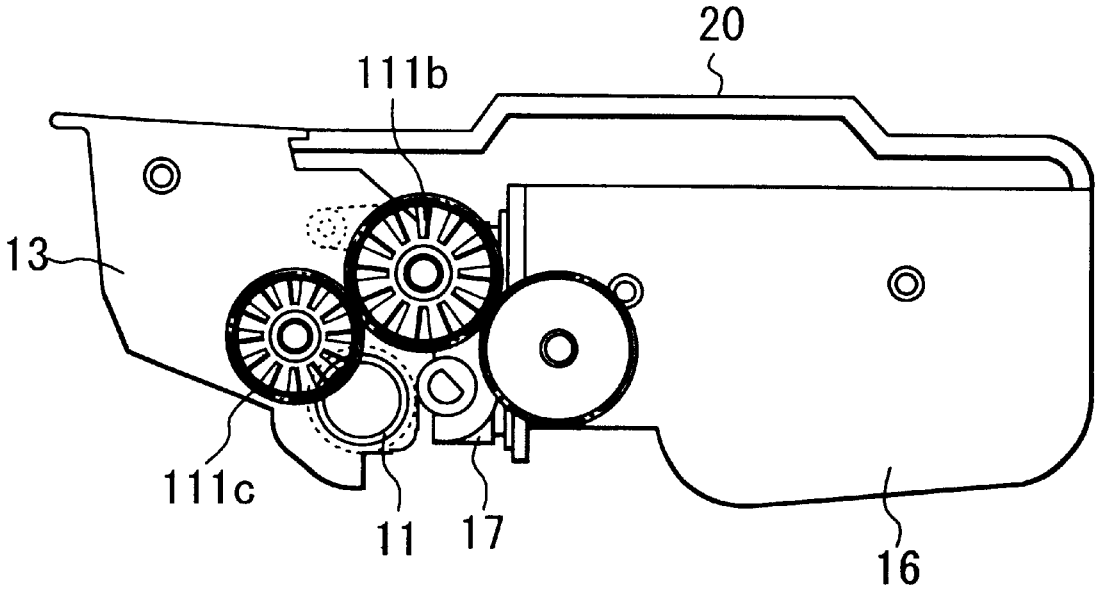
FIG. 28 is a front view of a cooling means of the process cartridge.
Figure 29:
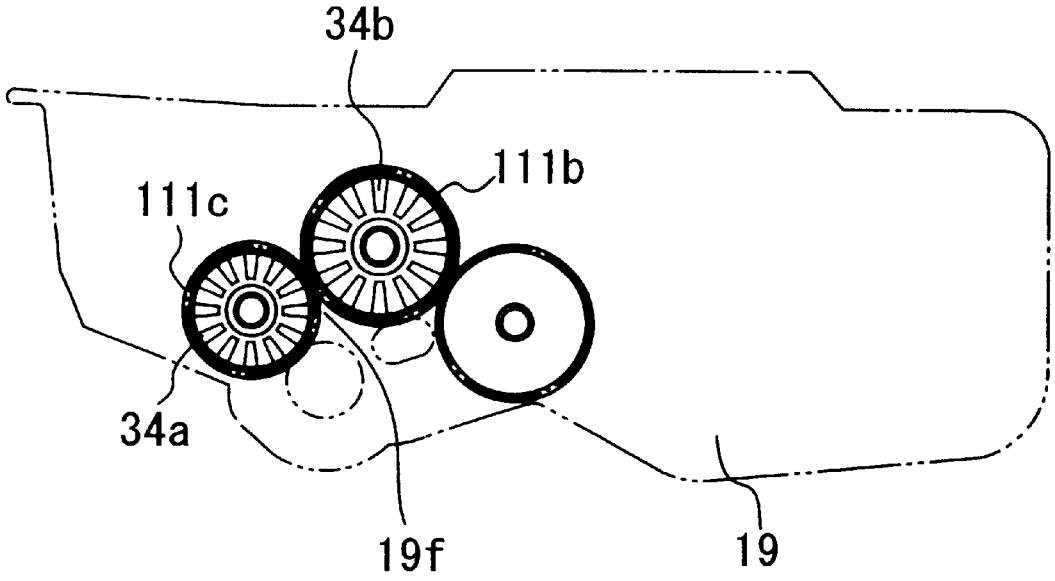
FIG. 29 is a front view of the cooling means of the process cartridge.

FIGS. 28 and 29 are drawings of a typical gear train positioned in the adjacencies of the photosensitive drum 11. FIG. 28 is a side view of the process cartridge 15 with the side cover removed, whereas FIG. 29 is a side view of the process cartridge 15 with the contour of the side cover indicated by a double-dot chain line. Within the cleaning means holding frame 13, the removed toner moving member 115 for conveying the recovered removed toner, inward of the removed toner bin 5, is placed. In order for the removed toner moving member 115 to be driven by the photosensitive drum 11, the driving speed must be drastically reduced sometimes. However, when a structural arrangement is made so that the removed toner moving member 115 is driven by the toner stirring member 114 within the developer holding frame 16, the drastic speed reduction is unnecessary, making it easier to provide the removed toner moving member 115 with a proper driving speed. In such a case, the gears 111*b* and 111*c* are positioned in the adjacencies of the photosensitive drum 11 and outside the developer holding frame 16 and the developing means holding frame 17 (FIG. 28).

In this embodiment, in order to prevent a temperature increase in the adjacencies of the photosensitive drum 11, the rear end cover 19 is provided with an air passage 19*f* (FIG. 19), which is located in the adjacencies of the photosensitive drum 11. However, the air passage 19*f* for cooling the interior of the process cartridge 15 is blocked by the gears 111*b* and 111*c* of the gear train. Thus, the gears 111*b* and 111*c* are provided with slits 34*a* and 34*b*, which are cut in a manner to constitute an axial flow fan to forcefully take in or exhaust air through the air passage 19*f*.

Figure 30:
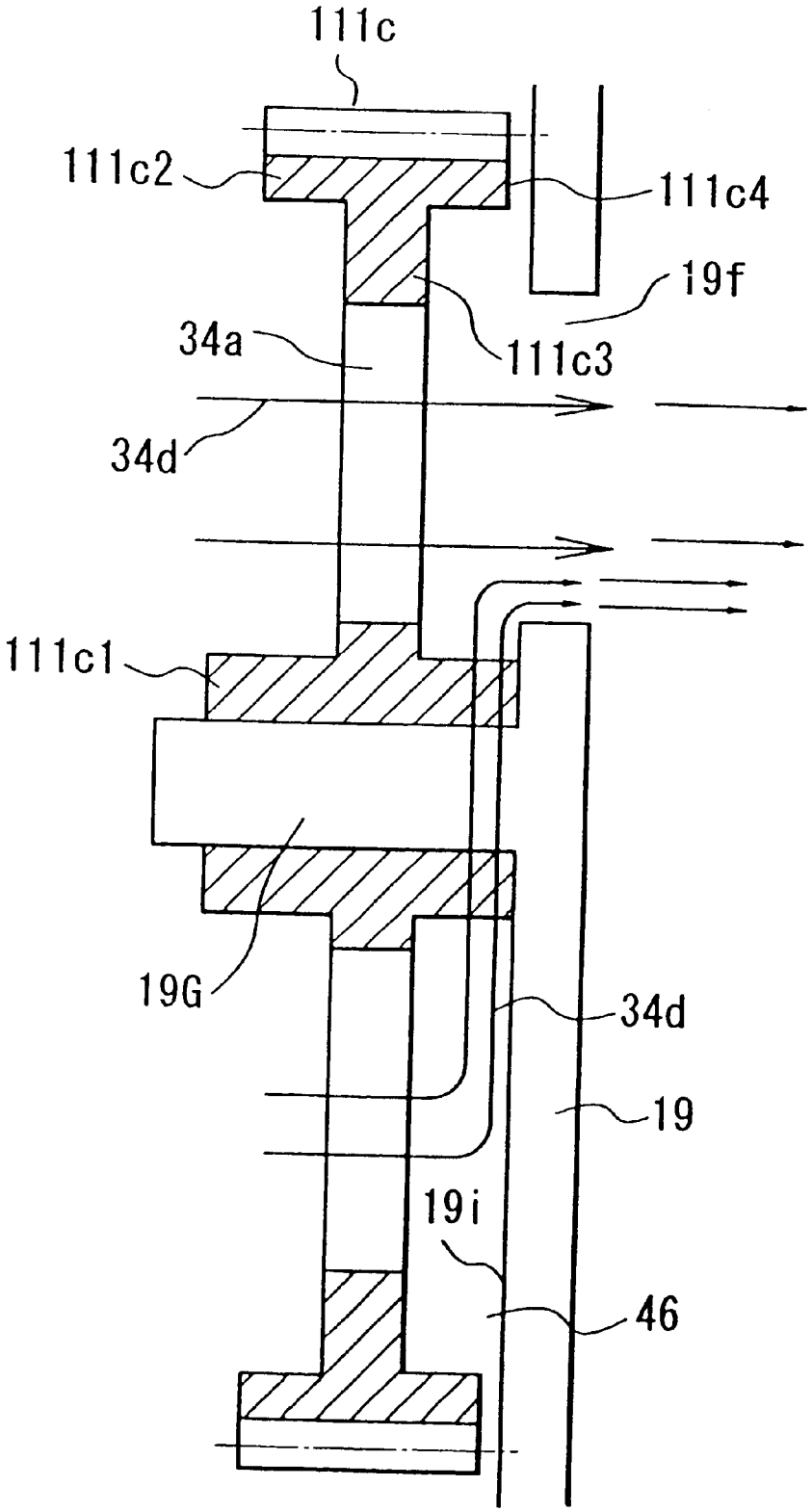
FIG. 30 is a sectional view of a gear with an impeller at a plane A—A in FIG. 31.
Figure 31:
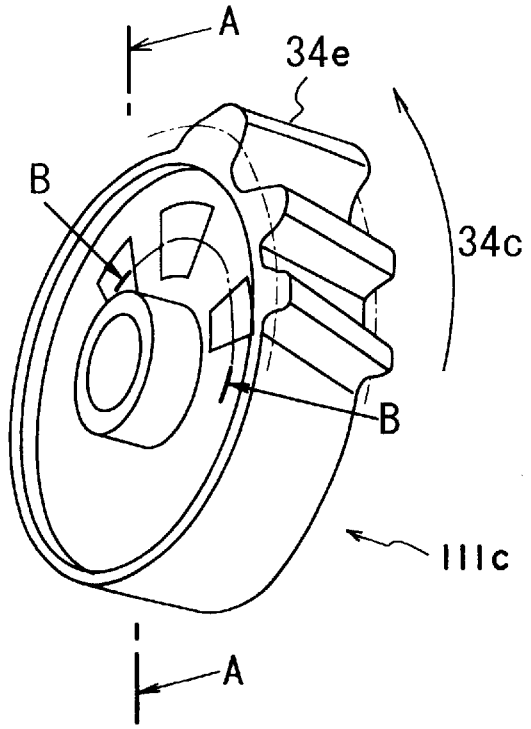
FIG. 31 is a perspective view of the gear with an impeller.
Figure 32:
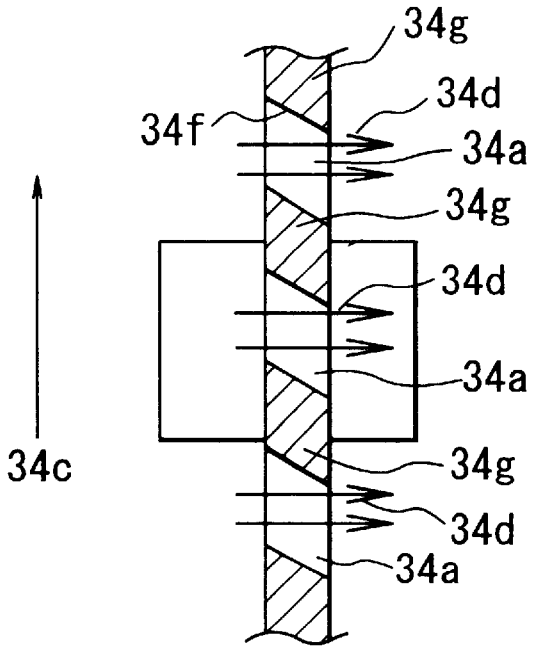
FIG. 32 is a perspective view of the gear with an impeller at a plane B—B in FIG. 31.
Figure 33:
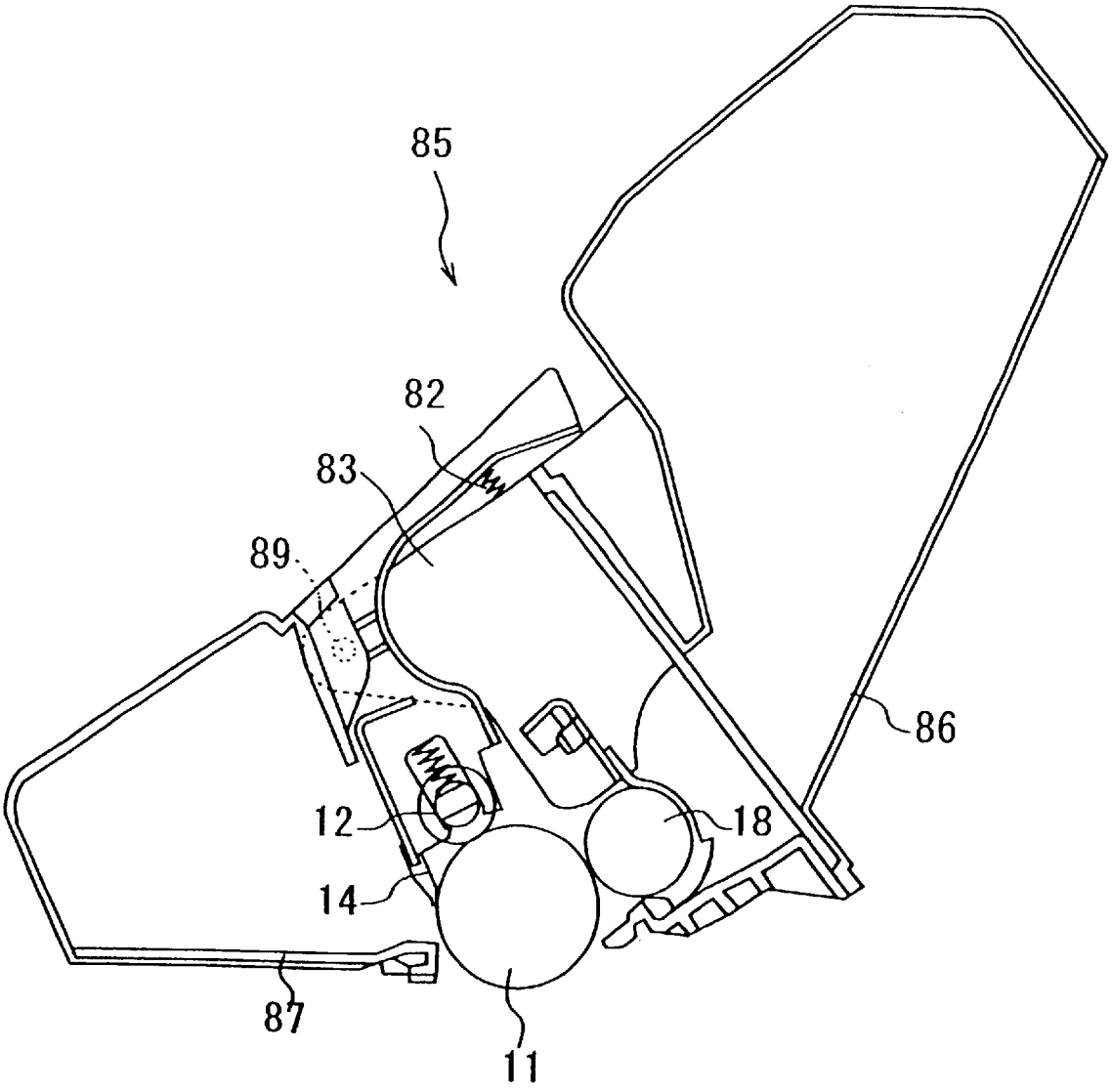
FIG. 33 PRIOR ART
FIG. 33 is a vertical sectional view of an example of a conventional process cartridge.

Next, referring to FIGS. 30, 31, and 32, the structure of the cooling air passage will be described. FIG. 31 is a perspective view of the gear 111*c*. The gear 111*b* is the same as the gear 111*c* except that they are different in both the direction in which the teeth are twisted and the direction in which the air passage is twisted. Therefore, the structure of the cooling air passage will be described with reference to only the gear 111*c*. FIG. 32 is a development of the gear 111*c* at a plane B—B in FIG. 31, and FIG. 30 is a sectional view of the gear 111*c* at a plane A—A in FIG. 31.

The gear 111*c* is a helical gear comprising a rim 111*c*2, a boss 111*c*1, and a disk-shaped hub 111*c*3. The hub 111*c*3 has a plurality of slits 34*a*, which radially extend, being evenly distributed in terms of the circumferential direction. There is a gap between the surface of the hub 111*c*3 and the inward surface 19*i* of the rear end cover 19. Thus, the air passage 19*f* of the rear end cover 19, which connects the inward and outward sides of the rear end cover 19, is connected to the slits 34*a* through a space 46. The gear 111*c* is rotationally supported by the shaft 19G, which projects inward from the inward surface of the rear end cover 19 in the longitudinal direction and is put through the central hole of the boss 111*c*1. The shaft 19G is fitted with an unshown stopper ring to prevent the gear 111*c* from shifting in the axial direction of the shaft 19G. The lateral surface 111*c*4 of the rim 111*c*2 is positioned as close as possible to the inward surface 19*i* of the rear end cover 19 to make as small as possible the amount of the air which passes between the surfaces 19*i* and 111*c*4. Incidentally, in order to make as small as possible the amount of the air which passes between the surfaces 19*i* and 111*c*4, these surfaces may be intricately configured in a manner to form a labyrinth.

The slits 34*a* are positioned so that they align with the air passage 19*f* in terms of the radius direction of the gear 111*c*.

Referring to FIG. 32, the portion of the hub 111*c*3, between the adjacent two slits 34*a*, constitutes a helical fan blade 34*g*. In order to improve the air blowing efficiency of the gear 111*c*, each slit 34*a* is desired to be aerodynamically shaped to give the helical fan blade 34*g* the aerodynamic shape of the fan blade of an axial flow fan. However, since the rotational velocity of the gear 111*c* is rather slow, the blade 34*g* may be simply tilted. As the slits 34*a* are cut in the hub 111*c*3 as described above, an impeller is formed inside the rim 111*c*2 in terms of the radial direction of the rim 111*c*2.

Referring to FIGS. 31 and 32, as the gear 111*c* rotates in the direction indicated by an arrow mark 34*c*, air flows in the axial direction and enters the space as indicated by an arrow mark 34*d* in FIG. 30. Then, the air flows from the space 46 toward the air passage 19*f*, and is exhausted from the process cartridge 15 through the air passage 19*f* of the rear end cover 19.

Since the space 46 is located so that it faces all the slits 34*a* at the same time regardless of their rotational positions, all fan blades 34*g* contribute to the generation of air flow.

If the direction in which the surface 34*f* of each fan blade 34*g* is tilted is reversed, the direction of the air flow is reversed to send the ambient air of the image forming apparatus into the process cartridge 15, even if the rotational direction of the gear 111*c* is kept the same. The fan blade 34*g* is tilted in the direction most effective for cooling, in consideration of the component positioning, and the overall structure of the air passage.

Matching the direction in which each tooth 34*e* of the helical gear 111*c* is twisted to the direction in which the surface 34*f* of each fan blade 34*g* is twisted makes the same the directions in which air flow is generated in the axial direction of the gear 111*c* by the helical teeth portion and axial fan portion of the gear 111*c*, and is advantageous when constructing a mold for forming the gear 111*c* using resin. When making a structural arrangement so that the teeth 34*e* and fan blades 34*g* of the gear 111*c* send air in the same direction in terms of the axial direction of the gear 111*c*, a gap should be provided between the lateral surface of the rim 111*c*2 and the inward surface of the rear end cover 19 to allow air to flow through, and a cover which follows the peripheral surfaces of the gear 111*c*, except for the area across which the gear 111*c* meshes with its counterpart, should be provided as if providing an air blower with casing.

Since an impeller is provided as a part of the gear 111*c* by cutting the plurality of slits 34*a* in a manner to form the plurality of fan blades 34*g* with the tilted surface 34*f* as described above, and the gears 111*b* and 111*c* rotate when forming images, the internal air of the process cartridge 15, in particular, the air in the adjacencies of the charging portion and cleaning blade, which increases in temperature, is exhausted without becoming stagnant, and also the heat generated by the fixing apparatus or the like is removed. Incidentally, the image forming apparatus main assembly 27 is provided with ventilating means (unshown), for example, air vents through which the internal air of the apparatus main assembly 27 is replaced with the ambient air, naturally, or forcefully with the use of a fan.

(Structure of Developing Means Holding Frame)

Figure 9:
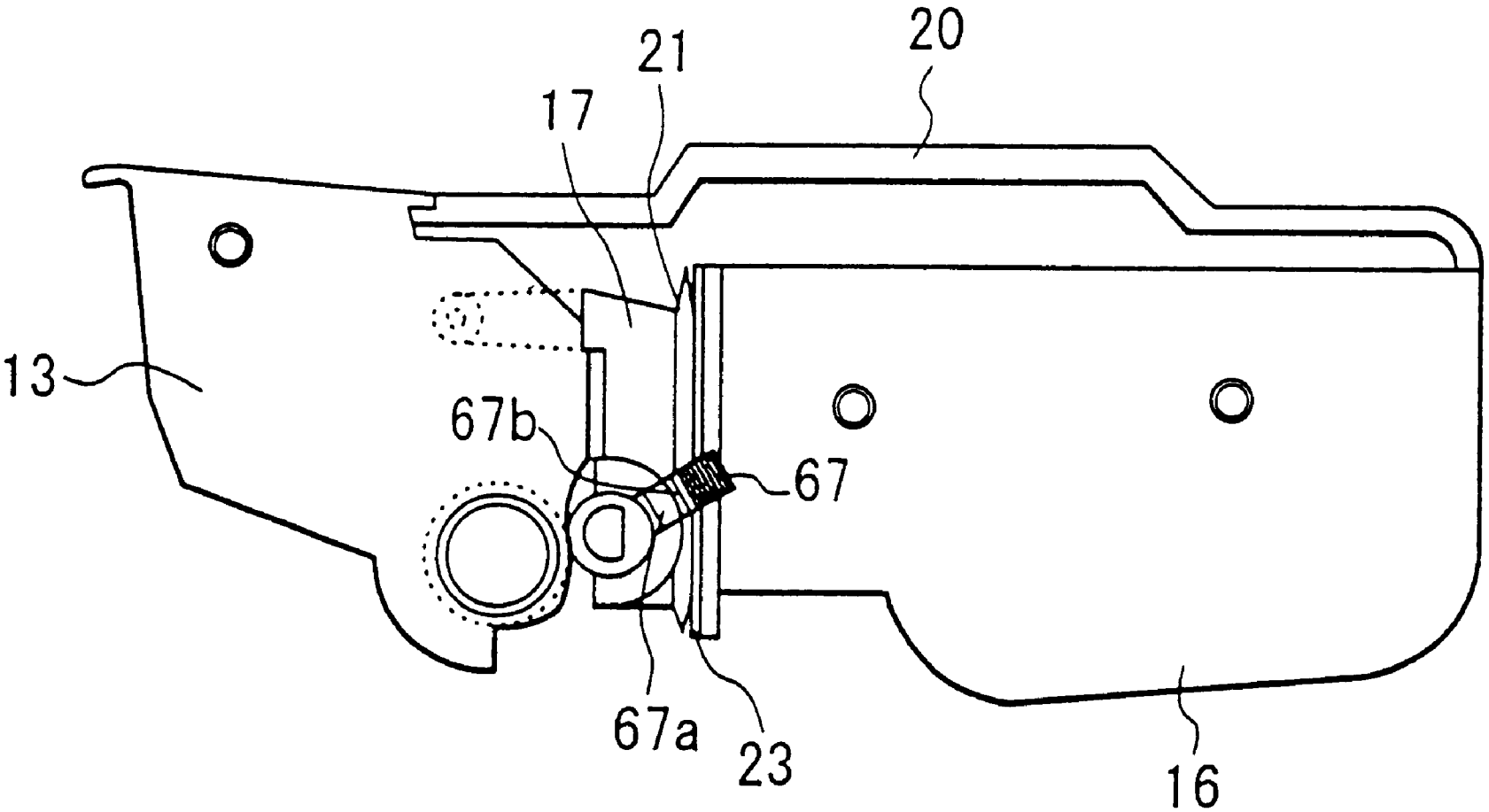
FIG. 9 is a rough front view of the process cartridge, with the side cover removed.
Figure 34:
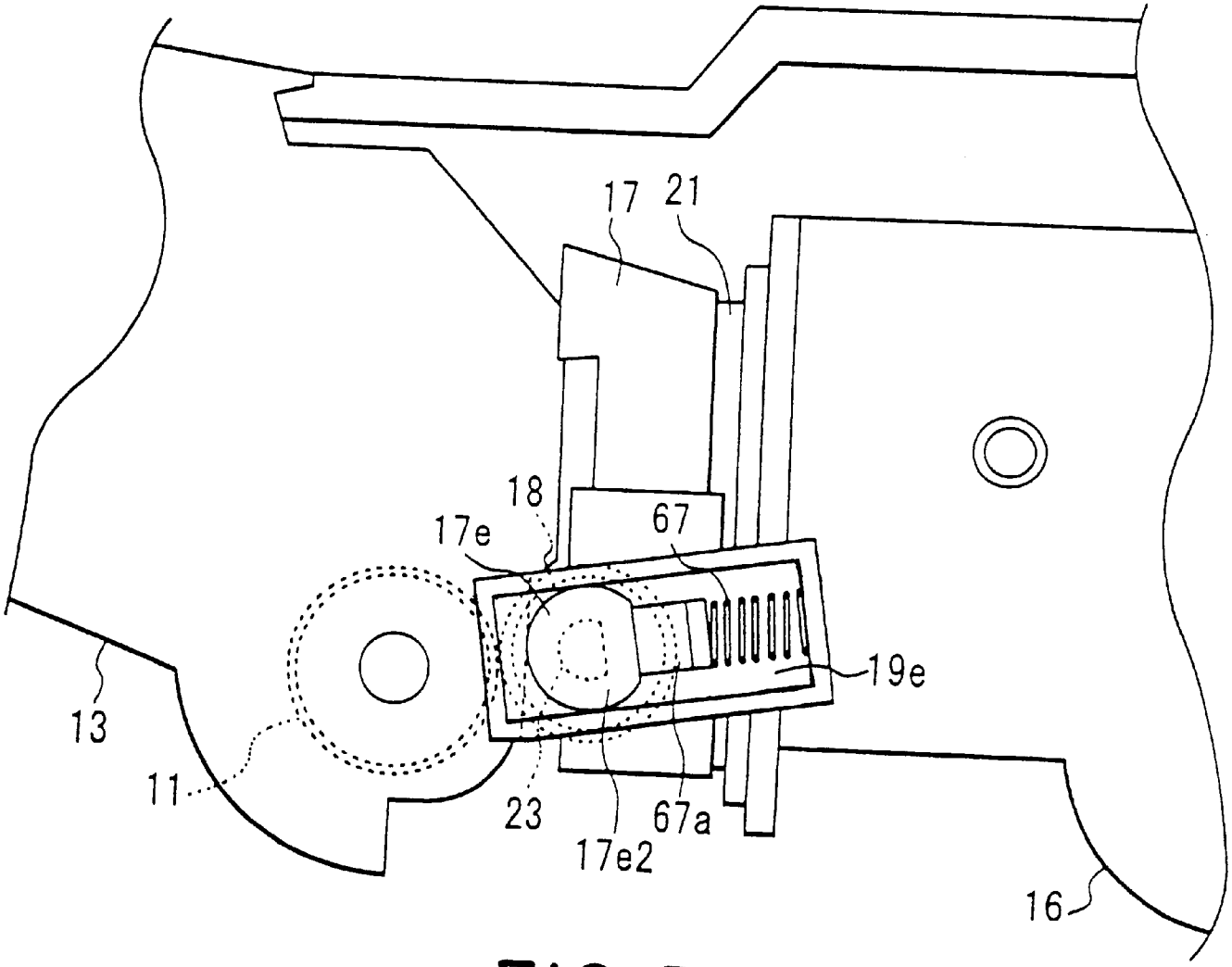
FIG. 34 is a front view of a portion of the process cartridge, with the side cover removed.
Figure 35:
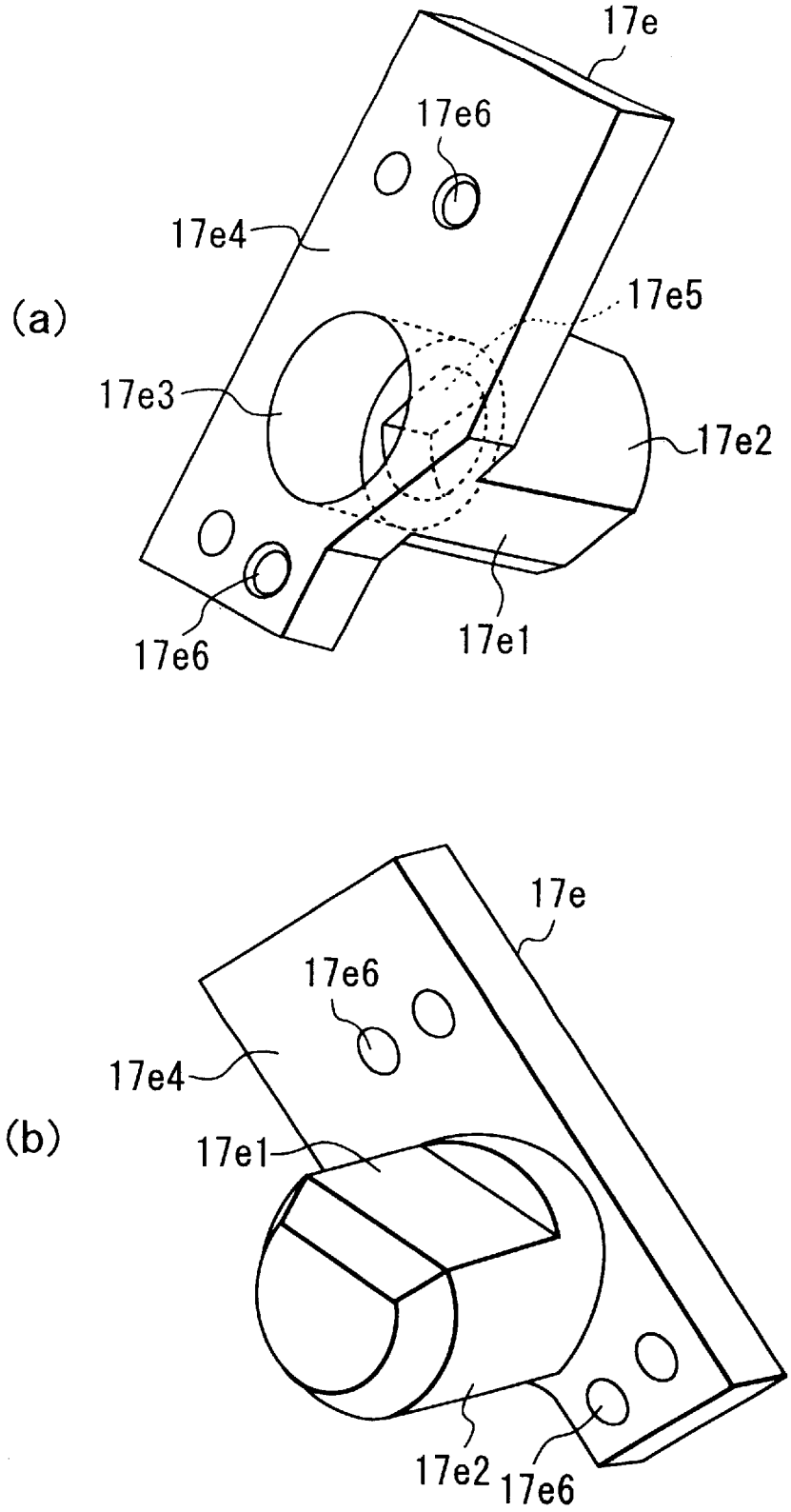
FIG. 35(*a*) is a perspective rear view of a connecting member, and FIG. 35(*b*) is a perspective front view of the connecting member.
Figure 36:
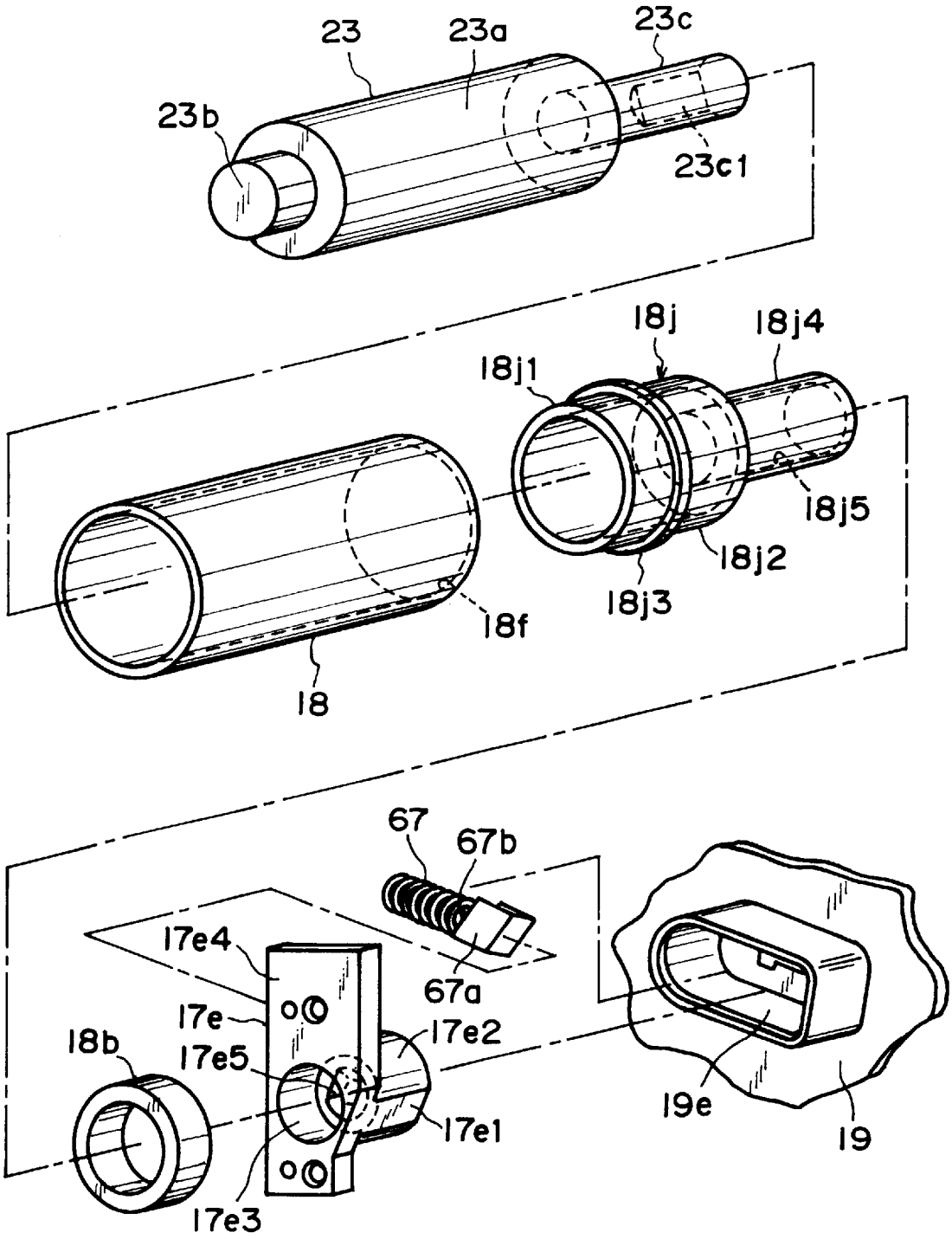
FIG. 36 is an exploded perspective view of the development roller, the development roller bearing, and components adjacent thereto, of the process cartridge.

Next, referring to FIGS. 7, 9, and 34–38, the structure of the developing means holding frame 17 will be described. FIG. 9 is a side view of the process cartridge 15 on the front end cover 20 side, with the front end cover 20 removed. FIG. 34 is a side view of the process cartridge 15 on the rear end cover 19 side, with the rear end cover 19 removed except for a certain portion. FIG. 36 is an exploded perspective drawing for showing how the end of the developing means holding frame 17, on the rear end cover side, is positioned relative to the rear end cover 19.

The development-roller unit comprising the development roller 18 and the cylindrical magnet 23 placed within the development roller 18 is rotationally supported by the developing means holding frame 17, with the interposition of the pair of connecting members 17*e* which double as development-roller bearings. The connecting members 17*e* are secured to the developing means holding frame 17 with the use of the small screws 41 (FIG. 23), being accurately positioned relative to the developing means holding frame 17. In addition, the development blade 26 and the unshown magnetic seal are attached to the developing means holding frame 17.

One end of the magnet 23 is rotationally supported by the internal surface of the development roller 18, and the other end is non-rotationally supported by the connecting member 17*e* which doubles as a development-roller bearing, holding a predetermined gap between itself and the development roller 18. Electric power is transmitted to the development roller 18 through an unshown electrical contact provided within the development roller 18. Around the development roller 18, the pair of spacer rings 18*b* are fitted (FIG. 37) to keep constant the gap between the peripheral surfaces of the development roller 18 and photosensitive drum 11.

(Structure for Supporting Development Roller and Magnet)

Figure 37:
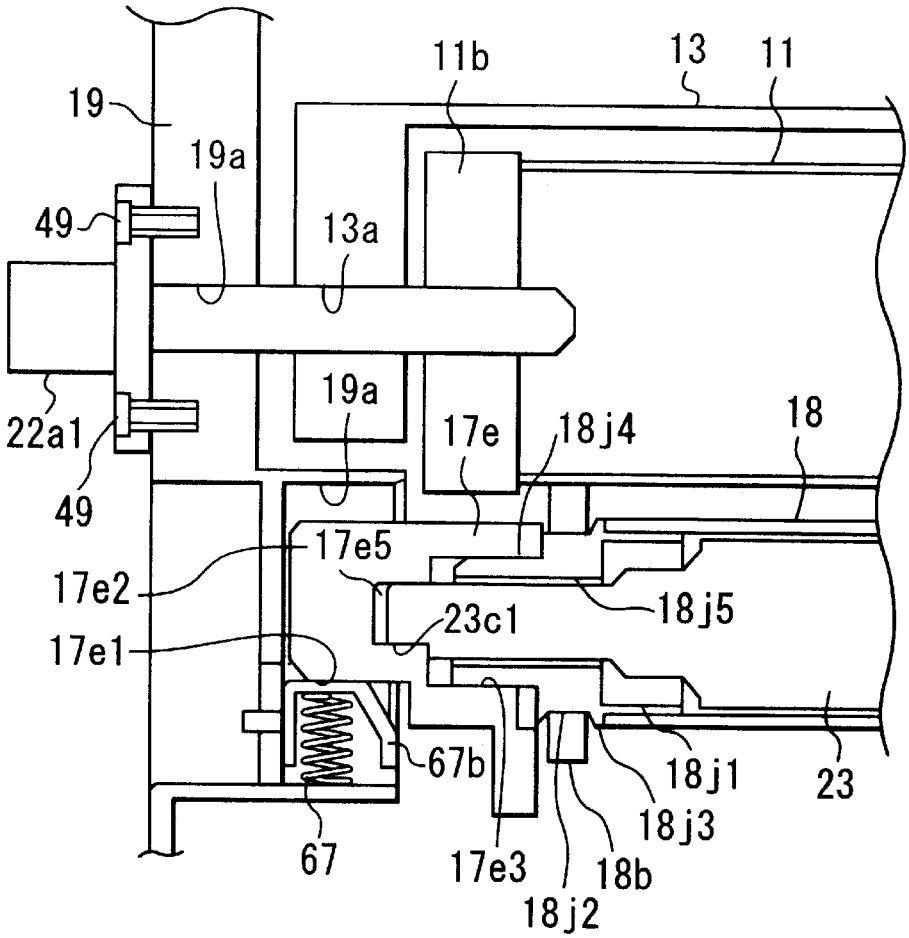
FIG. 37 is a sectional view of the structure for supporting the development roller and the photosensitive drum, at one of the longitudinal ends of the process cartridge.
Figure 38:
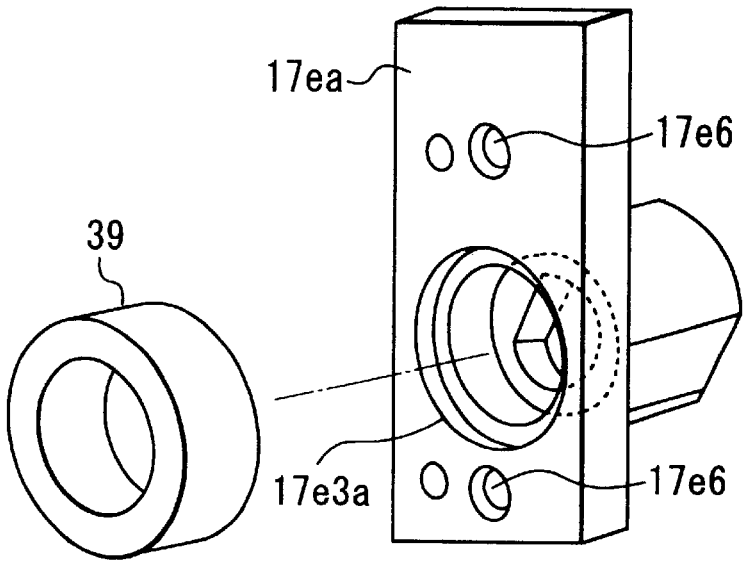
FIG. 38 is a perspective view of the connecting member in another embodiment of the present invention.
Figure 39:
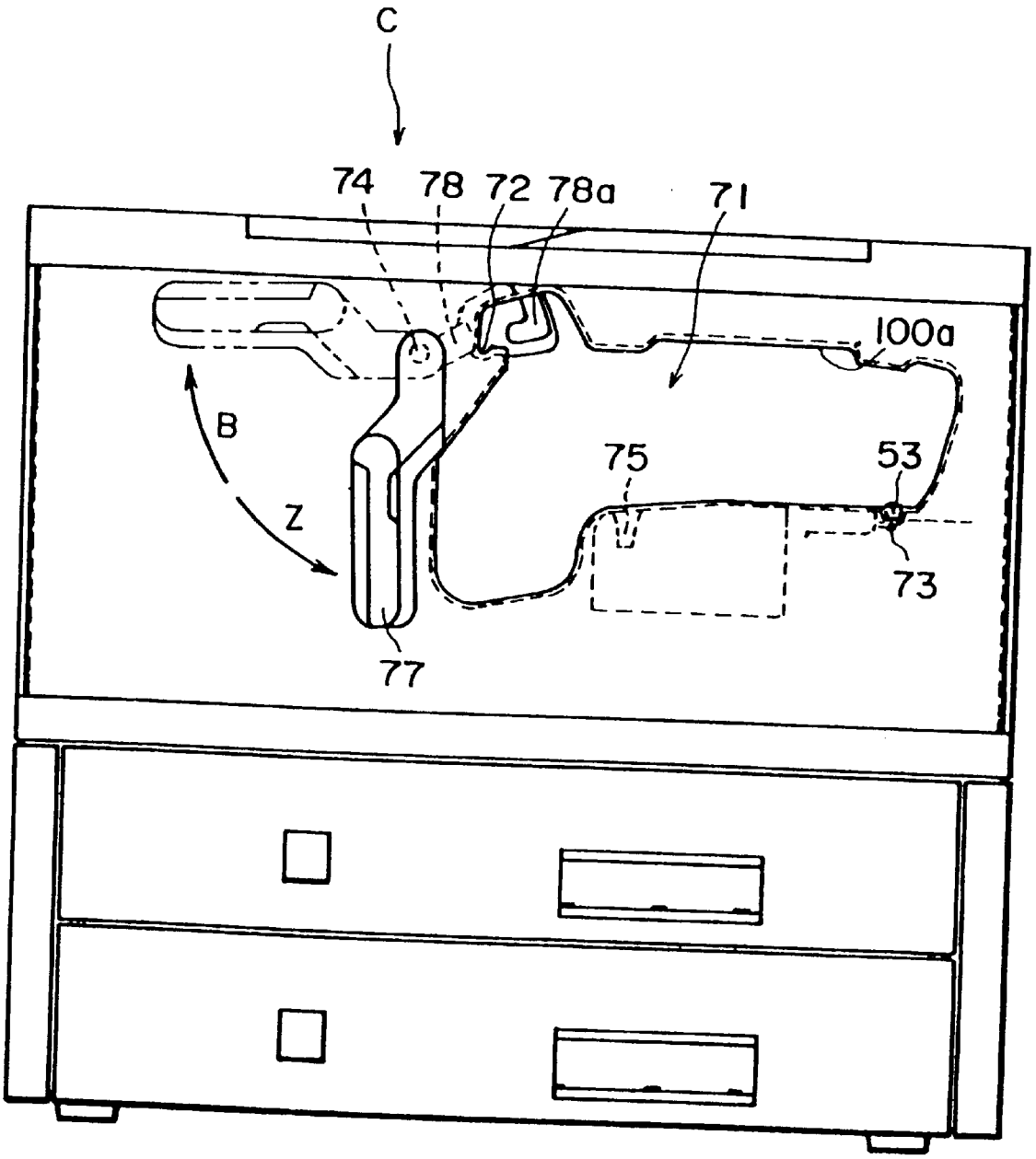
FIG. 39 is a front view of the cartridge mounting portion of an image forming apparatus.

Next, referring to FIGS. 35–37, the structure for supporting the development roller 18 and magnet 23 will be described. FIG. 35 is an external perspective view of the connecting member 17*e* which doubles as a development-roller bearing, and FIG. 36 is an exploded perspective view of the connecting member 17*e* of the process cartridge 15, and its adjacencies. FIG. 37 is a partial vertical sectional view of the process cartridge 15.

The development roller 18 is a cylindrical member formed of metallic material such as aluminum or stainless steel. It is approximately 16–20 mm in external diameter, and 0.5–1.0 mm in wall thickness. In order to improve toner charging performance, the peripheral surface of the development roller 18 is coated with carbon, or is blasted (in this embodiment, it is simply coated with carbon). The non-driven end of the development roller 18 is provided with a hole 18*f* into which a sleeve flange 18*j* is pressed to be secured to the development roller 18.

Referring to FIG. 36, the sleeve flange 18*j* is a hollow cylindrical member formed of metallic material such as aluminum or stainless steel. It is a stepped flange, and is secured to one end of the development roller 18 by being pressed into the hole at the end of the development roller 18. It has a portion 18*j*1 which is pressed into the end of the development roller 18; it is secured to the development roller 18 by pressing this portion 18*j*1 into the development roller 18. The sleeve flange 18*j* also has a flange 18*j*3 and a small diameter portion 18*j*2, which are on the outward side of the portion 18*j*1 in terms of the axial direction of the development roller 18. The flange 18*j*3 is approximately the same in diameter as the development roller 18. The small diameter portion 18*j*2 is smaller in external diameter than the portion 18*j*1, and its axial line coincides with that of the portion 18*j*1. The spacer ring 18*b* for regulating the distance between the development roller 18 and photosensitive drum 11 is fitted around this small diameter portion 18*j*2 of the sleeve flange 18*j*. Further, the sleeve flange 18*j* is provided with a journal portion 18*j*4, which is on the outward side of the small diameter portion 18*j*2 and is smaller in diameter than the small diameter portion 18*j*2.

Further, the sleeve flange 18*j* is provided with a through hole 18*j*5, which is coaxial with the journal portion 18*j*4. The end portion of the magnet 23 is put through this through hole 18*j*5 to precisely position the magnet 23 relative to the developing means holding frame 17, with the interposition of the connecting member 17*e*.

Referring to FIG. 36, the magnet 23 comprises a large diameter portion 23*a*, or the center portion, and support portions 23*b* and 23*c*, or the end portions. The large diameter portion 23*a* is contained within the development roller 18. The large diameter portion 23*a* has been magnetized so that a plurality of magnetic poles are exposed at the peripheral surface of the large diameter portion 23*a*. Generally, one of the plurality of magnetic poles is made to approximately oppose the photosensitive drum 11, and the other magnetic poles are made to face optimal directions. The total number of the magnetic poles is four. In order to keep the magnetic force constant at the peripheral surface of the development roller 18, the distance between the peripheral surface of the large diameter portion 23*a* of the magnet 23 and the peripheral surface of the development roller 18 must be kept constant, and in order to keep this distance constant, the support portion 23*c* of the magnet 23 is supported by the connecting member 17*e*. Further, in order to keep the magnetic poles accurately positioned in terms of the circumferential direction, the support portion 23*c* of the magnet 23 is provided with a D-cut portion 23*c*1, which regulates the positioning of the magnet 23 in terms of its circumferential direction. The other support portion 23*b* of the magnet 23 is supported by the magnetic roller bearing (unshown) in the other sleeve flange 18*a* (FIGS. 7 and 18).

The connecting member 17*e* is formed of resin, and has an approximately 2–5 mm thick flange portion 17*e*4 and a projection 17*e*2 having an external diameter of approximately 8–15 mm. The projection 17*e*2 fits in the groove 19*e* of the rear end cover 19. The peripheral surface of the projection 17*e*2 has a flat portion 17*e*1, which will be approximately perpendicular to the line connecting the axial lines of the development roller 18 and photosensitive drum 11 after the assembly of the process cartridge 15. This flat portion 17*e*1 is the surface which catches the pressure generated by the elastic member 67, that is, the aforementioned compression spring, through the aforementioned pressing member 67*a*, and assures that the development roller 18 is kept pressed toward the photosensitive drum 11. This structural arrangement assures that the development roller 18 is kept pressed toward the photosensitive drum 11 without wasting the pressure generated by the resiliency of the compression spring, and the distance between the peripheral surfaces of the development roller 18 and photosensitive drum 11 is kept constant under any condition to constantly produce images of good quality.

The flange portion 17*e*4 of the connecting member 17*e* has a cylindrical first hole 17*e*3, as a bearing portion, which is in the surface on the side opposite to the surface with the projection 17*e*2. The axial line of this hole 17*e*3 coincides with the axial line of the peripheral surface of the projection 17*e*2, and the diameter of the hole 17*e*3 is approximately 8–15 mm. The journal portion 18*j*4 of the sleeve flange 18*j* is rotationally fitted in this hole 17*e*3 to allow the development roller 18 to smoothly rotate. The position of the development roller 18 relative to the photosensitive drum 11 in terms of the rotational direction is precisely fixed by the combination of the connecting member 17*e* and rear end cover 19 alone; in other words, it is determined by the combination of the connecting member 17*e* and rear end cover 19 alone how accurately the development roller 18 is positioned relative to the photosensitive drum 11 in terms of parallelism. More specifically, it is possible that even when the axial lines of the photosensitive drum 11 and the development roller 18 remain parallel to each other in a plane parallel to the surface of the paper on which FIG. 37 is drawn, they may cross each other in a plane perpendicular to the surface of the paper on which FIG. 37 is drawn, and therefore, the gap between the peripheral surfaces of the photosensitive drum 11 and development roller 18 may become nonuniform in terms of the longitudinal direction, and also changes may occur to the development position in terms of the circumferential direction. However, the above-described structural arrangement eliminates such a possibility.

Further, the connecting member 17*e*3 is provided with a second hole 17*e*5 as a positioning hole, which is on the inward side of the hole 17*e*3 and has a D-shaped cross section. The axial line of the hole 17*e*5 coincides with that of the projection 17*e*2. The D-cut portion 23*c*1 of the magnet 23 is fitted in this second hole 17*e*5 to accurately position the magnet 23 in terms of its circumferential direction. In other words, the positional relationship between the magnet 23 and the development roller 18 is precisely determined by only a single component, or the connecting member 17*e*, and therefore, it is easy to assure that the magnet 23 and the development roller 18 are precisely positioned relative to each other.

As described above, the magnet 23 needs to be positioned so that one of the four magnetic poles of the magnet 23 approximately opposes the photosensitive drum 11. Since the position of the magnet 23 relative to the photosensitive drum 11 is determined by the combination of the connecting member 17*e* and rear end cover 19 alone, it is also easy to assure that the magnet 23 is accurately positioned relative to the photosensitive drum 11.

Referring to FIG. 35, the flange portion 17*e*4 of the connecting member 17*e* is provided with a pair of screw holes 17*e*6, which double as positioning holes and are positioned sufficiently apart from each other. Also as shown in FIG. 35, the connecting member 17*e* is precisely positioned relative to the developing means holding frame 17, and is solidly fixed to the developing means holding frame 17 with use of the small screws 41 (FIG. 23). As a result, the positional relationship between the development blade 26, the magnetic seal, and the like, which have been fixed to the developing means holding frame 17, and the magnet 23 and the development roller 18, the positions of which are fixed by the connecting member 17*e*, is determined.

To repeat the descriptions of the components of the above-described structure in the order in which they are assembled, with reference to FIGS. 36 and 37, first, the cylindrical portion 18*j*1 of the sleeve flange 18*j* is pressed into the hole 18*f*, that is, the hole in one end of the development roller 18 to securely fix the sleeve flange 18*j* to the development roller 18. Next, the magnet 23 is inserted into the development roller 18, and the other sleeve flange 18*a* and a magnetic roller bearing (unshown) are inserted, completing the development roller unit.

Next, the pair of spacer rings 18*b* are fitted around the small diameter portion 18*j*2 of the sleeve flange 18*j*, and the second cylindrical portion 18*c* of the sleeve flange 18*a*, one for one, and the development roller gear 62 (FIGS. 7 and 18) is fitted around the flattened portion 18*e* of the sleeve flange 18*a*. Then, the combination of the above-described components is attached to the developing means holding frame 17, with the interposition of the connecting members 17*e*. Thereafter, a unit formed by fitting the elastic member 67, or a compression spring, around the projection (unshown) of the flat surface 67*b* of the pressing member 67*a*, is fitted in the groove 19*e* of the rear end cover 19. Then, the projection 17*e*2 of the connecting member 17*e* having been solidly fixed to the developing means holding frame 17 is inserted into the groove 19*e* of the rear end cover 19. As the projection 17*e*2 is inserted into the groove 19*e*, the pressing member 67*a* is pressed inward against the resiliency of the elastic member 67 (state shown in FIG. 37).

As is evident from FIG. 37, the positions of the development roller 18 and the magnet 23 are fixed by the rear end cover 19, with the interposition of the connecting member 17*e*, and the surface which catches the pressure is also provided on the developing means holding frame 17 side. The phase of the D-cut portion 23*c*1 of the magnet 23 relative to the magnetic poles is optional. However, if the magnetic poles of the magnet 23 are positioned so that as the D-cut portion 23*c*1 is inserted into the second hole 17*e*5 of the connecting member 17*e*, the flat surface of the D-cut portion 23*c*1 becomes perpendicular to the plane connecting the axial lines of the development roller 18 and photosensitive drum 11, the second hole 17*e*5 and projection 17*e*2 of the connecting member 17*e* can be made coaxial, and similar in cross section, enabling component processors to improve efficiency.

Giving some components multiple functions as described above makes it possible to reduce the component count, and as a result, it becomes possible to provide a user with an inexpensive process cartridge. Further, fixing the positions of the essential components such as the photosensitive drum 11, development roller 18, and the magnet 23, which are extensively involved in image formation, with the use of only a small number of components makes it possible to improve the level of preciseness at which these essential components are positioned relative to each other, so that image quality is improved and stabilized.

The connecting member 17*e* has the first hole 17*e*3 as its bearing portion, by which the development roller 18 is rotationally supported. Therefore, a substance such as PPS or PA which is superior in terms of slipperiness is sometimes used as the material for the connecting member 17*e*. Such a substance is relatively expensive, and therefore, usage of such a substance results in cost increase. This problem can be solved by dividing the connecting member 17*e* into two independent pieces: bushing 39 as an actual bearing, and a main portion 17*ea* with a hole 17*e*3*a* in which the bush 39 is fitted. With this arrangement, the volume of the component which requires expensive material can be small, and a relatively inexpensive substance such as HIPS or the like can be used as the material for the main portion 17*ea* of the connecting member 17*e*, making it possible to reduce the cost. Further, modifying the shape of the bushing makes it possible to integrate the connecting member 17*e* with the developing means holding frame 17 (all that is necessary is to diagonally insert the development roller or the like during assembly). With the integration of the connecting member 17*e* with the developing means holding frame 17, not only can the small screws or the like be eliminated, but also the component count and the number of assembly steps can be further reduced. As a result, the cost can be further reduced.

The above-described process cartridge 15 is approximately 4 kg in weight, approximate 460 mm in length, approximately 300 mm in width, and approximately 110 mm in height.

(Means for Mounting Process Cartridge into Image Forming Apparatus Main Assembly)

Figure 40:
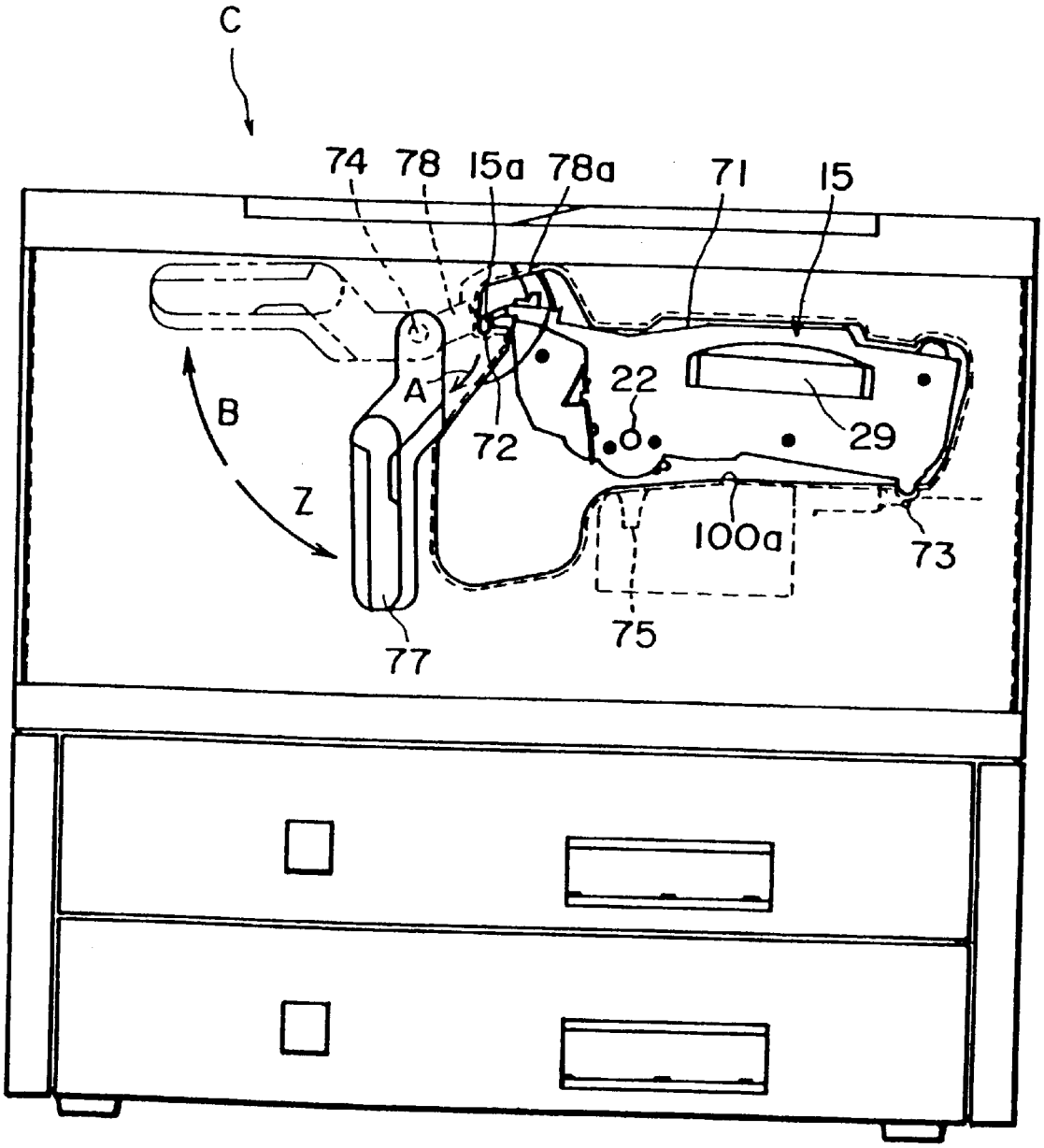
FIG. 40 is a front view of the image forming apparatus, for showing the manner in which the process cartridge is mounted into or dismounted from the main assembly of the image forming apparatus.
Figure 43:
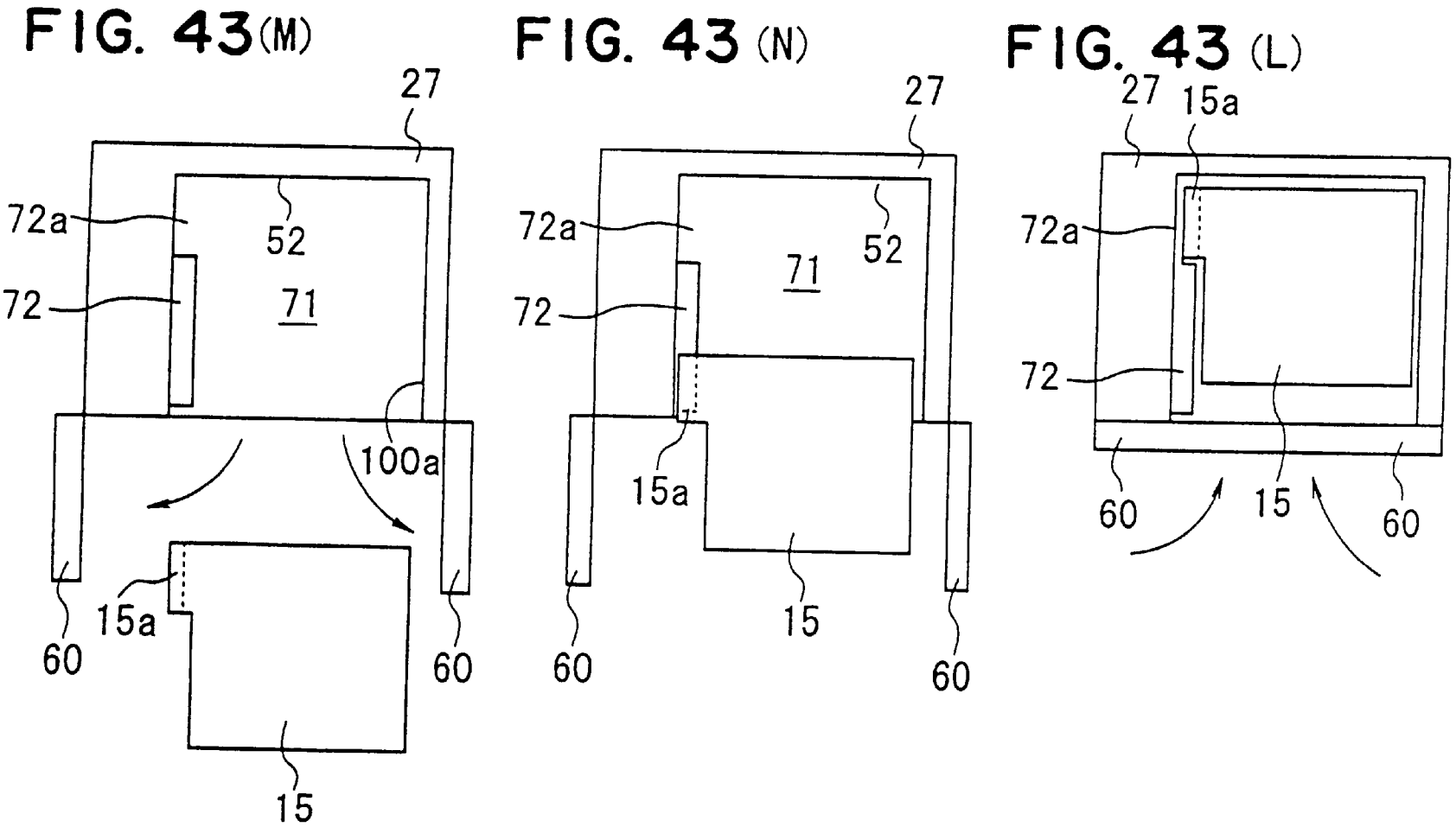
FIGS. 43(L), 43(M), and 43(N) are plan views for showing the manner in which the process cartridge is inserted into the image forming apparatus main assembly.

Referring to FIG. 43(L), the front of the apparatus main-assembly 27 is provided with a double-leafed hinged door 60. As this door 60 is opened as shown in FIG. 43(M), an opening 100*a*, through which the process cartridge 15 is inserted, is exposed as shown in FIG. 40. A process-cartridge mounting portion 71 can be seen through this opening 100*a*.

As can be seen through the opening 100*a*, the process-cartridge mounting portion 71 is provided with a guide 72 in the form of a rail, which belongs to the main-assembly side, a first guiding groove, a second guiding groove 73*b*, and a flat guiding portion 73*c* (guiding grooves and flat guiding portion 73*c* together will be referred to as a guide 73). These guiding portions are fixed to the apparatus main assembly 27 and extend in the front to rear direction of the apparatus main assembly 27. The guide 72 is located at the top left of the opening 100*a*, and the guide 73 is located at the bottom right of the opening 100*a*. The guide 72 is a straight groove and is approximately parallel to the photosensitive drum 11. It is in the form of a semicylinder, being open on the top side, and its inward surface functions as the guiding surface. The first and second guiding grooves 73*a* and 73*b* are parallel to the guide 72 on the main-assembly side.

Referring to FIG. 44, the guide 72 does not reach all the way to the deepest end of the process-cartridge mounting portion, creating a trap portion 72*a*. The guide 73 extends inward from the opening 100*a*, reaching a cylindrical member 53 of the wall 52 of the cartridge mounting portion. The wall 52 is the wall located at the deepest end of the cartridge mounting portion as seen from the opening 100*a*. The cylindrical member 53 has an approximately cylindrical hole 53*a*. This hole 53*a* is approximately parallel to the photosensitive drum 11, and aligns with the guide 73 as seen from above the apparatus main assembly 27. However, the axial line of the hole 53*a* of the cylindrical member 53 is located higher than the axial line of the semicylindrical guide rail 73. The detail of this positional relationship will be given in the description of the functions of the guides.

The cartridge mounting portion 71 is provided with a vertical movement lever 78, that is, a movable member, for lifting or lowering the process cartridge 15, which is located at the top left of the deepest end of the cartridge mounting portion 71. The vertical movement lever 78 is attached to a shaft 74 which is rotationally supported by the front end plate 100*b* and rear end plate 52 of the apparatus main assembly 27. The shaft 74 projects frontward beyond the end plate 100*b*, and the base portion of an external lever 77 is solidly fixed to the portion of the shaft 74, which is projecting frontward from the end plate 100*b*. The shaft 74 is horizontally positioned and is perpendicular to the direction in which recording medium is conveyed. Therefore, the vertical movement lever 78 can be moved in the vertical direction by the external lever 77. The vertical movement lever 78 is provided with a cam groove 78*a*, which catches the engaging portion 20*n* (which will be described later) of the process cartridge 15.

The aforementioned first coupling 103 and second coupling 104 on the apparatus-main-assembly side are projecting into the cartridge mounting portion 71, or the cartridge mounting space, from the deep end plate 52 of the cartridge mounting portion of the apparatus main assembly 27.

The space immediately below the cartridge mounting portion 71 constitutes a path through which a sheet S is conveyed. Also in the cartridge mounting space 71, a pair of stands are placed one for one corresponding to both ends of the transfer roller 9 positioned in this sheet conveyance path. Each stand has a positioning recess 75. In the positioning recess 75*a* (which is on the rear side in terms of the process-cartridge insertion direction), the shaft 22*a*1 of the bearing member 22*a* for supporting the photosensitive drum 11 of the process cartridge 15 fits. The axial line of the shaft 22*a* 1 coincides with that of the photosensitive drum 11. Therefore, the non-driven end of the photosensitive drum 11 is accurately positioned relative to the apparatus main assembly 27. In the positioning recess 75*b*, the bearing member 22*b*, which surrounds the first coupling 105*a* on the process-cartridge side, and the axial line of which coincides with the first coupling 105*a*, fits. This bearing member 22*b* is a cylindrical member, and doubles as a positioning member. With the bearing member 22*b* fitted in the positioning recess 75*b*, the axial line of the bearing member 22*b*, that is, the axial line of the photosensitive drum 11, approximately aligns with the axial line of the first coupling 103 on the apparatus-main-assembly side; the misalignment between the axial lines of the first coupling 103 on the apparatus-main-assembly side and bearing member 22*b* is within an approximate range of 100 microns to 1 mm. As the first coupling 103 on the apparatus-main-assembly side rotates, the first coupling 105*a* on the process-cartridge side is aligned with the first coupling 103 on the apparatus-main-assembly side. As a result, the photosensitive drum 11 rotates with its axial line aligned with that of the first coupling 103 on the apparatus-main-assembly side. Thus, while the photosensitive drum 11 is rotating, the bearing member 22*b*, which doubles as a positioning member, does not remain unyieldingly positioned in the positioning recess 75*b* at the deep end of the process-cartridge mounting portion, in other words, it remains in a floating state. Next, the cartridge mounting means on the process-cartridge side will be described.

Referring to FIG. 5, the process cartridge 15 is provided with a first guiding portion 15*a*, which is located at the top left corner of the deep end of the process cartridge 15 and is guided by the stationary guide 72 on the apparatus main-assembly side. The first guiding portion 15*a* is shaped so that the long edge portion points downward. The long edge portion has a cylindrical curvature, which approximately matches that of the photosensitive drum 11. This long edge portion of the first guiding portion 15*a* fits in the semicylindrical groove of the guide 72. The process cartridge 15 is provided with only one first guiding portion 15*a*, which is located at the front end of the process cartridge 15 in terms of the cartridge insertion direction. The first guiding portion 15*a* has a horizontal portion 15*a*-1 which is approximately parallel to the top surface of the cartridge frame, and a vertical portion 15*a*-2 which extends downward from the horizontal portion 15*a*1. The bottom edge of the vertical portion 15*a*-2 is guided by the stationary guide 72 on the apparatus-main-assembly side.

Referring to FIG. 6, the process cartridge 15 is provided with a second guiding portion 20*g*, which is located at the bottom right corner of the front end of the process cartridge 15 in terms of the cartridge-insertion direction, that is, the farthest portion from the above-described first guiding portion 15*a* in terms of a direction perpendicular to the cartridge insertion direction. The second guiding portion 20*g* has a support portion 20*g*2 which is an integral part of the front end cover 20, and a virtually cylindrical projection 20*g*2 like a cylindrical boss which projects from this support portion 20*g*2 approximately in parallel to the photosensitive drum 11. The bottom portion of the projection 20*g*1 and the bottom portion of the support portion 20*g*2 have the same cylindrical curvature, forming a continuous surface. The diameter of the projection 20*g*1 is such that it allows the projection 20*g*1 to loosely fit in the hole 53*a* of the cylindrical member 53. The second guiding portion 20*g* is an integral part of the front end cover 20.

Also referring to FIG. 6, the process cartridge 15 is provided with a first guiding portion 15*a*, which is located at the top left corner of the front end of the process cartridge 15 in terms of the direction in which the process cartridge 15 is inserted into the apparatus main assembly 27. The first guiding portion 15*a* projects leftward from the process cartridge 15 and bends diagonally downward. The longitudinal edge of the first guiding portion 15*a* has a semicylindrical shape. The process cartridge 15 is provided with an engaging member 20*n* in the form of a round pin, which is located at the top left comer of the front end of the process cartridge 15 in terms of the direction in which the process cartridge 15 is inserted into the apparatus main assembly 27, and is located slightly above the base portion of the above-described first guiding portion 15*a*, extending in the cartridge-insertion direction. The engaging member 20*n* is an integral part of the front end cover 20, and projects in the cartridge-insertion direction beyond the front end of the process cartridge 15 in terms of the cartridge-insertion direction. The front end of the process cartridge 15 is such an end of the process cartridge 15 that will be located at the front end when the process cartridge 15 is inserted into the apparatus main assembly 27. The top surface of the process cartridge 15 is such a surface of the process cartridge 15 that will be facing upward when the process cartridge 15 is inserted into the apparatus main assembly 27. The first guiding portion 15*a* comprises two sections: an integral part of the front end cover 20; and an integral part of the cleaning means holding frame 13. Further, the process cartridge 15 is provided with a second guiding portion 20*g*, which is at the bottom right corner of the front end of the process cartridge 15 in terms of the direction in which the process cartridge 15 is inserted into the apparatus main assembly 27. The second guiding portion 20*g* has a projection 20*g*1, and the projection 20*g*1 has a slanted surface 20*g*3, which is on the underside of the projection 20*g*1. Further, the process cartridge 15 is provided with a third guiding portion 19*g*, which is located at the bottom right comer of the rear end of the process cartridge 15 in terms of the direction in which the process cartridge 15 is inserted into the apparatus main assembly 27. The third guiding portion 19*g* is slightly below the bottom surface of the process cartridge 15. The axial line of the third guiding portion 19*g* coincides with the axial line of the projection 20*g* of the second guiding portion 20*g*, and is parallel to the axial line of the photosensitive drum 11. The third guiding member 19*g* is an integral part of the rear end cover 19.

In order to insert the process cartridge 15 into the image forming apparatus main assembly 27, first, the door 60 located at the front of the image forming apparatus main assembly 27 (which corresponds to the non-driven end of the photosensitive drum 11 in terms of the longitudinal direction) is opened as shown in FIG. 43(M). Then, the process cartridge 15 is lifted, with the first handle on the top surface of the process cartridge 15 grasped by one hand of an operator, and the second handle at the rear end of the process cartridge 15 grasped by the other hand, and is inserted into the cartridge mounting portion 71 through the opening 100*a*. Next, referring to FIG. 40, the first guiding portion 15*a* of the process cartridge 15 is rested on the stationary guide 72 on the apparatus main-assembly side, and the second guiding portion 20*g* of the process cartridge 15 is fitted in the second guiding groove 73*b* on the apparatus main-assembly side. Then, the process cartridge 15 is pushed straight (toward the back side of the paper on which FIG. 40 is drawn; the direction indicated by an arrow mark in FIGS. 43(M) and 43(N)) into the image forming apparatus main assembly 27 in the direction parallel to the longitudinal direction of the photosensitive drum 11.

Figure 44H:
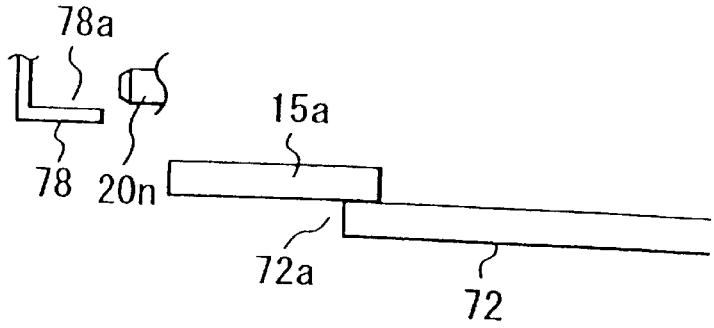
FIGS. 44(H), 44(I), and 44(J) are sectional drawings for showing the relationship among the guiding portion of the process cartridge, and the vertical movement lever and guide rail of the image forming apparatus main assembly.
Figure 44I:
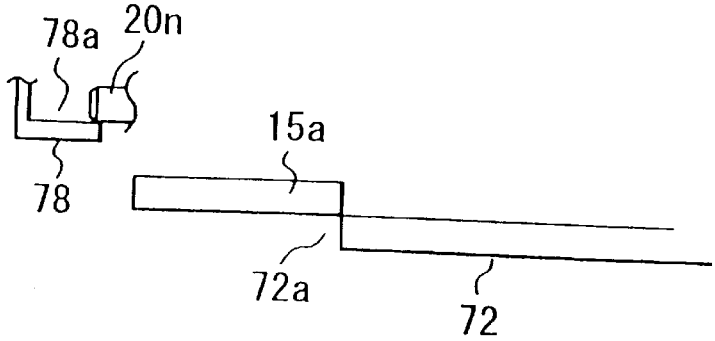
Figure 44J:
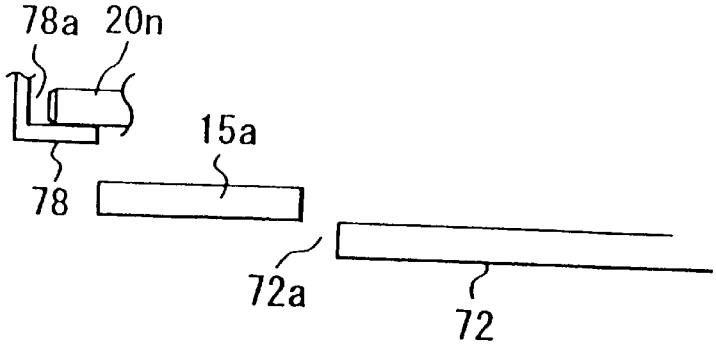

The stationary guide 72 on the apparatus main-assembly side for supporting the first guiding portion 15*a* of the process cartridge 15 while moving the process cartridge 15 in the image forming apparatus main assembly 27 in a direction parallel to the electrophotographic photosensitive drum 11*d* does not extend all the way to the front end of the process cartridge 15, creating a trap portion 72*a* between the front end of the stationary guide 72 and the front wall of the cartridge mounting portion 71. Thus, as the first guiding portion 15*a* slides inward on the stationary guide 72 on the apparatus main-assembly side, it arrives at the trap portion 72*a*, and extends from the end of the stationary guide 72 over the trap portion 72*a*, as shown in FIG. 44(H). Next, referring to FIG. 44(I), before the first guiding portion 15*a* falls off from the stationary guide 72, the engaging member 20*n* located at the front end of the process cartridge 15 in terms of the cartridge-insertion direction slides into the cam groove 78*a* of the vertical movement lever 78. Next, referring to FIGS. 44(I) and 44(J), as the process cartridge 15 is pushed further into the cartridge mounting portion 71, the first guiding portion 15*a* becomes disengaged from the stationary guide 72 on the apparatus-main-assembly side. As a result, the process cartridge 15 is partially supported by the vertical movement lever 78; the engaging member 20*n* of the process cartridge 15 is supported by the vertical movement lever 78.

At the same time as the first guiding portion 15*a* of the process cartridge 15 is rested on the stationary guide 72 on the apparatus-main-assembly side, the second guiding portion 20*g* at the bottom right comer of the front end of the process cartridge 15 is rested on the guide 73. Thereafter, as the process cartridge 15 is pushed further inward of the cartridge mounting portion 71, the second guiding portion 20*g* moves inward while sliding on the guide 73, and the third guiding portion 19*g* at the bottom right comer of the rear end of the process cartridge 15 in terms of the cartridge insertion engages into the second guiding groove 73*b* before the projection 20*g*1 of the second guiding portion 20*g* reaches the cylindrical member 53. The third guiding portion 19*g* is provided with the slanted surface, which is located at the front end in terms of the cartridge-insertion direction, as shown in FIG. 6, and therefore, the third guiding portion 19*g* smoothly enters the second guiding groove 73*b*. As a result, the bottom right of the rear portion of the process cartridge 15 in terms of the cartridge-insertion direction is supported by the second guiding groove 73*b*, in the cartridge mounting portion 71, and the first guiding portion 15*a* at the top left of the front end of the process cartridge 15 in terms of the cartridge-insertion direction is supported by the stationary guide 72 on the apparatus-main-assembly side. As the process cartridge 15 is further inserted, the projection 20*g*1 at the bottom right of the front end of the process cartridge 15 is inserted into the hole 53*a* of the cylindrical member 53 at the same time as the engaging member 20*n* engages into the cam groove 78*a* of the vertical movement lever 78. Since the position of the axial line of the hole 53*a* of the cylindrical member 53 is higher than that of the axial line of the projection 20*g*1 while the projection 20*g*1 is guided by the first guiding groove 73*a*, the right front of the process cartridge 15 is lifted as the engaging member 20*g* enters the hole 53*a*. The bottom side of the projection 20*g*1 has the slanted surface 20*g*3, which is located at the front end in terms of the cartridge-insertion direction, as shown in FIG. 6, and therefore, the projection 20*g*1 smoothly slides into the hole 53*a* of the cylindrical member 53.

Immediately after the projection 20*g*1 fits into the hole 53*a* of the cylindrical member 53 and the engaging member 20*n* engages into the cam groove 78*a* of the vertical movement lever 78, the first guiding portion 15*a* is directly above the trap portion 72*a*, and further, the third guiding portion 19*g* is resting in the second guiding groove 73*b*; in other words, the process cartridge 15 is supported at three points.

Figure 41:
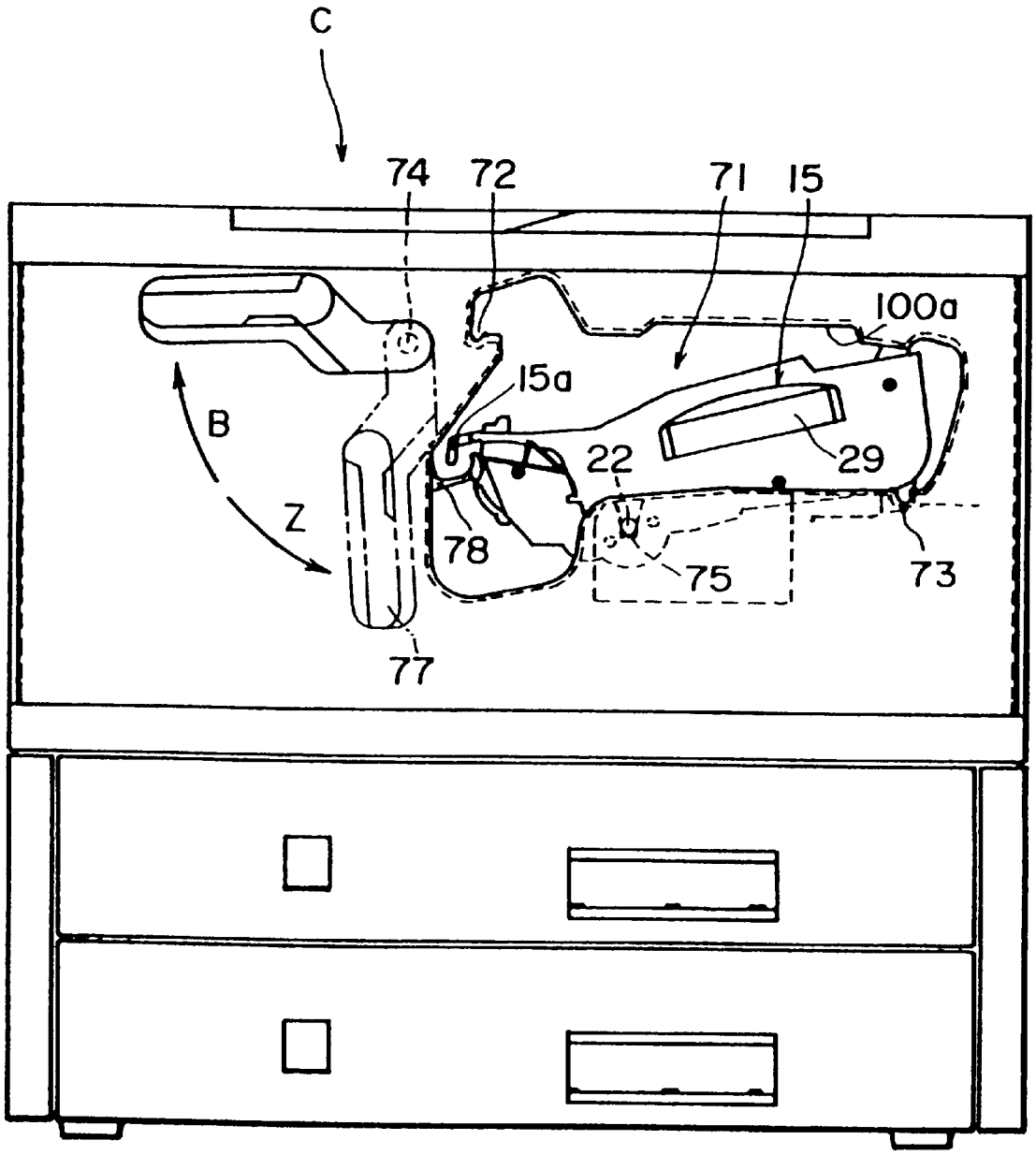
FIG. 41 is a front view of the image forming apparatus, for showing the manner in which the process cartridge is mounted into or dismounted from the main assembly of the image forming apparatus.
Figure 42:
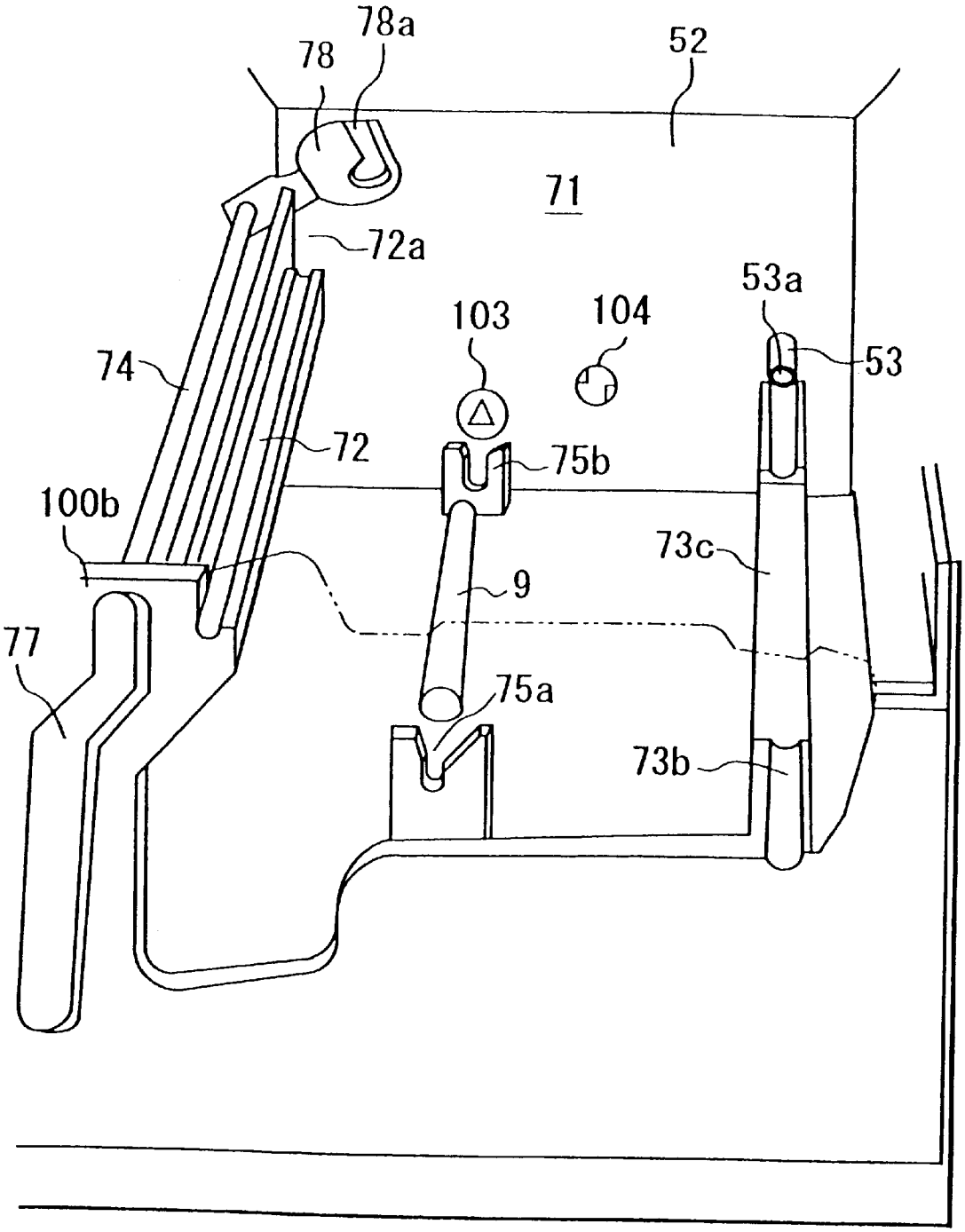
FIG. 42 is a perspective view of the cartridge mounting portion of the image forming apparatus main assembly.

When the external lever 77 is at the position shown in FIG. 40, it is retained by an unshown notch. As the external lever 77 is rotated in the direction indicated by an arrow mark B, the shaft 74 rotates with the external lever 77, causing the inside lever 78, or the vertical movement lever, to rotate in the direction to lower the cam groove 78*a*. As a result, the engaging member side of the process cartridge 15 descends, the process cartridge 15 pivoting about the projection 20*g*1 in the hole 53*a* of the cylindrical portion 53 and the third guiding portion 19*g* supported by the second guiding groove 73*b*, and the engaging member 20*n* rested in the cam groove 78*a* moving in the cam groove 78*a*, until the bearing members 22*a* and 22*b*, which double as positioning members, fit into the positioning recesses 75*a* and 75*b*, respectively, of the apparatus main assembly 27. The mounting of the process cartridge 15 into the apparatus main assembly 27 ends as the external lever 77 becomes horizontal (FIG. 41).

At this time, referring to FIG. 46, the manner in which the process cartridge 15 is lowered by the vertical movement lever 78 will be described.

Figure 46:
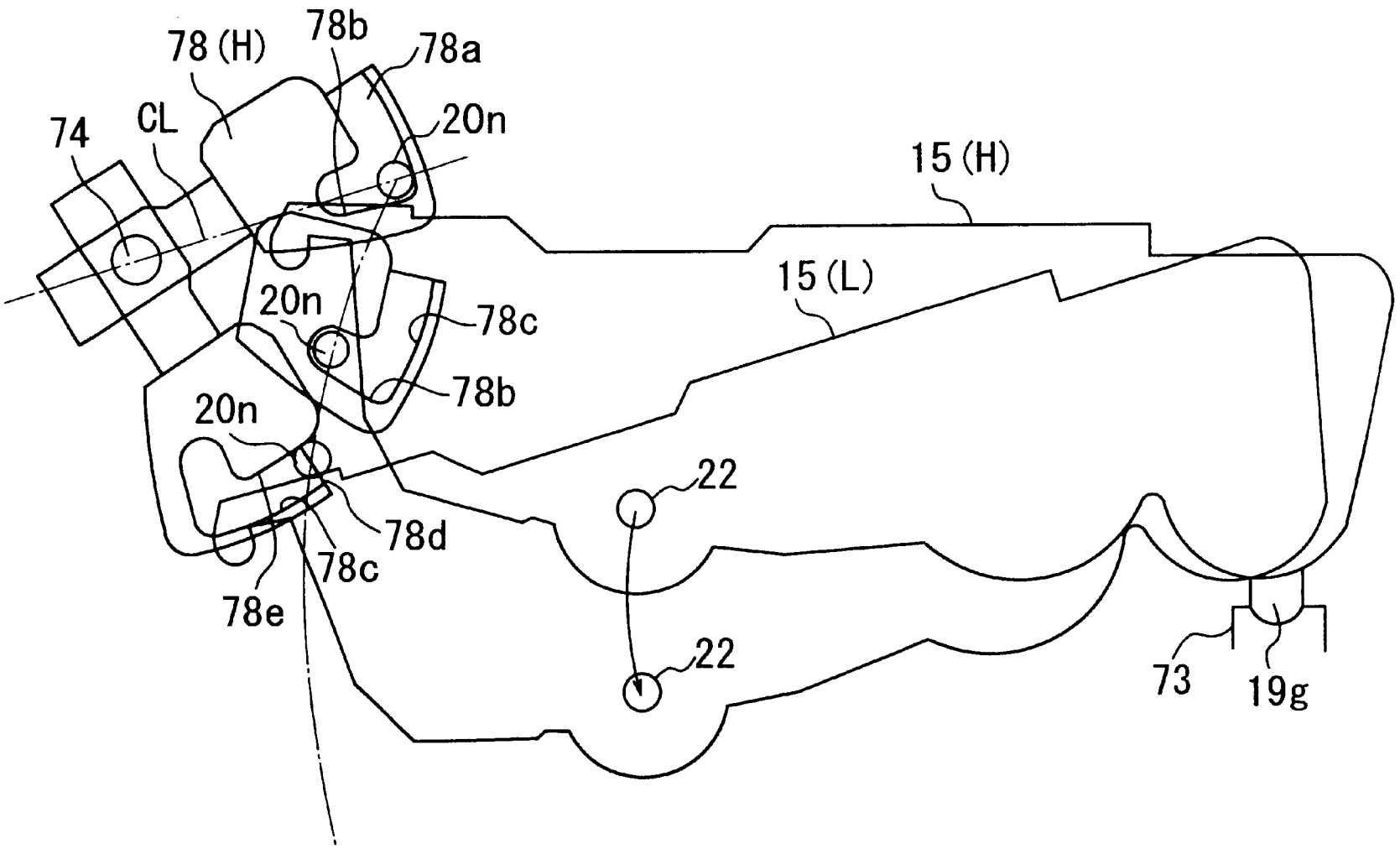
FIG. 46 is a side view of the vertical movement lever and the process cartridge, for showing the loci of the essential portions of the process cartridge, in the cartridge mounting portion.
Figure 47:
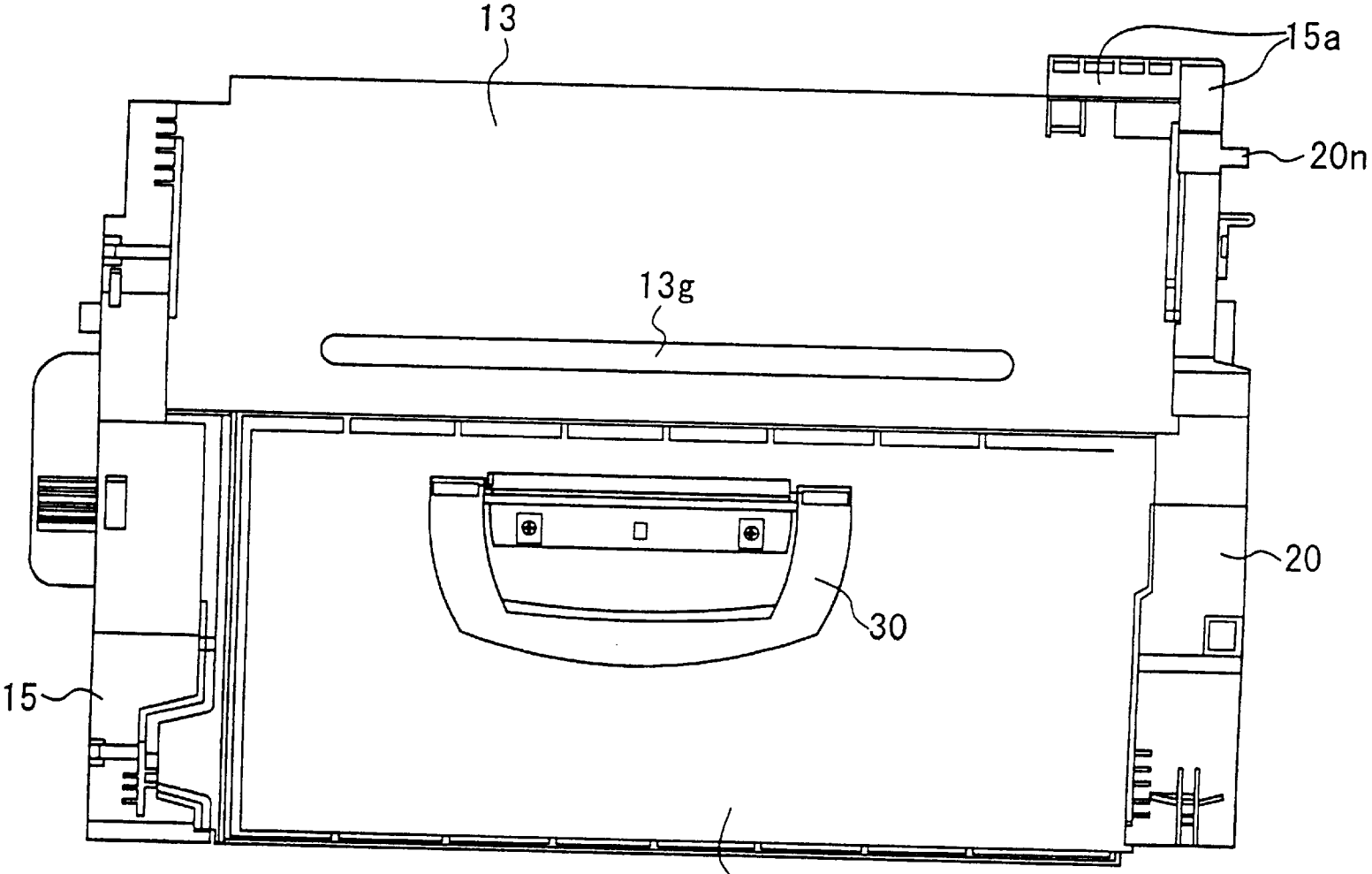
FIG. 47 is a plan view of the process cartridge.
Figure 48:
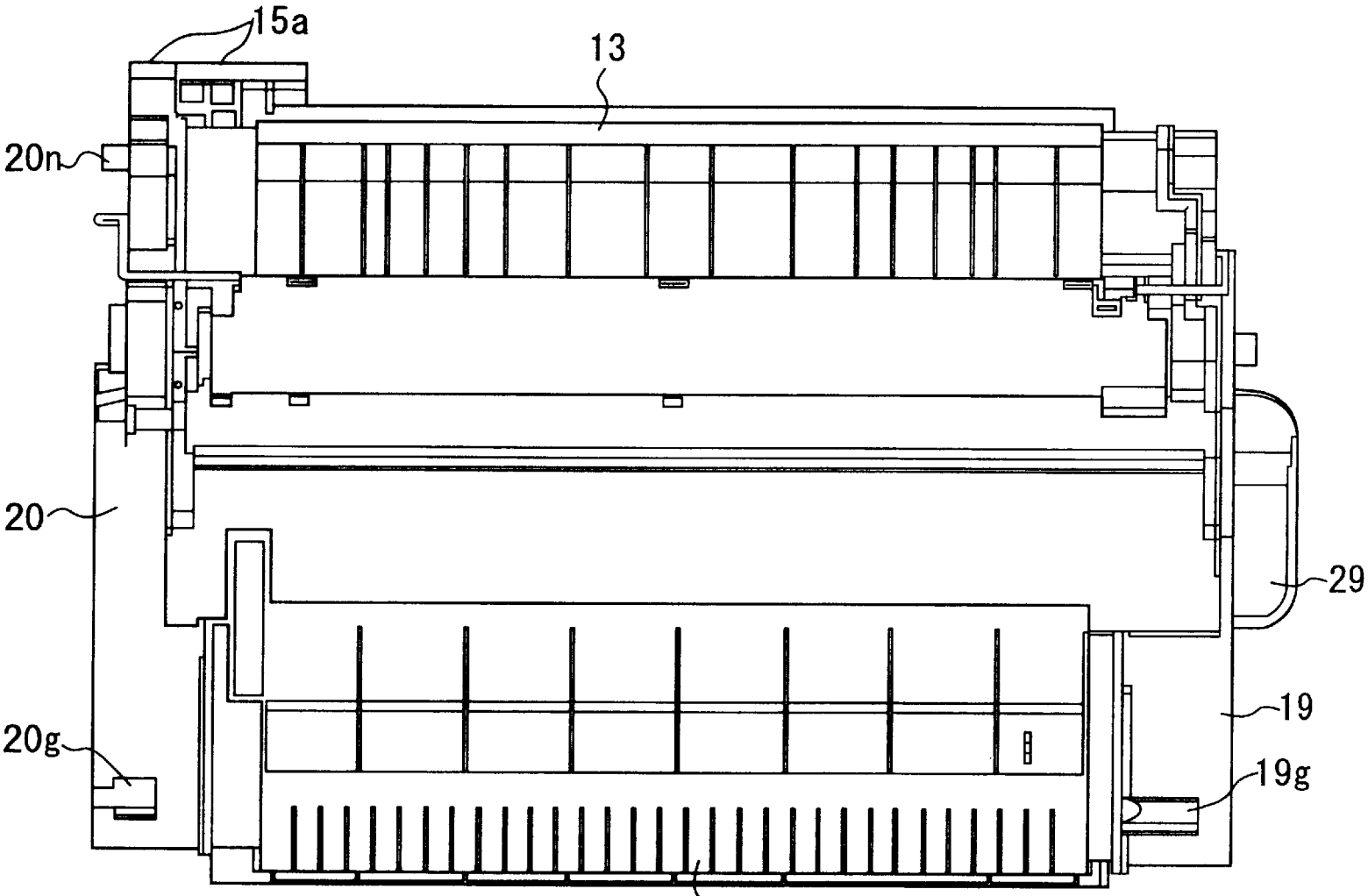
FIG. 48 is a bottom view of the process cartridge.

Immediately after the process cartridge 15 is inserted straight all the away into the cartridge mounting portion 71 through the opening 100*a*, the process cartridge 15 is at a high position (H) (indicated in FIG. 46 by the process-cartridge contour designated by a reference code 15(H)). At the position (H), the process cartridge 15(H) is supported by the vertical movement lever 78, by the engaging member 20*n*, and also is supported by the cylindrical portion 53, by the projection 20*g*1 in the hole 53*a* of the cylindrical portion 53. Further, the process cartridge 15(H) is supported by the second guiding groove 73*b*, by the third guiding portion 19*g*.

As the cam groove 78*a* side of the vertical movement lever 78 descends, the engaging member 20*n* also descends. During this descent, the process cartridge 15 pivots about the axial line of the projection 20*g*1 and the axial line of the third guiding portion 19*g*, which coincide with each other, and the engaging member 20*n* descends while sliding on the bottom 78*b* of the cam groove 78*a* toward the shaft 74, due to the weight of the process cartridge. When the engaging member side of the process cartridge 15 is at the mid point of its descent, the axial line of the engaging member 20*n* is in the plane connecting the axial lines of the third guiding portion 19*g* and shaft 74, and the engaging member 20*n* is closest to the shaft 74 within the moving range of the engaging member 20*n*. The profile of the bottom of the cam groove 78*a* is rendered so that while the engaging member 20*n* is descending from the position at which the vertical movement lever 78 is at a position 78(H) (indicated by the vertical movement lever contour designated by a reference code 78(H)), the axial line of the engaging member 20*n* remains in the plane CL connecting the axial lines of the engaging member 20*n* and shaft 74. As the cam groove 78*a* side of the vertical movement lever 78 further descends, the engaging member 20*n* slides on the bottom 78*b* of the cam groove 78 in the direction to move away from the shaft 74. Before the engaging member 20*n* reaches the outward wall 78*c* of the cam groove 78*a*, which has a cylindrical curvature and is connected to the right end of the bottom 78*b*, the bearing members 22*a* and 22*b* of process cartridge 15 fit into the positioning recesses 75*a* and 75*b*. Thereafter, the engaging member 20*n* remains stationary. As the cam groove 78*a* side of the vertical movement lever 78 further descends, the outward wall 78*c* of the cam groove 78*a*, which has a cylindrical curvature, moves without coming in contact with the engaging member 20*n*, and the opening portion 78*d* of the cam groove 78*a* comes to the position of the engaging member 20*n*. The axial lines of the cylindrical curvatures of the outward and inward walls 78*c* and 78*e* of the cam groove 78*a* coincide with the axial line of the shaft 74. The distance between the outward and inward walls 78*c* and 78*e* of the cam groove 78*a* is greater than the diameter of the engaging member 20*n*. The space between the outward and inward walls 78*c* and 78*e* opens upward, forming the opening 78*d*.

As the process cartridge 15 is inserted straight all the way into the cartridge mounting portion 71, the first and second couplings 105*a* and 106*a*, as driving force receiving members, on the process-cartridge side, engage with the first and second couplings 103 and 104, as driving force transmitting members, on the apparatus-main-assembly side, respectively, although they sometimes fail to engage. Even if they fail to engage, as the couplings on the apparatus-main-assembly side are driven, they advance and instantly engage with the coupling members on the process-cartridge side, because the couplings on the apparatus-main-assembly side are kept pressured by the force from the aforementioned resilient member.

As the first coupling 103 on the apparatus main-assembly side and the first coupling 105*a* on the process-cartridge side are rotationally driven by an unshown driving force source of the apparatus main assembly 27, they become aligned with each other; in other words, their axial lines become aligned with each other. As a result, the photosensitive drum 11 becomes aligned with the first coupling 103 on the apparatus-main-assembly side. The distance the axial line of the coupling 106*a* of the process-cartridge side moves to become aligned with the axial line of the first coupling 103 on the apparatus-main-assembly side is such that the bearing member 22*b* of the process cartridge 15 is displaced approximately 100 microns to 1 mm from the position at which the bearing member 22*b* has settled in the recess. While the process cartridge 15 is driven, it is supported by the positioning recess 75*b* at the rear side in terms of the cartridge-insertion direction, the cylindrical portion 53, and the first coupling 103 on the apparatus-main-assembly side, which is in engagement with the first coupling 105*a* on the process-cartridge side. As described before, even if the axial line of the second coupling 104 on the apparatus main-assembly side is not in alignment with that of the second coupling 106*a* on the process-cartridge side, the driving force can be transmitted without any problem.

After the descending process cartridge 15 has settled in the cartridge mounting portion 71, it remains supported by the positioning recess 75*a*, hole 53*a* of the cylindrical member 53, and the positioning recess 75*b* on the apparatus-main-assembly side.

In other words, the positioning members (shaft portions 22*a*1 and bearing member 22*b*) of the process cartridge 15 remain engaged in the positioning recesses 75*a* and 75*b* on the apparatus-main-assembly side, and the projection 20*g*1 of the process cartridge 15 remains engaged in the hole 53*a*.

As the external lever 77 in the state shown in FIG. 41 is rotated in the direction indicated by an arrow mark Z, the shaft 74 rotates in the same direction, causing the vertical movement lever 78 to move upward. As the vertical movement lever 78 moves upward, the engaging member 20*n* at the top left of the front end of the process cartridge 15 in terns of the cartridge-insertion direction is lifted by the cam groove 78*a*. As a result, the projection 20*g*1 at the bottom right corner of the front end of the process cartridge 15 in terms of the cartridge-insertion direction rotates in the cylindrical portion 53 of the apparatus main assembly 27, the left side of the process cartridge 15 as seen from the rear end in terms of the cartridge-insertion direction is lifted, the shaft 22*a*1 moves upward slightly away from the positioning recess 75*a*, the bearing member 22*b* moves upward slightly away from the positioning recess 75*b*, and the third guiding portion 19*g* at the bottom right corner of the rear end of the process cartridge 15 in terms of the cartridge-insertion direction descends and is supported by the second guiding groove 73*b*. In this state, that is, while the projection 20*g*1 of the process cartridge 15 is supported by the cylindrical portion 53, and the third guiding portion 19*g* of the process cartridge 15 is supported by the third guiding groove 73*b*, the process cartridge 15 pivots about the axial line of the projection 20*g*1 and the axial line of the cylindrical bottom end of the third guiding portion 19*g*, causing the engaging member 20*n* to move upward. As a result, the state shown in FIG. 40 is realized. In this state, the first guiding portion 15*a* at the top left of the front end of the process cartridge 15 in terms of the cartridge insertion direction, which has passed upward through the trap portion 72*a* during the above-described pivoting of the process cartridge 15, is in a position from which it can be smoothly slid onto the stationary guide 72 on the apparatus main assembly. In this state shown in FIG. 40, the process cartridge 15 can be pulled toward the front side of the apparatus main assembly, gasping the second handle 29 with one hand, the engaging member 20*n* at the top left comer of the front end of the process cartridge 15 in terms of the cartridge-insertion direction slides into the cam groove 78*a*, that is, the portion which catches the engaging member 20*n*, by a short distance, and the projection 20*g*1 at the bottom right of the front end of the process cartridge 15 in terms of the cartridge-insertion direction moves in the direction to disengage from the cylindrical portion 53. At this point in the cartridge removing operation, the first guiding portion 15*a* at the top left corner of the front end of the process cartridge 15 in terms of the cartridge-insertion direction has already passed upward through the trap portion 72*a*. Therefore, as the process cartridge 15 is pulled toward the front side of the apparatus main assembly, the engaging member 20*n* in the form of a pin, at the top left comer of the front end of the process cartridge 15 in terms of the cartridge-insertion direction disengages from the cam groove 78*a* after the first guiding portion 15*a* becomes fully rested on the stationary guide 72 on the apparatus-main-assembly side. At approximately the same time, the projection 20*g*1 at the bottom right corner of the front end of the process cartridge 15 in terms of the cartridge-insertion direction disengages from the cylindrical portion 53, and the second and third guiding portions 19*g* and 20*g* on the right side of the process cartridge 15 as seen from the front side of the apparatus main assembly 27 are rested on the first and second guiding grooves 73*a* and 73*b*. As the process cartridge 15 is pulled further toward the front side of the apparatus main assembly 27, the first guiding portion 15*a* slides on the stationary guide 72 on the apparatus-main-assembly side, and the second and third guiding portions 19*g* and 20*g* slide on the guide 73. Eventually, the third guiding portion 19*g* disengages first from the guide 73 as it comes out of the cartridge mounting portion 71 through the opening 100*a*. Then, as the process cartridge 15 is pulled further toward the front side of the apparatus main assembly 27 while the process cartridge 15 is supported with the use of the second handle 29, the first guiding portion 15*a* moves to the rear end of the stationary guide 72 on the apparatus main-assembly side in terms of the cartridge-insertion direction, and the second guiding portion 20*g* moves to the rear end of the stationary guide 73*b* of the apparatus-main-assembly side in terms of the cartridge-insertion direction. In this state, the process cartridge 15 can be pulled straight out of the cartridge mounting portion 71 through the opening 100*a*. As the process cartridge 15 is pulled out through the opening 100*a*, the first and second guiding portions 15*a* and 20*g* disengage from the rear ends of the stationary guides 72 and 73*b*, respectively, on the apparatus-main-assembly side in terms of the cartridge-insertion direction, toward the front end of the apparatus main assembly 27.

Figure 45P:
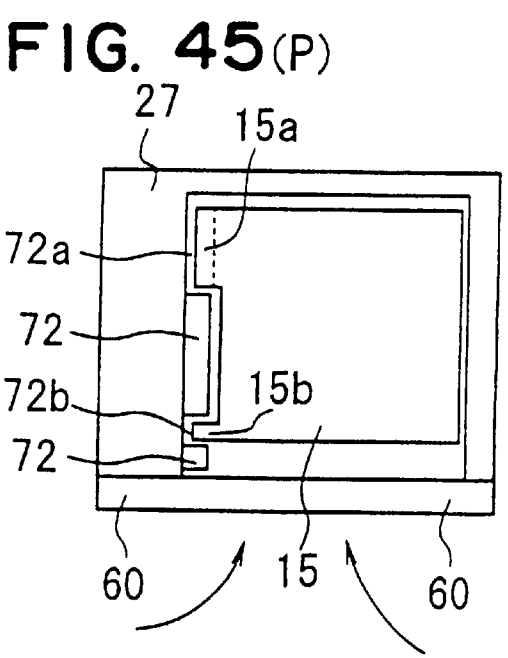
FIGS. 45(P), 45(Q), and 45(R) are plan views for showing the manner in which the process cartridge is inserted into the image forming apparatus main assembly, in another embodiment of the present invention.
Figure 45Q:
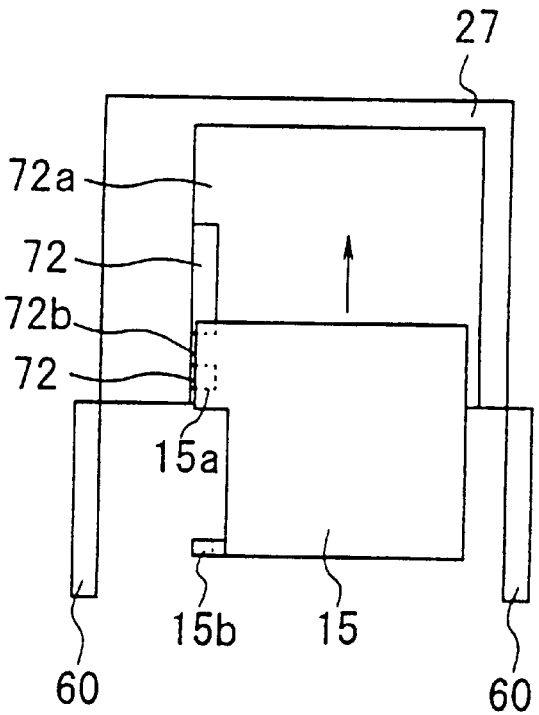
Figure 45R:
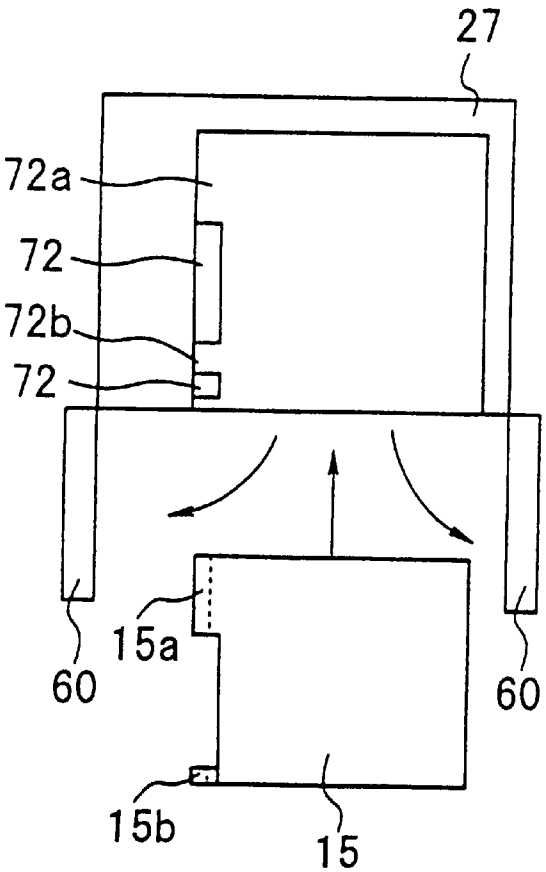

The guides on the apparatus-main-assembly side may be provided with a plurality of trap portions, and the process-cartridge side may be provided with a plurality of guiding portions. For example, FIG. 45 is a plan view of the process cartridge and image forming apparatus main assembly in another embodiment of the present invention, for showing the manner in which the process cartridge is mounted into the apparatus main assembly. In FIG. 45, the trap portion 72*b* is located between the front and rear ends of the stationary guide 72, so that the guiding portion 15*b* at the rear end of the process cartridge 15 aligns with the trap portion 72*b* at the same time as the first guiding portion 15*a* aligns with the trap portion 72*a*.

Since a structural arrangement is made so that the process cartridge 15 is mounted into or dismounted from the apparatus main assembly 27 as described above, while paper as the recording medium is conveyed through the image forming apparatus, in other words, and while a driving force is applied to rotate the photosensitive drum 11 in the clockwise direction, the projection 20*g*1 fitting in the cylindrical portion 53 prevents the process cartridge 15 from pivoting, and therefore, the process cartridge 15 is kept in the proper attitude. In other words, the member, about the axial line of which the process cartridge 15 pivots when the process cartridge 15 is mounted into or dismounted from the apparatus main assembly 27, also doubles as a member for preventing the process cartridge 15 from pivoting while paper is conveyed through the apparatus main assembly 27. Therefore, the member is more stable as the pivot about which the process cartridge 15 rotates.

According to the present invention, all that is necessary in order to mount a process cartridge into an image forming apparatus is to push the process cartridge into the image forming apparatus main assembly in the horizontal direction, and move a lever to a predetermined position. In other words, the operation for inserting the process cartridge straight into the apparatus main assembly is the only operation in which a process cartridge must be directly held by an operator. Therefore, even if the weight of a process cartridge increases as an image forming apparatus is increased in size, the process cartridge can be easily handled.

Further, the process cartridge can be accurately positioned simply by operating a lever. Therefore, not only can operational efficiency be improved, but also the accuracy with which a process cartridge is positioned is improved.

Further, a process cartridge can be taken out of an image forming apparatus simply by pulling the process cartridge toward the front side of the image forming apparatus after operating a lever. Therefore, even a large process cartridge can be easily dismounted from an image forming apparatus.

Further, the first and second guiding grooves for supporting a process cartridge from below are positioned at the bottom of the developer holding frame, sufficiently away from the photosensitive drum. Therefore, the axial line of the photosensitive drum follows a virtually vertical cylindrical curvature. In addition, the engaging member in the form of a pin, of a process cartridge is inserted into the cam groove with which a vertical movement level is provided. In other words, the means for vertically moving a process cartridge is simple in structure, and the weight of a process cartridge, which rests on the means for vertically moving a process cartridge, is directly applied to a process cartridge controlling lever (external lever 77) without going through a linking mechanism, enabling an operator to virtually directly feel the state of the process cartridge. Therefore, the operator can lift or lower the process cartridge at an appropriate speed.

The summary of the process cartridge, the method for connecting a developing means holding frame (developing means holding frame 17) and a developer holding frame (toner container 16), and the flexible sealing member, in the preceding embodiments of the present invention, which were described above, will be given below along with supplementary comments.

1. A process cartridge 15 detachably mountable to a main assembly 17 of an electrophotographic image forming apparatus, comprising:

an electrophotographic photosensitive drum 11;

a developing member 18, 26 for developing an electrostatic latent image formed on the electrophotographic photosensitive drum 11;

a developer frame 17 having a developer accommodating portion 16 for accommodating a developer to be used for developing the electrostatic latent image by the developing member 18, 26, wherein the developer frame 16 is provided with a developer supply opening 16*b* for supplying the developer accommodated in the developer accommodating portion 16 toward the developing member 18, 26;

a connecting member 33 mounted to the developer frame 16, the connecting member 33 being provided with a connecting member opening 33*b* opposed to the developer supply opening 16*b;* a drum frame 13 supporting the electrophotographic photosensitive drum 11;

a developing frame 17 supporting the developing member 18, 26, the developing frame 17 being movably connected with the developer frame 16 by a flexible seal 21, wherein the developing frame 17 is provided with a developer receiving opening 17*b* for receiving the developer having passed through the developer supply opening 16*b*, wherein the flexible seal 21 is provided with a first opening 21*f* and a second opening 21*e*, wherein the first opening 21*f* is opposed to the developer supply opening 16*b* and the connecting member opening 33*b*, and the second opening 21*e* is opposed to the developer receiving opening 17*b*, wherein the flexible seal 21 is stuck on the connecting member 33 at a periphery of the first opening 21*f*, and is stuck on the developing frame 17 at a periphery of the second opening 21*e*, and wherein the flexible seal 21 is made of a sheet which is folded back such that the first opening 21*f* and a second opening 21*e* are opposed to each other, and ends of surfaces of the sheet which are opposed to each other as a result of folding are stuck to each other. According to this aspect, the positional deviation between the developer accommodating portion and the developing frame can be properly accommodated, so the developer supply from the developer accommodating portion to the developing frame can be assured. In addition, because of the structure of the flexible seal, it can be easily manufactured.

2. A process cartridge 15 according to paragraph 1, wherein the developer frame 16 is provided with a developer seal for unsealably sealing the developer supply opening 16*b*, wherein the developer supply opening 16*b* is unsealed by peeling the developer seal off the developer frame 16, and the developer accommodated in the developer accommodating portion 16 is supplied toward the developing member 18, 26, and wherein the developer seal is disposed between the developer frame 16 and the connecting member 33. According to this aspect, the developer accommodating portion is sealed by the developer seal in addition to the flexible seal, so that the flexible seal is protected from an excessive load during transportation.

3. A process cartridge 15 according to paragraph 1 or 2, wherein the developer frame 16 is provided with a grip 30 on a top surface thereof, the top surface being on top of the process-cartridge when the process cartridge 15 is mounted in the main assembly 17 of the apparatus, and the grip 30 facilitates gripping by an operator when the a process cartridge 15 is transported. According to this aspect, the process cartridge can be easily handled even when the capacity thereof is large.

4. A process cartridge 15 according to paragraph 1 or 2, wherein the drum frame 13 is provided with an exposure opening 13*g* which is effective to permit information light to reach the electrophotographic photosensitive drum 11 from the main assembly 17 when the a process cartridge 15 is mounted to the main assembly 17 of the apparatus.

5. A process cartridge 15 according to paragraph 1 or 2, wherein the drum frame 13 is provided with a charging member for electrically charging the electrophotographic photosensitive drum 11 and a cleaning member for removing residual developer from the electrophotographic photosensitive drum 11.

6. A process cartridge 15 according to paragraph 1 or 2, wherein the flexible seal 21 is made of an elastic material, a sheet or film member.

7. A process cartridge 15 according to paragraph 7, wherein the flexible seal 21 is made of urethane foam, a heat-seal member, ester resin material, ethylenevinylacetate (EVA), polyurethane resin material, polyester resin material or olefin resin material.

8. A process cartridge] 15 according to paragraph 1, wherein the opposed surfaces of the flexible seal 21 are stuck at end portions of three sides thereof.

9. A method of movably connecting a developing frame 17 and a developer frame 16, wherein the developing frame 17 supports a developing member 18, 26 and is provided with a developer receiving opening 17*b* for receiving a developer, and the developer frame 16 is provided with a developer accommodating portion 16 for accommodating of the developer and a developer supply opening 16*b* for supplying the developer in the developer accommodating portion 16 toward the developing member 18, 26, comprises:

(a) a step of holding a flexible seal 21 having a bonding layer and a peelable member 25*b* covering the bonding layer on a holding device 31, the flexible seal 21 having a first opening 21*f* and a second opening 21*e;*

(b) a step of peeling the peelable member 25*b* from the flexible seal 21 held on the holding device 31;

(c) a step of positioning the flexible seal 21 relative to a connecting member 33 and the developer frame 16 while the flexible seal 21 from which the peelable member 25*b* has been removed is held on the holding device 31, such that the first opening 21*f* and an opening of the connecting member 33 are opposed to each other and such that the second openinig 21*e* and the developer receiving opening 17*b* are opposed to each other;

(d) a first bonding step of bonding a peripheral portion of the first opening 21*f* of the flexible seal 21 on the connecting member 33 and bonding a peripheral portion of the second opening 21*e* on the developing frame 17;

(e) a step of the releasing the flexible seal 21 from the holding device 31;

(f) a step of opposing the developer frame 16 and the connecting member 33 to each other with the flexible seal 21 inside;

(g) a second bonding step of bonding end portions of opposing surfaces of the flexible seal 21 to each other; and (h) a third bonding step of bonding the connecting member 33 to the developer frame 16. According to this aspect, the flexible sheet which may be thin can be bonded to the developer accommodating portion and to the developing frame, and the flexible seal may be of the envelope type.

10. A method according to paragraph 9, wherein the holding step uses negative pressure or electrostatic attraction force to hold the flexible seal 21 on the holding device 31.

11. A method according to paragraph 9 or 10, wherein the first in the second bonding steps use impulse sealing, and the third bonding step uses ultrasonic wave welding.

12. A method according to paragraph 9 or 10, wherein the flexible seal 21 is made of an elastic material, a sheet or a film member.

13. A method according to paragraph 12, wherein the flexible seal 21 is made of urethane foam, a heat-seal member, ester resin material, ethylenevinylacetate (EVA), polyurethane resin material, polyester resin material or olefin resin material.

14. A method according to paragraph 9 or 10, wherein the flexible seal 21 is mounted to the developer frame 16 and to the connecting member 33 by impulse sealing.

15. A method according to paragraph 9, wherein in said second bonding step, the opposed surfaces are bonded at the end portion of each of three sides.

16. A flexible sealing member is for movably connecting a developer frame 16 and a developing frame 17, wherein the developing frame 17 is for supporting a developing member 18, 26 and is provided with a developer receiving opening 17*b* for receiving a developer, and wherein the developer frame 16 is provided with a developer accommodating portion 16 for accommodating the developer and a developer supply opening 16*b* for supplying developer to the developer accommodating portion 16 toward the developing member 18, 26, the flexible sealing member comprises:

(a) a first bonding portion 21*h* for bonding with a connecting member 33 mounted to the developer frame 16 (FIG. 10);

(b) a second bonding portion 21*m* for bonding with the developing frame 17;

(c) a first opening 21*f* for opposing to a connecting member opening 33*b* of the connecting member 33; and (d) a second opening 21*e* for opposing to the developer receiving opening 17*b*.

According to this aspect, the flexible sealing member hardly resists the relative movement between the toner accommodating container and the developing frame.

17. A sealing member according to paragraph 16, wherein the flexible seal 21 is made of an elastic material, a sheet or a film member.

18. A sealing member according to paragraph 17, wherein the flexible sealing member 21 is made of urethane foam, a heat-seal member, ester resin material, ethylenevinylacetate (EVA), polyurethane resin material, polyester resin material or olefin resin material.

19. A sealing member according to paragraph 16, wherein the sealing member is constituted by a single layer.

As described in the foregoing, according to the present invention, the developing frame and the developer frame can be connected while the relative motion therebetween is permitted.

According to the present invention, a flexible seal which can accommodate the positional deviation between the developing frame and the developer frame, so that increases of the load applied to the developing member and the eletrophotographic photosensitive member can be avoided even when the capacity of the developer frame is increased.

According to the connecting method of the present invention between the developing frame and the developer frame, they can be easily connected to each other with a thin sheet, which may be an envelope type or a bellow type.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, comprising:

an electrophotographic photosensitive drum;

a developing member for developing an electrostatic latent image formed on said electrophotographic photosensitive drum;

a developer frame having a developer accommodating portion for accommodating a developer to be used for developing the electrostatic latent image by said developing member, wherein said developer frame is provided with a developer supply opening for supplying the developer accommodated in said developer accommodating portion toward said developing member;

a connecting member mounted to said developer frame, said connecting member being provided with a connecting member opening opposed to said developer supply opening;

a drum frame supporting said electrophotographic photosensitive drum; and a developing frame supporting said developing member, said developing frame being movably connected with said developer frame by a flexible seal, wherein said developing frame is provided with a developer receiving opening for receiving the developer having passed through said developer supply opening, wherein said flexible seal is provided with a first opening and a second opening, wherein said first opening is opposed to said developer supply opening and said connecting member opening, and said second opening is opposed to said developer receiving opening, wherein said flexible seal is stuck on said connecting member at a periphery of said first opening, and is stuck on said developing frame at a periphery of said second opening, and wherein said flexible seal is made of a sheet which is folded back such that said first opening and said second opening are opposed to each other, and ends of surfaces of the sheet which are opposed to each other as a result of folding are stuck to each other.

2. A process cartridge according to claim 1, wherein said developer frame is provided with a developer seal for unsealably sealing said developer supply opening, wherein said developer supply opening is unsealed by peeling said developer seal off said developer frame, and the developer accommodated in said developer accommodating portion is supplied toward said developing member, and wherein said developer seal is disposed between said developer frame and said connecting member.

3. A process cartridge according to claim 1 or 2, wherein said developer frame is provided with a grip on a top surface thereof, the top surface being on top of said process cartridge when said process cartridge is mounted in the main assembly of the apparatus, and said grip facilitates gripping by an operator when said process cartridge is transported.

4. A process cartridge according to claim 1 or 2, wherein said drum frame is provided with an exposure opening which is effective to permit information light to reach said electrophotographic photosensitive drum from the main assembly when said process cartridge is mounted to the main assembly of the apparatus.

5. A process cartridge according to claim 1 or 2, wherein said drum frame is provided with a charging member for electrically charging said electrophotographic photosensitive drum and a cleaning member for removing residual developer from said electrophotographic photosensitive drum.

6. A process cartridge according to claim 1 or 2, wherein said flexible seal is made of an elastic material, a sheet or film member.

7. A process cartridge according to claim 1, wherein said flexible seal is made of urethane foam, a heat-seal member, ester resin material, ethylenevinylacetate (EVA), polyurethane resin material, polyester resin material or olefin resin material.

8. A process cartridge according to claim 1, wherein said opposed surfaces of said flexible seal are stuck at end portions of three sides thereof.

9. A method of movably connecting a developing frame and a developer frame, wherein said developing frame supports a developing member and is provided with a developer receiving opening for receiving a developer, and said developer frame is provided with a developer accommodating portion for accommodating of the developer and a developer supply opening for supplying the developer in said developer accommodating portion toward said developing member, comprising:

(a) a step of holding a flexible seal having a bonding layer and a peelable member covering the bonding layer on a holding device, the flexible seal having a first opening and a second opening;

(b) a step of peeling the peelable member from the flexible seal held on the holding device;

(c) a step of positioning the flexible seal relative to a connecting member and the developer frame while the flexible seal from which the peelable member has been removed is held on the holding device, such that the first opening and an opening of the connecting member are opposed to each other and such that the second opening and the developer receiving opening are opposed to each other;

(d) a first bonding step of bonding a peripheral portion of the first opening of the flexible seal on the connecting member and bonding a peripheral portion of the second opening on the developing frame;

(e) a step of releasing the flexible seal from the holding device;

(f) a step of opposing the developer frame and the connecting member to each other with the flexible seal inside;

(g) a second bonding step of bonding end portions of opposing surfaces of the flexible seal to each other; and (h) a third bonding step of bonding the connecting member to the developer frame.

10. A method according to claim 9, wherein said holding step uses negative pressure or an electrostatic attraction force to hold the flexible seal on the holding device.

11. A method according to claim 9 or 10, wherein said first bonding step and said second bonding step use impulse sealing, and said third bonding step uses ultrasonic wave welding.

12. A method according to claim 9 or 10, wherein the flexible seal is made of an elastic material, a sheet or film member.

13. A method according to claim 12, wherein the flexible seal is made of urethane foam, a heat-seal member, ester resin material, ethylenevinylacetate (EVA), polyurethane resin material, polyester resin material or olefin resin material.

14. A method according to claim 9 or 10, wherein the flexible seal is mounted to the developer frame and to the connecting member by impulse sealing.

15. A method according to claim 9, wherein in said second bonding step, the opposed surfaces are bonded at the end portion of each of three sides of the flexible seal.

16. A flexible sealing member for movably connecting a developer frame and a developing frame, wherein the developing frame is for supporting a developing member and is provided with a developer receiving opening for receiving a developer, and wherein the developer frame is provided with a developer accommodating portion for accommodating the developer and a developer supply opening for supplying the developer from the developer accommodating portion toward the developing member, said flexible sealing member comprising:

(a) a first bonding portion for bonding with a connecting member mounted to the developer frame;

(b) a second bonding portion for bonding with the developing frame;

(c) a first opening for opposing to a connecting member opening of the connecting member; and (d) a second opening for opposing to the developer receiving opening.

17. A flexible sealing member according to claim 16, wherein said flexible sealing member is made of an elastic material, a sheet or film member.

18. A flexible sealing member according to claim 17, wherein said flexible sealing member is made of urethane foam, a heat-seal member, ester resin material, ethylenevinylacetate (EVA), polyurethane resin material, polyester resin material or olefin resin material.

19. A flexible sealing member according to claim 16, wherein said flexible sealing member is constituted by a single layer.

20. A developing apparatus for developing an electrostatic latent image formed on an electrophotographic photosensitive member with a developer, comprising:

a developing member for applying the developer to the electrophotographic photosensitive member;

a developing frame supporting said developer member and provided with a developer receiving opening for receiving the developer;

a developer accommodating container provided with an opening corresponding to the developer receiving opening of said developing frame; and a flexible seal for connecting said openings of said developing frame and said developer accommodating container in a sealed state, wherein said flexible seal is provided by folding a sheet and seals against the environment between said developing frame and said developer accommodating container while permitting relative positional change therebetween.

21. An apparatus according to claim 20, wherein said flexible seal is made of one sheet which is folded and bonded.

22. An apparatus according to claim 20 or 21, wherein said flexible seal is mounted to the openings by welding.

23. An apparatus according to claim 20 or 21, wherein said flexible seal is mounted to the openings by bonding.

24. A process cartridge detachably mountable to a main assembly of an image forming apparatus, comprising:

a developing device including a developing member for applying a developer to an electrophotographic photosensitive member, a developing frame supporting the developer member and the provided with an opening for receiving the developer, a developer accommodating container provided with an opening corresponding to the opening of said developing frame and a flexible seal for sealing between said developing frame and said developer accommodating container at the openings, wherein said flexible seal is provided by folding a sheet and seals against the environment between said developing frame and said developer accommodating container while permitting relative positional change therebetween.

25. A process cartridge according to claim 24, wherein said flexible seal is made of one sheet which is folded and bonded.

26. A process cartridge according to claim 24 or 25, wherein said flexible seal is mounted to the openings by welding.

27. A process cartridge according to claim 24 or 25, wherein said flexible seal is mounted to the openings by bonding.

28. A sealing member for a developing device, the developing device including a developing member for applying a developer to an electrophotographic photosensitive member, a developing frame supporting the developing member and provided with an opening for receiving the developer and a developer accommodating container provided with an opening corresponding to the opening of the developing frame, wherein said sealing member seals the developing frame and the developer accommodating container at the openings thereof, said sealing member being provided by folding and bonding a sheet and seals against the environment between the developing frame and the developer accommodating container while permitting relative positional change therebetween.

29. A sealing member according to claim 28, wherein said sealing member is made of one sheet which is folded and bonded.

30. A sealing member according to claim 28 or 29, wherein said sealing member is mounted to the openings by welding.

31. A sealing member according to claim 28 or 29, wherein said sealing member is mounted to the openings by bonding.

* * * * *

UNITED STATES PATENT AND TRADEMARK OFFICE

CERTIFICATE OF CORRECTION

PATENT NO. : 6,603,939 B1
DATED : August 5, 2003
INVENTOR(S) : Shinjiro Toba et al.

It is certified that error appears in the above-identified patent and that said Letters Patent is hereby corrected as shown below:

Title page,
Item [57], ABSTRACT,
Line 3, “an” should read -- a --.

Column 1,
Line 55, “efficiency” should read -- efficiency. --.

Column 13,
Line 16, “tape,” should read -- tape --.

Column 39,
Line 12, “terns” should read -- terms --.

Column 47,
Line 41, “the” should be deleted.

Signed and Sealed this

Thirtieth Day of March, 2004

JON W. DUDAS
*Acting Director of the United States Patent and Trademark Office*